US012268940B2

(12) United States Patent
Greensmith et al.

(10) Patent No.: US 12,268,940 B2
(45) **Date of Patent: *Apr. 8, 2025**

(54) GOLF CLUB HEAD

(71) Applicant: Taylor Made Golf Company, Inc, Carlsbad, CA (US)

(72) Inventors: Matthew Greensmith, Carlsbad, CA (US); Christopher Harbert, Carlsbad, CA (US); Todd Beach, San Diego, CA (US); Mark Greaney, Carlsbad, CA (US); Matthew D. Johnson, Carlsbad, CA (US)

(73) Assignee: TAYLOR MADE GOLF COMPANY, INC., Carlsbad, CA (US)

( * ) Notice: Subject to any disclaimer, the term of this patent is extended or adjusted under 35 U.S.C. 154(b) by 252 days.

This patent is subject to a terminal disclaimer.

(21) Appl. No.: 17/228,511

(22) Filed: Apr. 12, 2021

(65) Prior Publication Data

US 2022/0184470 A1 Jun. 16, 2022

Related U.S. Application Data

(63) Continuation-in-part of application No. 17/137,151, filed on Dec. 29, 2020, which is a continuation-in-part of application No. 17/124,134, filed on Dec. 16, 2020.

(51) Int. Cl.
*A63B 53/04* (2015.01)

(52) U.S. Cl.
CPC ..... *A63B 53/0437* (2020.08); *A63B 53/0412* (2020.08); *A63B 53/042* (2020.08); *A63B 53/0433* (2020.08)

(58) Field of Classification Search
CPC ..... A63B 53/0437; A63B 53/0433; A63B 53/042; A63B 53/0412
USPC ..... 473/324–350, 287–292
See application file for complete search history.

(56) References Cited

U.S. PATENT DOCUMENTS

| | | | |
|---|---|---|---|
| 4,872,685 | A | 10/1989 | Sun |
| 5,377,986 | A | 1/1995 | Viollaz et al. |
| 5,624,331 | A | 4/1997 | Lo et al. |
| 5,665,014 | A | 9/1997 | Sanford et al. |
| 5,997,415 | A | 12/1999 | Wood |

(Continued)

OTHER PUBLICATIONS

United States Golf Associate and R&A Rules Limited, Procedure for Measuring the Club Head Size of Wood Clubs; Revision 1.0.0, Nov. 21, 2003.

(Continued)

*Primary Examiner* — Sebastiano Passaniti
(74) *Attorney, Agent, or Firm* — Kunzler Bean & Adamson

(57) ABSTRACT

Disclosed herein is a driver-type golf club head that has a strike face. The strike face has a central region, defined by a 40 mm by 20 mm rectangular area centered on a geometric center of the strike face and elongated in a heel-to-toe direction. The driver-type golf club head is configured such that after 500 impacts of a standard golf ball at the geometric center of the strike face, where at each impact the standard golf ball has a velocity of 52 meters per second, the CT of the strike face at any point within the central region is less than 256 microseconds and the CT at the geometric center of the strike face is no more than five microseconds different than the initial CT value.

27 Claims, 23 Drawing Sheets

(56) References Cited

U.S. PATENT DOCUMENTS 6,017,280 A 1/2000 Hubert
6,149,534 A 11/2000 Peters et al.
6,390,933 B1 * 5/2002 Galloway ..... A63B 53/0466 473/305
6,525,157 B2 2/2003 Cozewith
6,773,360 B2 8/2004 Willet et al.
6,800,038 B2 10/2004 Willet et al.
6,824,475 B2 11/2004 Burnett et al.
6,997,820 B2 2/2006 Willet et al.
7,082,665 B2 8/2006 Deshmukh et al.
7,140,974 B2 11/2006 Chao et al.
7,166,040 B2 1/2007 Chao et al.
7,186,190 B1 3/2007 Beach et al.
7,223,180 B2 5/2007 Willet et al.
7,267,620 B2 9/2007 Chao et al.
7,407,447 B2 8/2008 Beach et al.
7,410,425 B2 8/2008 Willet et al.
7,410,426 B2 8/2008 Willet et al.
7,410,428 B1 8/2008 Dawson et al.
7,419,441 B2 9/2008 Hoffman et al.
7,448,963 B2 11/2008 Beach et al.
7,452,285 B2 11/2008 Chao et al.
7,530,904 B2 5/2009 Beach et al.
7,540,811 B2 6/2009 Beach et al.
7,568,985 B2 8/2009 Beach et al.
7,578,753 B2 8/2009 Beach et al.
7,591,738 B2 9/2009 Beach et al.
7,621,823 B2 11/2009 Beach et al.
7,628,707 B2 12/2009 Beach et al.
7,628,712 B2 12/2009 Chao et al.
7,632,194 B2 12/2009 Beach et al.
7,713,142 B2 5/2010 Hoffman et al.
7,717,804 B2 5/2010 Beach et al.
7,717,805 B2 5/2010 Beach et al.
7,731,603 B2 6/2010 Beach et al.
7,744,484 B1 6/2010 Chao et al.
RE41,577 E 8/2010 McLean et al.
7,775,905 B2 8/2010 Beach et al.
7,798,919 B2 9/2010 Kubota et al.
7,846,041 B2 12/2010 Beach et al.
7,871,340 B2 1/2011 Chao et al.
7,874,936 B2 1/2011 Chao
7,874,937 B2 1/2011 Chao
7,874,938 B2 1/2011 Chao
7,887,431 B2 2/2011 Beach et al.
7,963,861 B2 6/2011 Beach et al.
RE42,544 E 7/2011 Chao et al.
7,985,146 B2 7/2011 Lin et al.
8,025,587 B2 9/2011 Beach et al.
8,096,897 B2 1/2012 Beach et al.
8,163,119 B2 4/2012 Chao
8,235,831 B2 8/2012 Beach et al.
8,235,844 B2 8/2012 Albertson et al.
8,241,143 B2 8/2012 Albertson et al.
8,241,144 B2 8/2012 Albertson et al.
8,303,431 B2 11/2012 Beach et al.
8,337,319 B2 12/2012 Sargent et al.
8,353,786 B2 1/2013 Beach et al.
8,444,505 B2 5/2013 Beach et al.
8,608,591 B2 12/2013 Chao et al.
8,628,434 B2 1/2014 Chao
8,734,271 B2 5/2014 Beach et al.
8,870,678 B2 10/2014 Beach et al.
8,888,607 B2 11/2014 Harbert et al.
8,900,069 B2 12/2014 Beach et al.
8,926,450 B2 1/2015 Takahashi et al.
8,979,669 B2 3/2015 Greaney et al.
9,033,821 B2 5/2015 Beach et al.
9,044,653 B2 6/2015 Wahl et al.
9,174,096 B2 11/2015 Sargent et al.
9,220,953 B2 12/2015 Beach et al.
9,259,625 B2 2/2016 Beach et al.
9,278,267 B2 3/2016 Chao et al.
9,468,816 B2 10/2016 Barelmann et al.
9,662,545 B2 5/2017 Beach et al.
9,925,432 B2 3/2018 Morales et al.
9,943,733 B2 4/2018 Franklin et al.
10,035,049 B1 7/2018 Nielson et al.
10,046,212 B2 8/2018 Sargeant et al.
10,195,497 B1 * 2/2019 Greaney ..... A63B 60/002
10,434,381 B2 * 10/2019 Stokke ..... A63B 53/04
10,874,915 B2 12/2020 Greensmith et al.
10,874,920 B2 12/2020 Issertell et al.
10,881,917 B2 1/2021 Greensmith et al.
11,110,325 B2 9/2021 Spackman et al.
2002/0142861 A1 10/2002 Helmstetter et al.
2005/0187034 A1 * 8/2005 Rice ..... A63B 53/0466 473/345
2006/0068932 A1 * 3/2006 Rice ..... A63B 53/0466 473/345
2007/0004531 A1 1/2007 Galloway et al.
2007/0049415 A1 * 3/2007 Shear ..... A63B 53/0466 473/349
2007/0287554 A1 12/2007 Gilbert et al.
2007/0293344 A1 12/2007 Davis
2008/0149267 A1 6/2008 Chao
2009/0163289 A1 6/2009 Chao
2010/0125000 A1 5/2010 Lee et al.
2010/0160091 A1 6/2010 Boyd et al.
2010/0178996 A1 * 7/2010 Chao ..... A63B 53/0466 473/349
2010/0203983 A1 8/2010 Stites
2010/0279793 A1 11/2010 Burnett et al.
2011/0152000 A1 6/2011 Sargent et al.
2011/0275446 A1 11/2011 Rahrig et al.
2011/0275451 A1 11/2011 Chao
2011/0312437 A1 12/2011 Sargent et al.
2011/0319190 A1 * 12/2011 Wada ..... A63B 53/0466 473/349
2012/0071264 A1 3/2012 Beach et al.
2012/0083361 A1 4/2012 Beach et al.
2012/0122601 A1 5/2012 Beach et al.
2012/0199282 A1 8/2012 Chao et al.
2012/0258818 A1 10/2012 Beach et al.
2013/0123040 A1 5/2013 Willet et al.
2014/0011605 A1 1/2014 Lee
2014/0302946 A1 10/2014 Rae et al.
2015/0005096 A1 1/2015 Willet et al.
2015/0335963 A1 11/2015 Sugimae et al.
2015/0367206 A1 * 12/2015 Larson ..... A63B 53/0466 473/332
2016/0023063 A1 * 1/2016 Willett ..... A63B 53/0466 29/401.1
2018/0071589 A1 3/2018 Beach et al.
2018/0178087 A1 6/2018 Beach et al.
2018/0185719 A1 7/2018 Johnson et al.
2019/0046845 A1 2/2019 Greensmith et al.
2019/0201754 A1 * 7/2019 Hoffman ..... A63B 53/06
2019/0201759 A1 7/2019 Hoffman et al.
2020/0121994 A1 4/2020 Greensmith et al.
2020/0215399 A1 7/2020 Stokke
2022/0184466 A1 6/2022 Greensmith et al.
2022/0184472 A1 6/2022 Greensmith et al.
2022/0184473 A1 6/2022 Greensmith et al.
2022/0193505 A1 6/2022 Greensmith et al.

OTHER PUBLICATIONS

Hopley, M., TaylorMade M6 Driver Review, GOLFALOT, https://www.golfalot.com/equipment-reviews/taylormade-m6-driver-review-4143.aspx, accessed Dec. 28, 2020.
U.S. Appl. No. 16/752,397, filed Jan. 24, 2020.
U.S. Appl. No. 16/660,561, filed Oct. 22, 2019.
U.S. Appl. No. 17/006,561, filed Aug. 28, 2020.
GLOIRE Reserve DRIVER Limitless Technology, YouTube video, https://www.youtube.com/watch?v=dNqGaGln57M, accessed Dec. 29, 2020.
Achenbach, J., 2002: Business—Callaway's C4 looking to break sound barrier, Golfweek, https://golfweek.usatoday.com/2002/11/02/2002-business-callaways-c4-looking-break-sound-bar/, accessed Dec. 29, 2020.

(56) References Cited

OTHER PUBLICATIONS

Callaway Big Bertha C4 Carbon Fiber Driver & Cover NM, https://www.worthpoint.com/worthopedia/callaway-big-bertha-c4-carbon-fiber-169221581, accessed Dec. 29, 2020.
U.S. Appl. No. 17/224,026, filed Apr. 6, 2021.
Vapor Fly Clubs, https://news.nike.com/news/vapor-fly-clubs, accessed Mar. 8, 2022.
Nike Vapor Flex 440 Driver Review, https://www.golfalot.com/equipment-reviews/nike-vapor-flex-440-driver-review-3384.aspx, accessed Mar. 8, 2022.
U.S. Appl. No. 17/691,649, filed Mar. 10, 2022.

* cited by examiner

GOLF CLUB HEAD

CROSS-REFERENCE TO RELATED APPLICATIONS

This application is a continuation-in-part of U.S. patent application Ser. No. 17/137,151, filed Dec. 29, 2020, which is a continuation-in-part of U.S. patent application Ser. No. 17/124,134, filed Dec. 16, 2020, both of which are incorporated herein by reference in their entirety.

FIELD

This disclosure relates generally to golf clubs, and more particularly to a head of a driver-type golf club that helps reduce characteristic time (CT) creep along the strike face of the driver-type golf club head due to multiple impacts with a golf ball.

BACKGROUND

Modern "wood-type" golf clubs (notably, "drivers," "fairway woods," and "utility or hybrid clubs"), are generally called "metalwoods" since they tend to be made of strong, lightweight metals, such as titanium. An exemplary metalwood golf club, such as a driver or fairway wood, typically includes a hollow shaft and a golf club head coupled to a lower end of the shaft. The golf club heads of metal woods includes a hollow body with a face portion. The face portion has a front surface, known as a strike face, configured to contact the golf ball during a proper golf swing.

Under USGA regulations governing the configuration of golf club heads, the characteristic time (CT) of a golf club head at all points on the strike face within a hitting zone cannot exceed a regulated CT threshold. Moreover, USGA regulations require the CT of a golf club head to remain within the regulated limit regardless of the number of impacts the golf club head has with a golf ball. The CT of conventional driver-type golf club heads tends to increase after multiple impacts with a golf ball. The increase of CT due to impacts with a golf ball is known as CT creep. Often, in many driver-type golf club heads, after a sufficient number of impacts with a golf ball, the CT along the strike face increases to a value that exceeds the regulated CT threshold. Once the CT of a golf club head has crept above the regulated CT threshold, the golf club head is no longer in compliance with USGA regulations. Prolonging compliance with CT regulations governed by the USGA by reducing CT creep is desirable, but can be difficult to accomplish with current golf club head designs and manufacturing techniques.

SUMMARY

The subject matter of the present application has been developed in response to the present state of the art, and in particular, in response to the shortcomings of golf clubs and associated golf club heads, that have not yet been fully solved. Accordingly, the subject matter of the present application has been developed to provide a golf club and golf club head that overcome at least some of the above-discussed shortcomings.

Disclosed herein is a driver-type golf club head that comprises a forward portion, which comprises a strike face. The driver-type golf club head also comprises a rearward portion, opposite the forward portion. The driver-type golf club head further comprises a crown portion and a sole portion, opposite the crown portion. The driver-type golf club head also comprises a skirt portion, positioning around a periphery of the golf club head between the sole portion and the crown portion. The driver-type golf club head further comprises a heel portion and a toe portion, opposite the heel portion. The driver-type golf club head also comprises a hollow interior region defined by the forward portion, the rearward portion, the crown portion, the sole portion, the skirt portion, the heel portion, and the toe portion. The driver-type golf club head further comprises at least one of a crown opening, formed in the crown portion, or a sole opening, formed in the sole portion, each one of the crown opening and the sole opening is open to the hollow interior region. The driver-type golf club head additionally comprises an insert covering each one of the at least one crown opening, to form part of the crown portion, and the sole opening, to form part of the sole portion. The insert is made of a non-metal material having a density between about 1 $g/cm^3$ and about 2 $g/cm^3$. The strike face is void of through-apertures open to the hollow interior region. A volume of the driver-type golf club head is between 350 $cm^3$ and 500 $cm^3$. The golf club head has a center-of-gravity (CG) with an x-axis coordinate, on an x-axis of a head center face origin coordinate system of the golf club head, between −7 mm and 7 mm and a y-axis coordinate, on a y-axis of the head center face origin coordinate system of the golf club head, between 25 mm and 50 mm, and a z-axis coordinate, on a z-axis of the head center face origin coordinate system of the golf club head, less than 2 mm. The strike face of the forward portion has a central region, defined by a 40 mm by 20 mm rectangular area centered on a geometric center of the strike face and elongated in a heel-to-toe direction. A summation of a moment of inertia of the golf club head about a z-axis of a head center-of-gravity coordinate system (Izz) and a moment of inertia of the golf club head about an x-axis of the head center-of-gravity coordinate system (Ixx) is between about 740 $kg \cdot mm^2$ and about 1,100 $kg \cdot mm^2$. A characteristic time (CT) of the strike face, within the central region, is no more than 257 microseconds. Before the strike face impacts a golf ball, the CT of the strike face, at the geometric center of the strike face, has an initial CT value of at least 244 microseconds. The driver-type golf club head is configured such that after 500 impacts of a standard golf ball at the geometric center of the strike face, where at each impact the standard golf ball has a velocity of 52 meters per second, the CT of the strike face at any point within the central region is less than 256 microseconds and the CT at the geometric center of the strike face is no more than five microseconds different than the initial CT value. The preceding subject matter of this paragraph characterizes example 1 of the present disclosure.

The strike face, the forward portion, at least part of the crown portion, at least part of the sole portion, at least part of the skirt portion, at least part of the heel portion, and at least part of the toe portion form a one-piece monolithic construction and are made of the same material. A minimum thickness of the forward portion at the strike face is between 1.5 mm and 2.5 mm. A maximum thickness of the forward portion at the strike face is less than 3.7 mm. An interior surface of the forward portion, opposite the strike face, is not chemically etched and has an alpha case thickness of no more than 0.30 mm. The preceding subject matter of this paragraph characterizes example 2 of the present disclosure, wherein example 2 also includes the subject matter according to example 1, above.

The forward portion further comprises a strike plate that defines the strike face. The forward portion comprises a plate opening. The strike plate encloses the plate opening. The strike plate is made of a first alloy of a metallic material, the first alloy having a first ultimate tensile strength. The forward portion, other than the strike plate, is made of a second alloy of the metallic material, the second alloy having a second ultimate tensile strength that is less than the first ultimate tensile strength by at least 10%. The first ultimate tensile strength is at least 1,000 MPa. A minimum thickness of the strike plate is between 1.5 mm and 2.5 mm. A maximum thickness of the strike plate is less than 3.7 mm. An interior surface of the strike plate, opposite the strike face, is not chemically etched and has an alpha case thickness of no more than 0.30 mm. The preceding subject matter of this paragraph characterizes example 3 of the present disclosure, wherein example 3 also includes the subject matter according to any one of examples 1-2, above.

The first ultimate tensile strength is at least 1,100 MPa. The preceding subject matter of this paragraph characterizes example 4 of the present disclosure, wherein example 4 also includes the subject matter according to example 3, above.

The driver-type golf club head further comprises a body that defines the forward portion, other than the strike plate. The plate opening is formed in the body. The strike plate is one of welded, bonded, or brazed to the body. The preceding subject matter of this paragraph characterizes example 5 of the present disclosure, wherein example 5 also includes the subject matter according to any one of examples 3-4, above.

The forward portion further comprises a strike plate that defines the strike face. The forward portion comprises a plate opening. The strike plate encloses the plate opening. The strike plate is made of a non-metal material having a density between 1 g/cm$^3$ and 2 g/cm$^3$. The preceding subject matter of this paragraph characterizes example 6 of the present disclosure, wherein example 6 also includes the subject matter according to examples 1, above.

The driver-type golf club head further comprises a body that defines the forward portion, other than the strike plate. The plate opening is formed in the body, and the strike plate is adhered to the body. The preceding subject matter of this paragraph characterizes example 7 of the present disclosure, wherein example 7 also includes the subject matter according to example 6, above.

The non-metal material of the strike plate comprises a fiber-reinforced polymer. The preceding subject matter of this paragraph characterizes example 8 of the present disclosure, wherein example 8 also includes the subject matter according to any one of examples 6-7, above.

The strike plate comprises a plurality of plies. Each one of the plies is made of the non-metal material. The strike plate has a variable thickness. The preceding subject matter of this paragraph characterizes example 9 of the present disclosure, wherein example 9 also includes the subject matter according to any one of examples 6-8, above.

The strike plate comprises a base portion and a cover applied onto the base portion. The cover defines the strike face. The base portion is made of a fiber-reinforced polymer. The cover is made of a fiber-less polymer. The preceding subject matter of this paragraph characterizes example 10 of the present disclosure, wherein example 10 also includes the subject matter according to any one of examples 6-9, above.

The driver-type golf club head further comprises a body that defines the forward portion, other than the strike plate. The plate opening is formed in the body. The strike plate is adhered to the body. The fiber-less polymer comprises polyurethane. the cover comprises grooves. A surface roughness of the cover is greater than a surface roughness of the body. The preceding subject matter of this paragraph characterizes example 11 of the present disclosure, wherein example 11 also includes the subject matter according to example 10, above.

A maximum thickness of the strike plate, within a preferred impact zone, is between 4.3 mm and 5.15 mm. The preferred impact zone is centered at a geometric center of the strike face. The preferred impact zone has an ovular shape with a height of between 17 mm and 45 mm, in a crown-to-sole direction, and a length of between 28 mm and 65 mm, in a heel-to-toe direction. The preceding subject matter of this paragraph characterizes example 12 of the present disclosure, wherein example 12 also includes the subject matter according to any one of examples 6-11, above.

A maximum thickness of the strike plate, within the preferred impact zone, is between 4.0 mm and 5.15 mm. The preceding subject matter of this paragraph characterizes example 13 of the present disclosure, wherein example 13 also includes the subject matter according to example 12, above.

The maximum thickness of the strike plate is located at a geometric center of the strike face. The preceding subject matter of this paragraph characterizes example 14 of the present disclosure, wherein example 14 also includes the subject matter according to any one of examples 12-13, above.

The strike face comprises a toe edge region and a heel edge region outside of the preferred impact zone such that the preferred impact zone is between the toe edge region and the heel edge region. The toe edge region is closer to the toe portion than the heel edge region. The heel edge region is closer to the heel portion than the toe edge region. A thickness of the strike plate transitions from the maximum thickness, within the preferred impact zone, to a toe edge region thickness, within the toe edge region, between 3.85 mm and 4.5 mm. The toe edge region thickness is less than the maximum thickness. The preceding subject matter of this paragraph characterizes example 15 of the present disclosure, wherein example 15 also includes the subject matter according to any one of examples 12-14, above.

The preferred impact zone of the strike face has an area between 500 mm$^2$ and 1,800 mm$^2$. The preceding subject matter of this paragraph characterizes example 16 of the present disclosure, wherein example 16 also includes the subject matter according to any one of examples 12-15, above.

The strike plate has a total mass between 22 grams and 28 grams. The preceding subject matter of this paragraph characterizes example 17 of the present disclosure, wherein example 17 also includes the subject matter according to any one of examples 12-16, above.

The non-metal material of the strike plate comprises a fiber-reinforced polymer comprising fibers embedded in a resin. A percent composition of the resin in the fiber-reinforced polymer is between 38% and 44%. The preceding subject matter of this paragraph characterizes example 18 of the present disclosure, wherein example 18 also includes the subject matter according to any one of examples 12-17, above.

A thickness of the strike plate, within a preferred impact zone on the strike face, is variable. A thickness of the strike plate outside of the preferred impact zone is constant. The preferred impact zone is centered at a geometric center of the strike face. The preferred impact zone has an ovular shape with a height of between 17 mm and 45 mm, in a crown-to-sole direction, and a length of between 28 mm and 65 mm, in a heel-to-toe direction. The preceding subject matter of this paragraph characterizes example 19 of the present disclosure, wherein example 19 also includes the subject matter according to any one of examples 6-18, above.

The thickness of the strike plate, within the preferred impact zone, is between 3.5 mm and 5.0 mm. The thickness of the strike plate, outside of the preferred impact zone, is between 3.5 mm and 4.2 mm. The thickness of the strike plate within the preferred impact zone is greater than the thickness of the strike plate outside of the preferred impact zone. The preceding subject matter of this paragraph characterizes example 20 of the present disclosure, wherein example 20 also includes the subject matter according to example 19, above.

A maximum thickness of the strike plate is between 4.0 mm and 5.5 mm, and a minimum thickness of the strike plate is between 3.0 mm and 4.0 mm. The preceding subject matter of this paragraph characterizes example 21 of the present disclosure, wherein example 21 also includes the subject matter according to any one of examples 6-20, above.

The forward portion further comprises a plate-opening recessed ledge that defines the plate opening. The strike plate is seatably engaged with the plate-opening recessed ledge of the forward portion. The preceding subject matter of this paragraph characterizes example 22 of the present disclosure, wherein example 22 also includes the subject matter according to any one of examples 6-21, above.

The strike plate is adhesively bonded to the plate-opening recessed ledge. The preceding subject matter of this paragraph characterizes example 23 of the present disclosure, wherein example 23 also includes the subject matter according to example 22, above.

The plate-opening recessed ledge defines a bonding surface to which the strike plate is adhesively bonded. A surface area of the bonding surface adhesively bonded to the strike plate is between 850 $mm^2$ and 1,800 $mm^2$. The preceding subject matter of this paragraph characterizes example 24 of the present disclosure, wherein example 24 also includes the subject matter according to example 23, above.

The plate-opening recessed ledge defines a bonding surface to which the strike plate is adhesively bonded. A ratio of a surface area of the bonding surface adhesively bonded to the strike plate to a total surface area of an interior surface of the strike plate, opposite the strike face, is between 0.21 and 0.45. The preceding subject matter of this paragraph characterizes example 25 of the present disclosure, wherein example 25 also includes the subject matter according to any one of examples 23-24, above.

The strike plate is adhesively bonded to the plate-opening recessed ledge with a layer of adhesive. The forward portion further comprises a sidewall angled relative to the plate-opening recessed ledge and defining a radially outer periphery of the plate-opening recessed ledge away from a center of the plate opening. The layer of adhesive is interposed between the plate-opening recessed ledge and the strike plate and interposed between the sidewall and the strike plate. A thickness of the layer of adhesive between the plate-opening recessed ledge and the strike plate is between 0.25 mm and 0.45 mm. A thickness of the layer of adhesive between the sidewall and the strike plate is between 0.15 mm and 0.25 mm. The preceding subject matter of this paragraph characterizes example 26 of the present disclosure, wherein example 26 also includes the subject matter according to any one of examples 23-25, above.

The strike plate is adhesively bonded to the plate-opening recessed ledge with a layer of adhesive. The forward portion further comprises a sidewall angled relative to the plate-opening recessed ledge and defining a radially outer periphery of the plate-opening recessed ledge away from a center of the plate opening. The layer of adhesive is interposed between the plate-opening recessed ledge and the strike plate and interposed between the sidewall and the strike plate. A thickness of the layer of adhesive between the plate-opening recessed ledge and the strike plate is greater than a thickness of the layer of adhesive between the sidewall and the strike plate. The preceding subject matter of this paragraph characterizes example 27 of the present disclosure, wherein example 27 also includes the subject matter according to any one of examples 23-26, above.

The plate-opening recessed ledge comprises a top plate-opening recessed ledge extending adjacently along the crown portion of the driver-type golf club head. The top plate-opening recessed ledge has a top ledge width. The top plate-opening recessed ledge has a top ledge thickness. The top ledge thickness of the top plate-opening recessed ledge varies along the top ledge width of the top plate-opening recessed ledge. The preceding subject matter of this paragraph characterizes example 28 of the present disclosure, wherein example 28 also includes the subject matter according to any one of examples 22-27, above.

The top ledge thickness of the top plate-opening recessed ledge decreases along the top ledge width of the top plate-opening recessed ledge in a crown-to-sole direction. The preceding subject matter of this paragraph characterizes example 29 of the present disclosure, wherein example 29 also includes the subject matter according to example 28 above.

The top ledge thickness of the top plate-opening recessed ledge varies such that a maximum value of the top ledge thickness is between 30% and 60% greater than a minimum value of the top ledge thickness. The preceding subject matter of this paragraph characterizes example 30 of the present disclosure, wherein example 30 also includes the subject matter according to example 29 above.

The top ledge thickness of the top plate-opening recessed ledge varies between a maximum value of 1.7 mm and a minimum value of 0.8 mm. The preceding subject matter of this paragraph characterizes example 31 of the present disclosure, wherein example 31 also includes the subject matter according to any one of examples 29-30, above.

The plate-opening recessed ledge comprises a top plate-opening recessed ledge extending adjacently along the crown portion of the driver-type golf club head. The top plate-opening recessed ledge has a top ledge width. The top plate-opening recessed ledge has a top ledge thickness. The top ledge width of the top plate-opening recessed ledge is greater than 4.5 mm and less than 8.0 mm. The preceding subject matter of this paragraph characterizes example 32 of the present disclosure, wherein example 32 also includes the subject matter according to any one of examples 22-31, above.

The top ledge width of the top plate-opening recessed ledge is greater than 5.0 mm and less than 8.0 mm. The preceding subject matter of this paragraph characterizes example 33 of the present disclosure, wherein example 33 also includes the subject matter according to example 32, above.

The top ledge width of the top plate-opening recessed ledge is greater than 5.5 mm and less than 8.0 mm. The preceding subject matter of this paragraph characterizes example 34 of the present disclosure, wherein example 34 also includes the subject matter according to example 33, above.

The plate-opening recessed ledge comprises a top plate-opening recessed ledge extending adjacently along the crown portion of the driver-type golf club head. The top plate-opening recessed ledge has a top ledge width. The top plate-opening recessed ledge has a top ledge thickness. A ratio of the top ledge width of the top plate-opening recessed ledge to a maximum height of the strike plate is between 0.08 and 0.15. The preceding subject matter of this paragraph characterizes example 35 of the present disclosure, wherein example 35 also includes the subject matter according to any one of examples 22-34, above.

The plate-opening recessed ledge comprises a top plate-opening recessed ledge extending adjacently along the crown portion of the driver-type golf club head. The top plate-opening recessed ledge has a top ledge width. The top plate-opening recessed ledge has a top ledge thickness. A ratio of the top ledge width of the top plate-opening recessed ledge to a maximum height of the plate opening is between 0.07 and 0.15. The preceding subject matter of this paragraph characterizes example 36 of the present disclosure, wherein example 36 also includes the subject matter according to any one of examples 22-35, above.

A ratio of a thickness of the top-plate opening recessed ledge to a thickness of the strike plate is between 0.2 and 1.2. The preceding subject matter of this paragraph characterizes example 37 of the present disclosure, wherein example 37 also includes the subject matter according to example 36, above.

The plate-opening recessed ledge comprises a top plate-opening recessed ledge extending adjacently along the crown portion of the driver-type golf club head. The top plate-opening recessed ledge has a top ledge width. The top plate-opening recessed ledge has a top ledge thickness. A ratio of the top ledge width to the top ledge thickness is between 2.6 and 10. The preceding subject matter of this paragraph characterizes example 38 of the present disclosure, wherein example 38 also includes the subject matter according to any one of examples 22-37, above.

The plate-opening recessed ledge comprises a top plate-opening recessed ledge extending adjacently along the crown portion of the driver-type golf club head. The top plate-opening recessed ledge has a top ledge width. The top plate-opening recessed ledge has a top ledge thickness. The forward portion of the driver-type golf club head further comprises an internal recess adjacent the top plate-opening recessed ledge in a sole-to-crown direction. The internal recess has a depth that extends in a back-to front direction such that in a sole-to-crown direction the internal recess is between the top plate-opening recess ledge and a top of the forward portion of the driver-type golf club head. The preceding subject matter of this paragraph characterizes example 39 of the present disclosure, wherein example 39 also includes the subject matter according to any one of examples 22-38, above.

The driver-type golf club head further comprises an interior mass pad formed in the crown portion at a location adjacent the top plate-opening recess ledge and between and offset from the heel portion and the toe portion. A portion of the internal recess is formed in the mass pad. The interior mass pad extends along only a portion of a length, that extends in a heel-to-toe direction, of the top plate-opening recess ledge. The preceding subject matter of this paragraph characterizes example 40 of the present disclosure, wherein example 40 also includes the subject matter according to example 39, above.

A thickness of the crown portion at the internal recess is thicker at the interior mass pad than away from the interior mass pad. The preceding subject matter of this paragraph characterizes example 41 of the present disclosure, wherein example 41 also includes the subject matter according to example 40, above.

The plate-opening recessed ledge comprises a bottom plate-opening recessed ledge extending adjacently along the sole portion of the driver-type golf club head. The bottom plate-opening recessed ledge has a bottom ledge width. The bottom plate-opening recessed ledge has a bottom ledge thickness. The bottom ledge thickness of the bottom plate-opening recessed ledge varies along the bottom ledge width of the bottom plate-opening recessed ledge. The preceding subject matter of this paragraph characterizes example 42 of the present disclosure, wherein example 42 also includes the subject matter according to any one of examples 22-41, above.

The bottom ledge thickness of the bottom plate-opening recessed ledge decreases along the bottom ledge width of the bottom plate-opening recessed ledge in a sole-to-crown direction. The preceding subject matter of this paragraph characterizes example 43 of the present disclosure, wherein example 43 also includes the subject matter according to example 42, above.

The bottom ledge thickness of the bottom plate-opening recessed ledge varies such that a maximum value of the bottom ledge thickness is between 30% and 60% greater than a minimum value of the bottom ledge thickness. The preceding subject matter of this paragraph characterizes example 44 of the present disclosure, wherein example 44 also includes the subject matter according to example 43, above.

The bottom ledge thickness of the bottom plate-opening recessed ledge varies between a maximum value of 1.7 mm and a minimum value of 0.8 mm. The preceding subject matter of this paragraph characterizes example 45 of the present disclosure, wherein example 45 also includes the subject matter according to any one of examples 43-44, above.

The plate-opening recessed ledge comprises a bottom plate-opening recessed ledge extending adjacently along the crown portion of the driver-type golf club head. The bottom plate-opening recessed ledge has a bottom ledge width. The bottom plate-opening recessed ledge has a bottom ledge thickness. The bottom ledge width of the bottom plate-opening recessed ledge is greater than 4.5 mm and less than 8.0 mm. The preceding subject matter of this paragraph characterizes example 46 of the present disclosure, wherein example 46 also includes the subject matter according to any one of examples 22-45, above.

The bottom ledge width of the bottom plate-opening recessed ledge is greater than 5.0 mm and less than 8.0 mm. The preceding subject matter of this paragraph characterizes example 47 of the present disclosure, wherein example 47 also includes the subject matter according to example 46, above.

The bottom ledge width of the bottom plate-opening recessed ledge is greater than 5.5 mm and less than 8.0 mm. The preceding subject matter of this paragraph characterizes example 48 of the present disclosure, wherein example 48 also includes the subject matter according to example 47, above.

The plate-opening recessed ledge comprises a bottom plate-opening recessed ledge extending adjacently along the crown portion of the driver-type golf club head. The bottom plate-opening recessed ledge has a bottom ledge width. The bottom plate-opening recessed ledge has a bottom ledge thickness. A ratio of the bottom ledge width of the bottom plate-opening recessed ledge to a maximum height of the face plate is between 0.08 and 0.15. The preceding subject matter of this paragraph characterizes example 49 of the present disclosure, wherein example 49 also includes the subject matter according to any one of examples 22-48, above.

The plate-opening recessed ledge comprises a bottom plate-opening recessed ledge extending adjacently along the crown portion of the driver-type golf club head. The bottom plate-opening recessed ledge has a bottom ledge width. The bottom plate-opening recessed ledge has a bottom ledge thickness. A ratio of the bottom ledge width of the bottom plate-opening recessed ledge to a maximum height of the plate opening is between 0.07 and 0.15. The preceding subject matter of this paragraph characterizes example 50 of the present disclosure, wherein example 50 also includes the subject matter according to any one of examples 22-49, above.

The driver-type golf club head comprises the crown opening. A crown opening recessed ledge defines the crown opening. The insert is a crown insert that is seatably engaged with the crown opening recessed ledge and covers the crown opening to form part of the crown portion. A thickness of the crown portion decreases, in a rearward-to-forward direction from a forward extent of the crown opening recessed ledge, and decreases, in a forward-to-rearward direction from the forward extent of the crown opening recessed ledge. The preceding subject matter of this paragraph characterizes example 51 of the present disclosure, wherein example 51 also includes the subject matter according to any one of examples 6-50, above.

The driver-type golf club head is configured such that after 1,000 impacts of the standard golf ball at the geometric center of the strike face, where at each impact the standard golf ball has a velocity of 52 meters per second, the CT of the strike face at any point within the central region is less than 256 microseconds. The preceding subject matter of this paragraph characterizes example 52 of the present disclosure, wherein example 52 also includes the subject matter according to any one of examples 1-51, above.

The driver-type golf club head is configured such that after 1,500 impacts of the standard golf ball at the geometric center of the strike face, where at each impact the standard golf ball has a velocity of 52 meters per second, the CT of the strike face at any point within the central region is less than 256 microseconds. The preceding subject matter of this paragraph characterizes example 53 of the present disclosure, wherein example 53 also includes the subject matter according to any one of examples 1-52, above.

The driver-type golf club head is configured such that after 2,000 impacts of the standard golf ball at the geometric center of the strike face, where at each impact the standard golf ball has a velocity of 52 meters per second, the CT of the strike face at any point within the central region is less than 256 microseconds and the CT at the geometric center of the strike face is no more than seven microseconds different than the initial CT value. The preceding subject matter of this paragraph characterizes example 54 of the present disclosure, wherein example 54 also includes the subject matter according to any one of examples 1-53, above.

The driver-type golf club head is configured such that after 2,000 impacts of the standard golf ball at the geometric center of the strike face, where at each impact the standard golf ball has a velocity of 52 meters per second, the CT of the strike face at any point within the central region is less than 256 microseconds and the CT at the geometric center of the strike face is no more than nine microseconds different than the initial CT value. The preceding subject matter of this paragraph characterizes example 55 of the present disclosure, wherein example 55 also includes the subject matter according to any one of examples 1-54, above.

The driver-type golf club head is configured such that after 2,500 impacts of the standard golf ball at the geometric center of the strike face, where at each impact the standard golf ball has a velocity of 52 meters per second, the CT of the strike face at any point within the central region is less than 256 microseconds. The preceding subject matter of this paragraph characterizes example 56 of the present disclosure, wherein example 56 also includes the subject matter according to any one of examples 1-55, above.

The driver-type golf club head is configured such that after 3,000 impacts of the standard golf ball at the geometric center of the strike face, where at each impact the standard golf ball has a velocity of 52 meters per second, the CT of the strike face at any point within the central region is less than 256 microseconds and the CT at the geometric center of the strike face is no more than nine microseconds different than the initial CT value. The preceding subject matter of this paragraph characterizes example 57 of the present disclosure, wherein example 57 also includes the subject matter according to any one of examples 1-56, above.

The driver-type golf club head is configured such that after 3,000 impacts of the standard golf ball at the geometric center of the strike face, where at each impact the standard golf ball has a velocity of 52 meters per second, the CT of the strike face at any point within the central region is less than 257 microseconds and the CT at the geometric center of the strike face is no more than thirteen microseconds different than the initial CT value. The preceding subject matter of this paragraph characterizes example 58 of the present disclosure, wherein example 58 also includes the subject matter according to any one of examples 1-57, above.

An inward face progression of the strike face is less than 0.01 inches after 500 impacts of the standard golf ball at the geometric center of the strike face, where at each impact the standard golf ball has a velocity of 52 meters per second. The preceding subject matter of this paragraph characterizes example 59 of the present disclosure, wherein example 59 also includes the subject matter according to any one of examples 1-58, above.

No less than 25% of the strike face, within the central region, has a coefficient of restitution (COR) of at least 0.8. The preceding subject matter of this paragraph characterizes example 60 of the present disclosure, wherein example 60 also includes the subject matter according to any one of examples 1-59, above.

The summation of the moment of inertia of the golf club head about the z-axis of a head center-of-gravity coordinate system (Izz) and the moment of inertia of the golf club head about the x-axis of the head center-of-gravity coordinate system (Ixx) is between about 780 $kg \cdot mm^2$ and about 960 $kg \cdot mm^2$. The preceding subject matter of this paragraph characterizes example 61 of the present disclosure, wherein example 61 also includes the subject matter according to any one of examples 1-60, above.

The summation of the moment of inertia of the golf club head about the z-axis of a head center-of-gravity coordinate system (Izz) and the moment of inertia of the golf club head about the x-axis of the head center-of-gravity coordinate system (Ixx) is between about 860 $kg \cdot mm^2$ and about 960 $kg \cdot mm^2$. The preceding subject matter of this paragraph characterizes example 62 of the present disclosure, wherein example 62 also includes the subject matter according to any one of examples 1-61, above.

The summation of the moment of inertia of the golf club head about the z-axis of a head center-of-gravity coordinate system (Izz) and the moment of inertia of the golf club head about the x-axis of the head center-of-gravity coordinate system (Ixx) is between about 820 kg·mm$^2$ and about 900 kg·mm$^2$ and Ixx is no less than 320 kg·mm$^2$. The preceding subject matter of this paragraph characterizes example 63 of the present disclosure, wherein example 63 also includes the subject matter according to any one of examples 1-62, above.

The driver-type golf club head further comprises a hosel that has a hosel axis. A value of a delta-1 of the driver-type golf club head is less than 25 mm, the delta-1 of the driver-type golf club head is a distance along the y-axis of the head center face origin coordinate system between the CG and an XZ plane passing through the hosel axis. Ixx is at least 320 kg·mm$^2$. The preceding subject matter of this paragraph characterizes example 64 of the present disclosure, wherein example 64 also includes the subject matter according to any one of examples 1-63, above.

The driver-type golf club head has a CG projection onto the strike face, parallel to the y-axis of the head center face origin coordinate system, of at most 3 mm above or below the geometric center of the strike face, as measured along the z-axis of the head center face origin coordinate system. The preceding subject matter of this paragraph characterizes example 65 of the present disclosure, wherein example 65 also includes the subject matter according to any one of examples 1-64, above.

The driver-type golf club head has a CG projection onto the strike face, parallel to the y-axis of the head center face origin coordinate system, that is toe-ward of the geometric center of the strike face. The preceding subject matter of this paragraph characterizes example 66 of the present disclosure, wherein example 66 also includes the subject matter according to any one of examples 1-65, above.

Ixx is at least 65% of Izz. The preceding subject matter of this paragraph characterizes example 67 of the present disclosure, wherein example 67 also includes the subject matter according to any one of examples 1-66, above.

A thickness of the forward portion at the strike face is variable along a cone-shaped projection protruding rearwardly from an interior surface of the forward portion that is opposite the strike face. A geometric center of the cone-shaped projection is toe-ward of the geometric center of the strike face. The preceding subject matter of this paragraph characterizes example 68 of the present disclosure, wherein example 68 also includes the subject matter according to any one of examples 1-67, above.

The CT of at least 60% of the strike face, within the central region, is at least 235 microseconds. The preceding subject matter of this paragraph characterizes example 69 of the present disclosure, wherein example 69 also includes the subject matter according to any one of examples 1-68, above.

The CT of at least 35% of the strike face, within the central region, is at least 240 microseconds. The preceding subject matter of this paragraph characterizes example 70 of the present disclosure, wherein example 70 also includes the subject matter according to any one of examples 1-69, above.

The driver-type golf club head comprises the crown opening. The insert covers the crown opening to form part of the crown portion. The driver-type golf club head further comprises a body that comprises a cast cup and a ring joined to the cast cup via a joint. The cast cup is made of a first material having a first material density. The ring is made of a second material having a second material density that is different than the first material density. The cast cup defines at least the forward portion, including an entirety of the strike face, a part of the crown portion, a part of the sole portion, at least a part of the heel portion, at least a part of the toe portion, at least a part of the skirt portion, and a hosel. The cast cup has a one-piece monolithic construction. The cast cup defines a forward section of the crown opening. The ring defines a rearward section of the crown opening. The insert is permanently secured by adhesion to both the cast cup and the rear ring. The insert is formed separately from the cast cup and the rear ring. The preceding subject matter of this paragraph characterizes example 71 of the present disclosure, wherein example 71 also includes the subject matter according to any one of examples 1-70, above.

The driver-type golf club head further comprises the sole opening. The insert covering the crown opening is a crown insert. The insert covering the sole opening is a sole insert and forms part of the sole portion. The cast cup defines a forward section of the sole opening. The ring defines a rearward section of the sole opening. The sole insert is permanently secured by adhesion to both the cast cup and the rear ring. The sole insert is formed separately from the cast cup and the rear ring. The preceding subject matter of this paragraph characterizes example 72 of the present disclosure, wherein example 72 also includes the subject matter according to example 71, above.

The second material density is lower than the first material density. The preceding subject matter of this paragraph characterizes example 73 of the present disclosure, wherein example 73 also includes the subject matter according to example 72, above.

An areal weight of the crown portion is less than 0.35 g/cm$^2$ over more than 50% of an entire surface area of the crown portion and at least part of the crown portion is formed of a non-metal material with a density between about 1 g/cm$^3$ to about 2 g/cm$^3$. The preceding subject matter of this paragraph characterizes example 74 of the present disclosure, wherein example 74 also includes the subject matter according to any one of examples 1-73, above.

An areal weight of the sole portion is less than about 0.35 g/cm$^2$ over more than about 50% of an entire surface area of the sole portion. The preceding subject matter of this paragraph characterizes example 75 of the present disclosure, wherein example 75 also includes the subject matter according to example 74, above.

The driver-type golf club head comprises the crown opening and the sole opening. The driver-type golf club head comprises an insert covering each one of the crown opening and the sole opening. An areal weight of the insert covering the crown opening is less than an areal weight of the insert covering the sole opening. The preceding subject matter of this paragraph characterizes example 76 of the present disclosure, wherein example 76 also includes the subject matter according to any one of examples 1-75, above.

The driver-type golf club head further comprises a body that defines the forward portion, including an entirety of the strike face, the rearward portion, at least a part of the crown portion, at least a part of the sole portion, the skirt portion, the heel portion, and the toe portion. The body is cast substantially entirely of 9-1-1 titanium. The 9-1-1 titanium comprises molybdenum, vanadium, and aluminum. The 9-1-1 titanium has a tensile strength of at least 958 MPa, inclusive. The has a single monolithic one-piece construction. A minimum thickness of the forward portion, at the strike face, is less than 2.5 mm. A maximum thickness of the forward portion, at the strike face, is greater than the minimum thickness of the forward portion, at the strike face, and less than 5.0 mm. An interior surface of the forward portion, opposite the strike face, is not chemically etched and has an alpha case thickness of 0.30 mm or less. The preceding subject matter of this paragraph characterizes example 77 of the present disclosure, wherein example 77 also includes the subject matter according to any one of examples 1-5 and 52-76, above.

The forward portion comprises an interior surface that is opposite the strike face. A thickness of the forward portion between the interior surface and the strike face is variable. At least a portion of the interior surface is a machined surface. The preceding subject matter of this paragraph characterizes example 78 of the present disclosure, wherein example 78 also includes the subject matter according to any one of examples 1-77, above.

A variable thickness portion of the forward portion defines a shape on the interior surface of the of the forward portion. A geometric center of the shape is offset from the geometric center of the strike face toward the toe portion or toward the heel portion. The preceding subject matter of this paragraph characterizes example 79 of the present disclosure, wherein example 79 also includes the subject matter according to example 78, above.

A variable thickness portion of the forward portion defines a shape on the interior surface of the of the forward portion. The shape is non-symmetrical. The preceding subject matter of this paragraph characterizes example 80 of the present disclosure, wherein example 80 also includes the subject matter according to any one of examples 78-79, above.

The driver-type golf club head further comprises a body that comprises a cast cup and a ring joined to the cast cup via a joint. The cast cup is made of a first material having a first material density. The ring is made of a second material having a second material density that is different than the first material density. The cast cup defines at least a part of the forward portion, a part of the crown portion, a part of the sole portion, at least a part of the heel portion, at least a part of the toe portion, at least a part of the skirt portion, and a hosel. The ring defines the rearward portion. The driver-type golf club head further comprises a weight secured to the ring. The preceding subject matter of this paragraph characterizes example 81 of the present disclosure, wherein example 81 also includes the subject matter according to any one of examples 78-80, above.

A thickness of the forward portion, at the geometric center of the strike face, is less than a maximum thickness of the forward portion at the strike face. A thickness of the forward portion, at the strike face, changes at least 25% along the strike face. The preceding subject matter of this paragraph characterizes example 82 of the present disclosure, wherein example 82 also includes the subject matter according to example 81, above.

The driver-type golf club head further comprises a second weight secured to the part of the cast cup defining the sole portion. The preceding subject matter of this paragraph characterizes example 83 of the present disclosure, wherein example 83 also includes the subject matter according to any one of examples 81-82, above.

The first material comprises a titanium alloy. The preceding subject matter of this paragraph characterizes example 84 of the present disclosure, wherein example 84 also includes the subject matter according to any one of examples 81-83, above.

The second material comprises an aluminum alloy. The preceding subject matter of this paragraph characterizes example 85 of the present disclosure, wherein example 85 also includes the subject matter according to example 84, above.

The driver-type golf club head further comprises a body that comprises a cast cup and a ring joined to the cast cup via a joint. The cast cup is made of a first material having a first material density. The ring is made of a second material having a second material density that is different than the first material density. The cast cup defines at least a part of the forward portion, a part of the crown portion, a part of the sole portion, at least a part of the heel portion, at least a part of the toe portion, at least a part of the skirt portion, and a hosel. The ring defines the rearward portion. The ring comprises at least one engagement projection located on a toe portion of the ring and at least one engagement projection located on a heel portion of the ring. The cast cup comprises at least one engagement notch located on a toe portion of the cast cup and sized to receive the at least one engagement projection located on the toe portion of the ring. The cast cup comprises at least one engagement notch located on a heel portion of the cast cup and sized to receive the at least one engagement projection located on the heel portion of the ring. The cast cup lacks an engagement projection in the part of the forward portion and the part of the crown portion defined by the cast cup. The preceding subject matter of this paragraph characterizes example 86 of the present disclosure, wherein example 86 also includes the subject matter according to any one of examples 1-85, above.

The driver-type golf club head further comprises a body that comprises a cast cup and a ring joined to the cast cup via a joint. The cast cup is made of a first material having a first material density. The ring is made of a second material having a second material density that is different than the first material density. The cast cup defines at least a part of the forward portion, a part of the crown portion, a part of the sole portion, at least a part of the heel portion, at least a part of the toe portion, at least a part of the skirt portion, and a hosel. The ring defines the rearward portion. The driver-type golf club head comprises the crown opening. The insert covers the crown opening to form part of the crown portion. The driver-type golf club head further comprises a body that comprises a cast cup and a ring joined to the cast cup via a joint. The cast cup is made of a first material having a first material density. The ring is made of a second material having a second material density that is different than the first material density. The cast cup defines at least the forward portion, including an entirety of the strike face, a part of the crown portion, a part of the sole portion, at least a part of the heel portion, at least a part of the toe portion, at least a part of the skirt portion, and a hosel. The cast cup has a one-piece monolithic construction. The cast cup defines a forward section of the crown opening. The ring defines a rearward section of the crown opening. The driver-type golf club head further comprises the sole opening. The insert covering the crown opening is a crown insert. The insert covering the sole opening is a sole insert and forms part of the sole portion. The cast cup defines a forward section of the sole opening. The ring defines a rearward section of the sole opening. The forward section of the crown opening is defined by a forward crown opening recessed ledge of the cast cup. The rearward section of the crown opening is defined by a rearward crown opening recessed ledge of the ring. The forward section of the sole opening is defined by a forward sole opening recessed ledge of the cast cup. The rearward section of the sole opening is defined by a rearward sole opening recessed ledge of the ring. The crown insert encloses the crown opening and is coupled to the forward crown opening recessed ledge and the rearward crown opening recessed ledge. The sole insert encloses the sole opening and is coupled to the forward sole opening recessed ledge and the rearward sole opening recessed ledge. The preceding subject matter of this paragraph characterizes example 87 of the present disclosure, wherein example 87 also includes the subject matter according to any one of examples 1-86, above.

The driver-type golf club head further comprises a body that comprises a cast cup and a ring joined to the cast cup via a joint. The cast cup is made of a first material having a first material density. The ring is made of a second material having a second material density that is different than the first material density. The cast cup defines at least a part of the forward portion, a part of the crown portion, a part of the sole portion, at least a part of the heel portion, at least a part of the toe portion, at least a part of the skirt portion, and a hosel. The ring defines the rearward portion. One of the cast cup further comprises toe and heel male projections and the ring further comprises toe and heel female notches, where the toe and heel male projections mate with corresponding ones of the toe and heel female notches to couple the cast cup to the ring, or the cast cup further comprises toe and heel female notches and the ring further comprises toe and heel male projections, where the toe and heel male projections mate with corresponding ones of the toe and heel female notches to couple the ring to the cast cup. The preceding subject matter of this paragraph characterizes example 88 of the present disclosure, wherein example 88 also includes the subject matter according to any one of examples 1-87, above.

The driver-type golf club head further comprises a slot formed in the sole portion of the driver-type golf club head. The slot is open to the hollow interior region of the driver-type golf club head. The preceding subject matter of this paragraph characterizes example 89 of the present disclosure, wherein example 89 also includes the subject matter according to any one of examples 1-88, above.

No material having a shore D value greater than 10 contacts an interior surface of the forward portion, opposite the strike face and open to the hollow interior region, at a location heelward of the geometric center of the strike face. The preceding subject matter of this paragraph characterizes example 90 of the present disclosure, wherein example 90 also includes the subject matter according to any one of examples 1-89, above.

No material having a shore D value greater than 10 contacts an interior surface of the forward portion, opposite the strike face and open to the hollow interior region, at a location toeward of the geometric center of the strike face. The preceding subject matter of this paragraph characterizes example 91 of the present disclosure, wherein example 91 also includes the subject matter according to example 90, above.

No material contacts an interior surface of the forward portion, opposite the strike face and open to the hollow interior region. The preceding subject matter of this paragraph characterizes example 92 of the present disclosure, wherein example 92 also includes the subject matter according to any one of examples 1-90, above.

The strike face has a first bulge radius of at least 300 mm and a first roll radius of at least 250 mm. The preceding subject matter of this paragraph characterizes example 93 of the present disclosure, wherein example 93 also includes the subject matter according to any one of examples 1-92, above.

Further disclosed herein is a driver-type golf club head that comprises a forward portion, which comprises a strike face having a first bulge radius of at least 300 mm and a first roll radius of at least 250 mm. The driver-type golf club head also comprises a rearward portion, opposite the forward portion. The driver-type golf club head further comprises a crown portion, wherein an areal weight of the crown portion is less than 0.35 g/cm$^2$ over more than 50% of an entire surface area of the crown portion and at least part of the crown portion has a variable thickness. The driver-type golf club head additionally comprises a sole portion, opposite the crown portion. The driver-type golf club head also comprises a skirt portion, positioning around a periphery of the golf club head between the sole portion and the crown portion. The driver-type golf club head further comprises a heel portion. The driver-type golf club head additionally comprises a toe portion, opposite the heel portion. The driver-type golf club head also comprises a hollow interior region defined by the forward portion, the rearward portion, the crown portion, the sole portion, the skirt portion, the heel portion, and the toe portion. the strike face is void of through-apertures open to the hollow interior region. A volume of the driver-type golf club head is between 350 cm3 and 500 cm3. The golf club head has a center-of-gravity (CG) with an x-axis coordinate, on an x-axis of a head center face origin coordinate system of the golf club head, between −7 mm and 7 mm and a y-axis coordinate, on a y-axis of the head center face origin coordinate system of the golf club head, between 25 mm and 50 mm, and a z-axis coordinate, on a z-axis of the head center face origin coordinate system of the golf club head, less than 2 mm. The strike face of the forward portion has a central region, defined by a 40 mm by 20 mm rectangular area centered on a geometric center of the strike face and elongated in a heel-to-toe direction. A summation of a moment of inertia of the golf club head about a z-axis of a head center-of-gravity coordinate system (Izz) and a moment of inertia of the golf club head about an x-axis of the head center-of-gravity coordinate system (Ixx) is between about 800 kg·mm2 and about 1,100 kg·mm2 and Ixx is no less than 320 kg·mm2. A characteristic time (CT) of the strike face, within the central region, is no more than 257 microseconds. Before the strike face impacts a golf ball, the CT of the strike face, at the geometric center of the strike face, has an initial CT value. The driver-type golf club head is configured such that after 2,000 impacts of a standard golf ball at the geometric center of the strike face, where at each impact the standard golf ball has a velocity of 52 meters per second, the CT of the strike face at any point within the central region is less than 256 microseconds and the CT at the geometric center of the strike face is no less than 249 microseconds and no more than ten microseconds different than the initial CT value. The driver-type golf club head has a CG projection onto the strike face, parallel to the y-axis of the head center face origin coordinate system, of at most 3.5 mm above or below the geometric center of the strike face, as measured along the z-axis of the head center face origin coordinate system. The preceding subject matter of this paragraph characterizes example 94 of the present disclosure.

Also disclosed herein is a driver-type golf club head. The driver-type golf club head comprises a forward portion, comprising a plate opening and strike face having a first bulge radius of at least 300 mm and a first roll radius of at least 250 mm, the forward portion further comprising a strike plate that defines the strike face. The strike plate encloses the plate opening. The strike plate is made of a first alloy of a metallic material. The first alloy having a first ultimate tensile strength. The forward portion, other than the strike plate, is made of a second alloy of the metallic material. The second alloy having a second ultimate tensile strength that is less than the first ultimate tensile strength. A minimum thickness of the strike plate is between 1.5 mm and 2.5 mm. A maximum thickness of the strike plate is less than 3.7 mm. An interior surface of the strike plate, opposite the strike face, is not chemically etched and has an alpha case thickness of no more than 0.30 mm. The driver-type golf club head also comprises a rearward portion, opposite the forward portion. The driver-type golf club head further comprises a crown portion. An areal weight of the crown portion is less than 0.35 g/cm$^2$ over more than 50% of an entire surface area of the crown portion and at least part of the crown portion has a variable thickness. The driver-type golf club head additionally comprises a sole portion, opposite the crown portion. The driver-type golf club head also comprises a skirt portion, positioning around a periphery of the golf club head between the sole portion and the crown portion. The driver-type golf club head further comprises a heel portion. The driver-type golf club head additionally comprises a toe portion, opposite the heel portion. The driver-type golf club head also comprises a hollow interior region defined by the forward portion, the rearward portion, the crown portion, the sole portion, the skirt portion, the heel portion, and the toe portion. The strike face is void of through-apertures open to the hollow interior region. A volume of the driver-type golf club head is between 350 cm$^3$ and 500 cm$^3$. The golf club head has a center-of-gravity (CG) with an x-axis coordinate, on an x-axis of a head center face origin coordinate system of the golf club head, between −7 mm and 7 mm and a y-axis coordinate, on a y-axis of the head center face origin coordinate system of the golf club head, between 25 mm and 50 mm, and a z-axis coordinate, on a z-axis of the head center face origin coordinate system of the golf club head. The strike face of the forward portion has a central region, defined by a 40 mm by 20 mm rectangular area centered on a geometric center of the strike face and elongated in a heel-to-toe direction. A summation of a moment of inertia of the golf club head about a z-axis of a head center-of-gravity coordinate system (Izz) and a moment of inertia of the golf club head about an x-axis of the head center-of-gravity coordinate system (Ixx) is between about 800 kg·mm$^2$ and about 1,100 kg·mm$^2$ and Ixx is no less than 320 kg·mm$^2$. A characteristic time (CT) of the strike face, within the central region, is no more than 257 microseconds. The driver-type golf club head has a CG projection onto the strike face, parallel to the y-axis of the head center face origin coordinate system, of at most 3.5 mm above or below the geometric center of the strike face, as measured along the z-axis of the head center face origin coordinate system. The preceding subject matter of this paragraph characterizes example 95 of the present disclosure.

The second alloy has a second ultimate tensile strength that is less than the first ultimate tensile strength by at least 10% and the first ultimate tensile strength is at least 1,000 MPa. The preceding subject matter of this paragraph characterizes example 96 of the present disclosure, wherein example 96 also includes the subject matter according to example 95, above.

No less than 25% of the strike face, within the central region, has a coefficient of restitution (COR) of at least 0.8. The preceding subject matter of this paragraph characterizes example 97 of the present disclosure, wherein example 97 also includes the subject matter according to any one of examples 95-96, above.

A thickness of the forward portion, at the strike face, changes at least 25% along the strike face. The preceding subject matter of this paragraph characterizes example 98 of the present disclosure, wherein example 98 also includes the subject matter according to any one of examples 95-97, above.

At least 50% of the crown portion has a variable thickness that changes at least 25% along at least 50% of the crown portion. The preceding subject matter of this paragraph characterizes example 99 of the present disclosure, wherein example 99 also includes the subject matter according to any one of examples 95-98, above.

The crown portion has a minimum thickness and a maximum thickness, and the minimum thickness is less than 0.6 mm. The preceding subject matter of this paragraph characterizes example 100 of the present disclosure, wherein example 100 also includes the subject matter according to any one of examples 95-99, above.

A peak crown height occurs toeward of a geometric center of the strike face. The preceding subject matter of this paragraph characterizes example 101 of the present disclosure, wherein example 101 also includes the subject matter according to any one of examples 95-100, above.

A value of delta-1 of the driver-type golf club head is less than 25 mm, and delta-1 of the driver-type golf club head is a distance along the y-axis of the head center face origin coordinate system between the CG and an XZ plane passing through the hosel axis. The preceding subject matter of this paragraph characterizes example 102 of the present disclosure, wherein example 102 also includes the subject matter according to any one of examples 95-101, above.

Before the strike face impacts a golf ball, the CT of the strike face, at the geometric center of the strike face, has an initial CT value. The driver-type golf club head is configured such that after 2,000 impacts of a standard golf ball at the geometric center of the strike face, where at each impact the standard golf ball has a velocity of 52 meters per second, the CT of the strike face at any point within the central region is less than 256 microseconds and the CT at the geometric center of the strike face is no less than 249 microseconds and no more than ten microseconds different than the initial CT value. The preceding subject matter of this paragraph characterizes example 103 of the present disclosure, wherein example 103 also includes the subject matter according to any one of examples 95-102, above.

Additionally disclosed herein is a driver-type golf club head. The driver-type golf club head comprises a forward portion, comprising a strike face having a first bulge radius of at least 300 mm and a first roll radius of at least 250 mm. The forward portion further comprises a strike plate that defines the strike face. The forward portion comprises a plate opening. The strike plate encloses the plate opening. The strike plate has an outer surface area of no more than 4,300 mm$^2$ and no less than 3,300 mm$^2$. A minimum thickness of the strike plate is between 1.5 mm and 2.5 mm. A maximum thickness of the strike plate is less than 3.7 mm. An interior surface of the strike plate, opposite the strike face, is not chemically etched and has an alpha case thickness of no more than 0.30 mm. The driver-type golf club head also comprises a rearward portion, opposite the forward portion. The driver-type golf club head further comprises a crown portion, an areal weight of the crown portion is less than 0.35 g/cm$^2$ over more than 50% of an entire surface area of the crown portion and at least part of the crown portion has a variable thickness. The driver-type golf club head additionally comprises a sole portion, opposite the crown portion. The driver-type golf club head also comprises a skirt portion, positioning around a periphery of the golf club head between the sole portion and the crown portion. The driver-type golf club head further comprises a heel portion. The driver-type golf club head additionally comprises a toe portion, opposite the heel portion. The driver-type golf club head also comprises a hollow interior region defined by the forward portion, the rearward portion, the crown portion, the sole portion, the skirt portion, the heel portion, and the toe portion. The strike face is void of through-apertures open to the hollow interior region. A volume of the driver-type golf club head is between 350 $cm^3$ and 500 $cm^3$. The golf club head has a center-of-gravity (CG) with an x-axis coordinate, on an x-axis of a head center face origin coordinate system of the golf club head, between −7 mm and 7 mm and a y-axis coordinate, on a y-axis of the head center face origin coordinate system of the golf club head, between 25 mm and 50 mm, and a z-axis coordinate, on a z-axis of the head center face origin coordinate system of the golf club head. The strike face of the forward portion has a central region, defined by a 40 mm by 20 mm rectangular area centered on a geometric center of the strike face and elongated in a heel-to-toe direction. A summation of a moment of inertia of the golf club head about a z-axis of a head center-of-gravity coordinate system (Izz) and a moment of inertia of the golf club head about an x-axis of the head center-of-gravity coordinate system (Ixx) is between about 800 $kg \cdot mm^2$ and about 1,100 $kg \cdot mm^2$ and Ixx is no less than 320 $kg \cdot mm^2$. A characteristic time (CT) of the strike face, within the central region, is no more than 257 microseconds. The driver-type golf club head has a CG projection onto the strike face, parallel to the y-axis of the head center face origin coordinate system, of at most 3.5 mm above or below the geometric center of the strike face, as measured along the z-axis of the head center face origin coordinate system. The preceding subject matter of this paragraph characterizes example 104 of the present disclosure.

A value of delta-1 of the driver-type golf club head is less than 25 mm. The delta-1 of the driver-type golf club head is a distance along the y-axis of the head center face origin coordinate system between the CG and an XZ plane passing through the hosel axis. The preceding subject matter of this paragraph characterizes example 105 of the present disclosure, wherein example 105 also includes the subject matter according to example 104 above.

The crown portion comprises an outer crown surface and an inner crown surface. A crown height is measured relative to the outer crown surface and a ground plane when the club head is in a normal address position. A first crown height at a face-to-crown transition region in the forward crown area where the club face connects to the crown portion of the club head. A second crown height at a crown-to-skirt transition region where the crown portion connects to a skirt of the golf club head near a rear end of the golf club head. A maximum crown height is defined rearward of the first crown height and forward of the second crown height. The maximum crown height is greater than both the first and second crown heights. The preceding subject matter of this paragraph characterizes example 106 of the present disclosure, wherein example 106 also includes the subject matter according to any one of examples 104-105, above.

The maximum crown height occurs toeward of a geometric center of the strike face. The preceding subject matter of this paragraph characterizes example 107 of the present disclosure, wherein example 107 also includes the subject matter according to example 106, above.

The maximum crown height is formed by a non-metal composite crown insert. The preceding subject matter of this paragraph characterizes example 108 of the present disclosure, wherein example 108 also includes the subject matter according to any one of examples 106-107, above.

Further disclosed herein is a driver-type golf club head. The driver-type golf club head comprises a forward portion, comprising a strike face having a first bulge radius of at least 300 mm and a first roll radius of at least 250 mm. The forward portion further comprises a strike plate that defines the strike face. The forward portion comprises a plate opening. The strike plate encloses the plate opening. The strike plate is made of a non-metal material having a density between 1 $g/cm^3$ and 2 $g/cm^3$; and an outer surface area (excluding any grooves) of no more than 4,300 $mm^2$ and no less than 3,300 $mm^2$. A minimum thickness of the strike plate is between 3.5 mm and 4.5 mm. A maximum thickness of the strike plate is less than 6.0 mm. The driver-type golf club head also comprises a rearward portion, opposite the forward portion. The driver-type golf club head further comprises a crown portion, an areal weight of the crown portion is less than 0.35 $g/cm^2$ over more than 50% of an entire surface area of the crown portion and at least part of the crown portion has a variable thickness. The driver-type golf club head additionally comprises a sole portion, opposite the crown portion. The driver-type golf club head also comprises a skirt portion, positioning around a periphery of the golf club head between the sole portion and the crown portion. The driver-type golf club head further comprises a heel portion. The driver-type golf club head additionally comprises a toe portion, opposite the heel portion. The driver-type golf club head also comprises a hollow interior region defined by the forward portion, the rearward portion, the crown portion, the sole portion, the skirt portion, the heel portion, and the toe portion. The strike face is void of through-apertures open to the hollow interior region. A volume of the driver-type golf club head is between 350 $cm^3$ and 500 $cm^3$. The golf club head has a center-of-gravity (CG) with an x-axis coordinate, on an x-axis of a head center face origin coordinate system of the golf club head, between −7 mm and 7 mm and a y-axis coordinate, on a y-axis of the head center face origin coordinate system of the golf club head, between 25 mm and 50 mm, and a z-axis coordinate, on a z-axis of the head center face origin coordinate system of the golf club head. The strike face of the forward portion has a central region, defined by a 40 mm by 20 mm rectangular area centered on a geometric center of the strike face and elongated in a heel-to-toe direction. A summation of a moment of inertia of the golf club head about a z-axis of a head center-of-gravity coordinate system (Izz) and a moment of inertia of the golf club head about an x-axis of the head center-of-gravity coordinate system (Ixx) is between about 800 $kg \cdot mm^2$ and about 1,100 $kg \cdot mm^2$ and Ixx is no less than 320 $kg \cdot mm^2$. A characteristic time (CT) of the strike face, within the central region, is no more than 257 microseconds. The driver-type golf club head has a CG projection onto the strike face, parallel to the y-axis of the head center face origin coordinate system, of at most 3.5 mm above or below the geometric center of the strike face, as measured along the z-axis of the head center face origin coordinate system. The preceding subject matter of this paragraph characterizes example 109 of the present disclosure.

The described features, structures, advantages, and/or characteristics of the subject matter of the present disclosure may be combined in any suitable manner in one or more embodiments and/or implementations. In the following description, numerous specific details are provided to impart a thorough understanding of embodiments of the subject matter of the present disclosure. One skilled in the relevant art will recognize that the subject matter of the present disclosure may be practiced without one or more of the specific features, details, components, materials, and/or methods of a particular embodiment or implementation. In other instances, additional features and advantages may be recognized in certain embodiments and/or implementations that may not be present in all embodiments or implementations. Further, in some instances, well-known structures, materials, or operations are not shown or described in detail to avoid obscuring aspects of the subject matter of the present disclosure. The features and advantages of the subject matter of the present disclosure will become more fully apparent from the following description and appended claims, or may be learned by the practice of the subject matter as set forth hereinafter.

BRIEF DESCRIPTION OF THE DRAWINGS

In order that the advantages of the subject matter may be more readily understood, a more particular description of the subject matter briefly described above will be rendered by reference to specific embodiments that are illustrated in the appended drawings. Understanding that these drawings depict only typical embodiments of the subject matter and are not therefore to be considered to be limiting of its scope, the subject matter will be described and explained with additional specificity and detail through the use of the drawings, in which.

DETAILED DESCRIPTION

Figure 1:
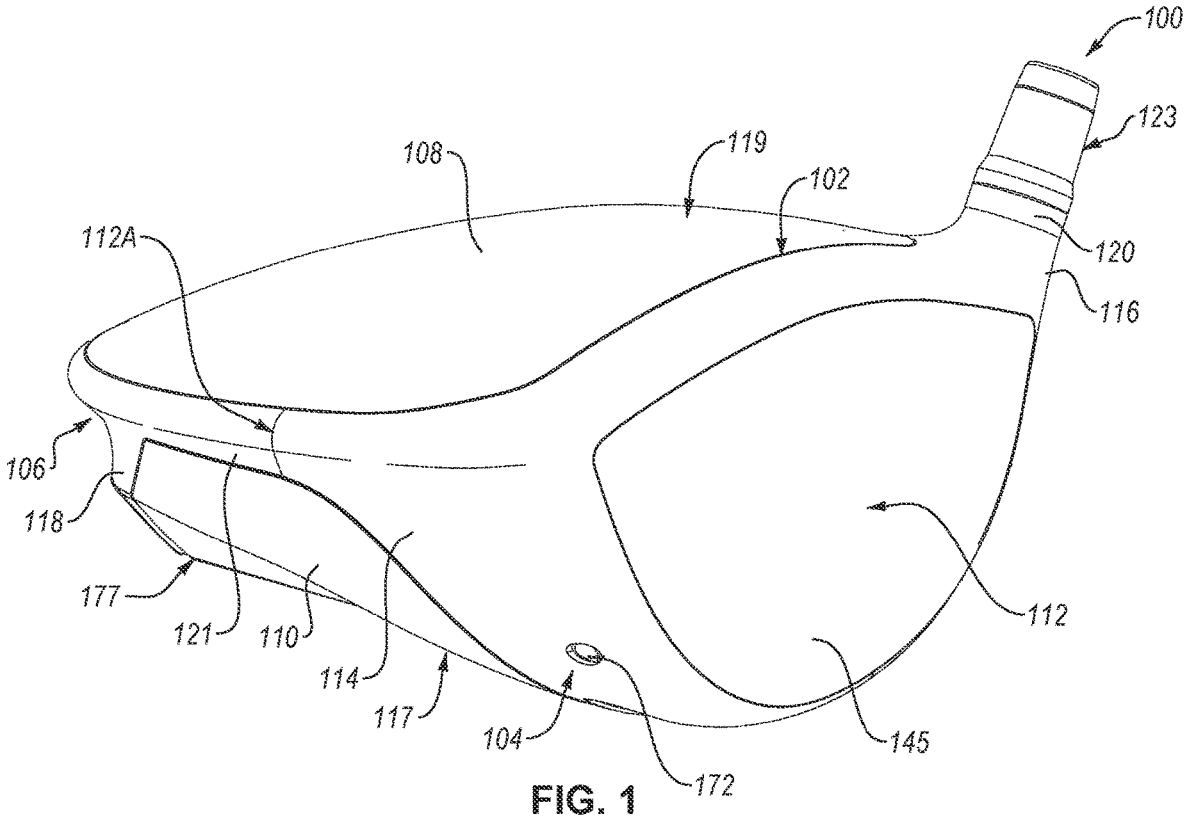
FIG. 1 is a schematic, perspective view of a golf club head, according to one or more examples of the present disclosure.

The following describes embodiments of golf club heads in the context of a driver-type golf club, but the principles, methods and designs described may be applicable in whole or in part to fairway woods, utility clubs (also known as hybrid clubs) and the like. The examples of driver-type golf club heads disclosed herein are configured to promote a reduction in the increase of the characteristic time (CT) (i.e., CT creep) of the golf club heads after multiple impacts with a golf ball compared to conventional driver-type golf club heads. Accordingly, the driver-type golf club heads disclosed herein are configured to prolong the golf club heads' compliance with CT regulations compared to conventional driver-type golf club heads.

The CT of a golf club head is the amount of time a metal hemisphere, at the end of a pendulum, remains in contact with the face portion of a golf club head during a bounce of the metal hemisphere against the face portion. The characteristics of the pendulum and metal hemisphere, as well as the constraints of the CT testing equipment, are governed by the United States Golf Association ("USGA") under the Procedure for Measuring the Flexibility of a Golf Clubhead manual, which is published at www.usga.org and incorporated herein by reference. The CT of a golf club head is directly related to the flexibility or spring-like effect of the face portion of the golf club head. In other words, the higher the flexibility of the face portion, the higher the CT of the golf club head. Under the USGA regulations governing the configuration of golf club heads, the CT of a golf club head at all points on the face portion within a hitting zone cannot exceed a regulated CT threshold.

For driver-type golf club heads having strike faces formed of metallic materials, fatigue of the metallic materials is a primary source of CT creep. In some examples disclosed herein, the golf club heads having strike faces formed of metallic materials promote a reduction of CT creep by varying the thickness of the strike face at strategic locations about the strike face. According to other examples disclosed herein, alternative or in addition to varying the thickness of the strike face at strategic locations about the strike face, the reduction of CT creep is promoted by making the strike face out of a metallic material with superior strength.

For driver-type golf club heads having strike faces formed of a non-metallic material, such as a fiber-reinforced polymeric material, a breakdown of the adhesive joint formed between a body of the golf club head and a non-metallic strike plate is the primary source of CT creep. Accordingly, in yet certain examples disclosed herein, the golf club heads are configured to strengthen the adhesive joint formed between the body of the golf club heads and the non-metallic strike plate, such as by optimizing the structural characteristics of the golf club head that defines the ledge that receives the strike plate and the properties of the adhesive that bonds the body and the strike plate together.

U.S. Patent Application Publication No. 2014/0302946 A1 (946 app), published Oct. 9, 2014, which is incorporated herein by reference in its entirety, describes a "reference position" similar to the address position used to measure the various parameters discussed throughout this application. The address or reference position is based on the procedures described in the United States Golf Association and R&A Rules Limited, "Procedure for Measuring the Club Head Size of Wood Clubs," Revision 1.0.0, (Nov. 21, 2003). Unless otherwise indicated, all parameters are specified with the club head in the reference position.

Figure 7:
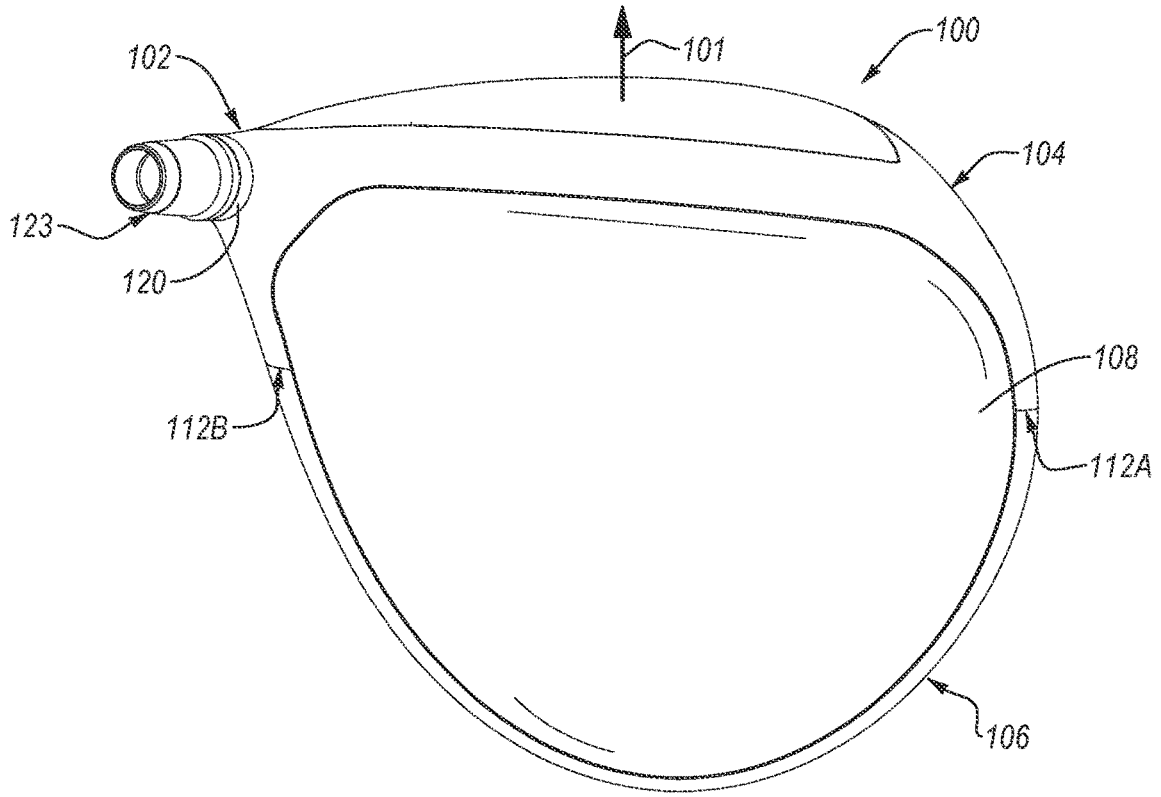
FIG. 7 is a schematic, top plan view of the golf club head of FIG. 1, according to one or more examples of the present disclosure.
Figure 8:
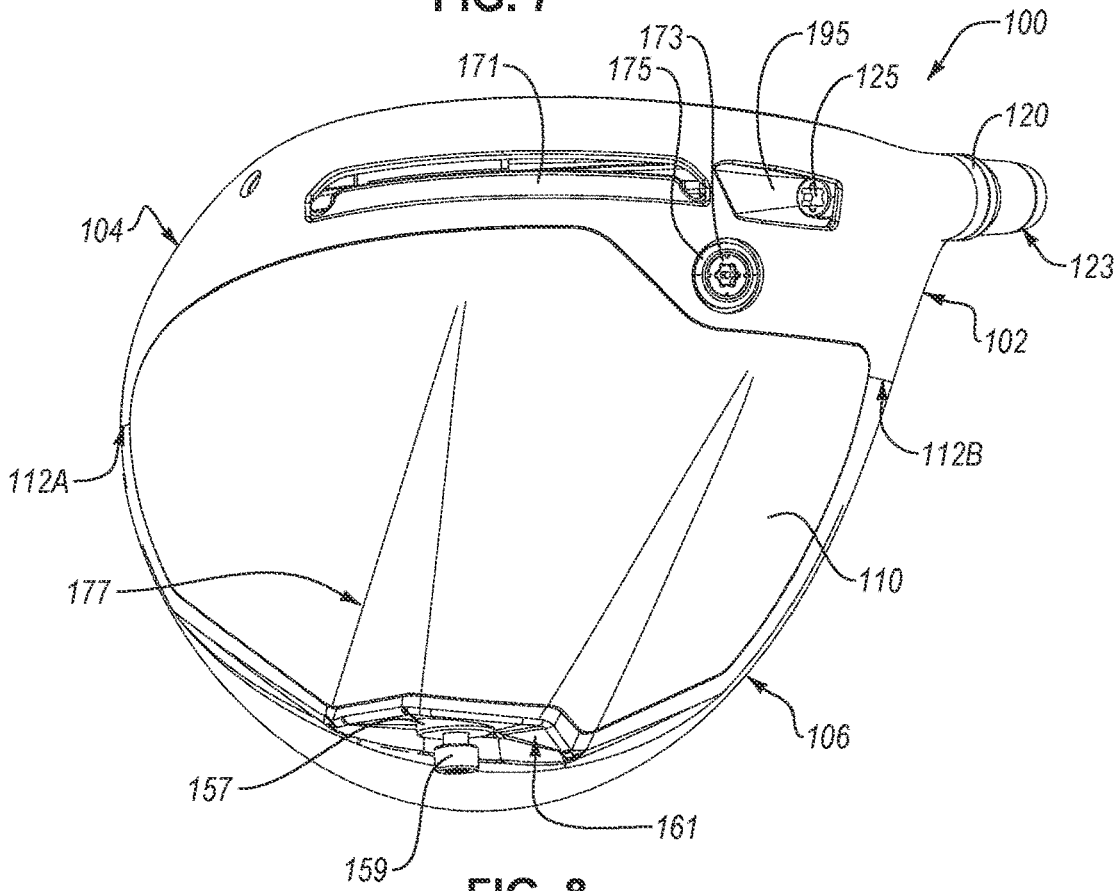
FIG. 8 is a schematic, bottom plan view of the golf club head of FIG. 1, according to one or more examples of the present disclosure.

FIGS. 3, 4, 5, and 9A are examples that show a golf club head 100 in the address or reference position. The golf club head 100 is in the address or reference position when a hosel axis 191 of the golf club head 100 is at a lie angle θ of 60-degrees relative to a ground plane 181 (see, e.g., FIG. 5) and a strike face 145 of the golf club head 100 is square relative to an imaginary target line 101 (see, e.g., FIG. 7). As shown in FIGS. 3, 4, 5, and 9A, positioning the golf club head 100 in the address or reference position lends itself to using a club head origin coordinate system 185, centered at a geometric center (e.g., center face 183) of the strike face 145, for making various measurements. With the golf club head in the address or reference position, using the USGA methodology, various parameters described throughout this application including head height, club head center of gravity (CG) location, and moments of inertia (MOI), can be measured relative to the club head origin coordinate system 185 or relative to another reference or references.

For further details or clarity, the reader is advised to refer to the measurement methods described in the '946 app and the USGA procedure. Notably, however, the origin and axes associated with the club head origin coordinate system 185 used in this application may not necessarily be aligned or oriented in the same manner as those described in the '946 app or the USGA procedure. Further details are provided below on locating the club head origin coordinate system 185.

In some examples, the golf club heads described herein include driver-type golf club heads, which can be identified, at least partially, as golf club heads with strike faces that have a total surface area of at least 3,500 mm^2, preferably at least 3,800 mm^2, and even more preferably at least 3,900 mm^2 (e.g., between 3,500 $mm^2$ and 5,000 $mm^2$ in one example, less than 5,000 $mm^2$ in various examples, and between 3,700 $mm^2$ and 4,300 $mm^2$ in another example). In some examples, such as when the strike face is defined by a non-metal material, the total surface area of the strike face is no more than 4,300 $mm^2$ and no less than 3,300 $mm^2$. Additionally, in certain examples, driver-type golf club heads include a center-of-gravity (CG) projection, parallel to a horizontal (y-axis), which is at most 3 mm above or below a center face of the strike face, and preferably at most 1 mm above or below the center face, as measured along a vertical axis (z-axis). In some examples, the CG projection is toe-ward of the geometric center of the strike face. Moreover, in some examples, driver-type golf club heads have a relatively high moment of inertia about a vertical axis (z-axis) (e.g. Izz>400 kg-mm^2 and preferably Izz>450 kg-mm^2, and more preferably Izz>500 kg-mm^2, but less than (i.e., no more than) 590 kg-mm^2 in certain implementations), a relatively high moment of inertia about a horizontal axis (x-axis) (e.g. Ixx>250 kg-mm^2 and preferably Ixx>300 kg-mm^2 or 320 kg-mm^2, and more preferably Ixx>350 kg-mm^2, but no more than 395 kg·$mm^2$ in some examples), and preferably a ratio of Ixx/Izz>0.70. According to certain examples, a summation of Ixx and Izz is greater than 780 kg-mm^2, 800 kg-mm^2, 820 kg-mm^2, 825 kg-mm^2, 850 kg-mm^2, 860 kg-mm^2, 875 kg-mm^2, 900 kg-mm^2, and 925 kg-mm^2, but less than 1,100 kg-mm^2, less than 960 kg-mm^2, less than 811 kg-mm^2, or less than 709 kg-mm^2. For example, the summation of Ixx and Izz can be between 740 kg-mm^2 and 1,100 kg-mm^2, such as around 869 kg-mm^2. Ixx is at least 65% of Izz in some examples.

According to some examples, where the strike face is made from a fiber-reinforced polymer, has a composite face area between 3300 mm^2 and 4300 mm^2, the golf club head has a forward weight track and may optionally include a rear weight, the golf club head has a CG projection (balance point) of no more than 3.5 mm above a geometric center of the face, the summation of Ixx and Izz can be between 680 kg-mm^2 and 730 kg-mm^2, between 790 kg-mm^2 and 830 kg-mm^2, or between 850 kg-mm^2 and 910 kg-mm^2.

In some examples, the golf club heads described herein have a delta-1 value that is less than 25 mm. The delta-1 of the driver-type golf club head is a distance, along the y-axis of the head center face origin coordinate system 185, between the CG of the golf club head and an XZ plane, passing through the x-axis and the z-axis of the head center face origin coordinate system 185 and passing through the hosel axis 191. In certain examples, the Ixx of the golf club head is at least 335 $kg \cdot mm^2$ and the delta 1 is no more than 25 mm, the Ixx of the golf club head is at least 345 $kg \cdot mm^2$ and the delta 1 is no more than 25 mm, the Ixx of the golf club head is at least 355 $kg \cdot mm^2$ and the delta 1 is no more than 25 mm, the Ixx of the golf club head is at least 365 $kg \cdot mm^2$ and the delta 1 is no more than 25 mm, or the Ixx of the golf club head is at least 375 $kg \cdot mm^2$ and the delta 1 is no more than 25 mm.

Figure 2:
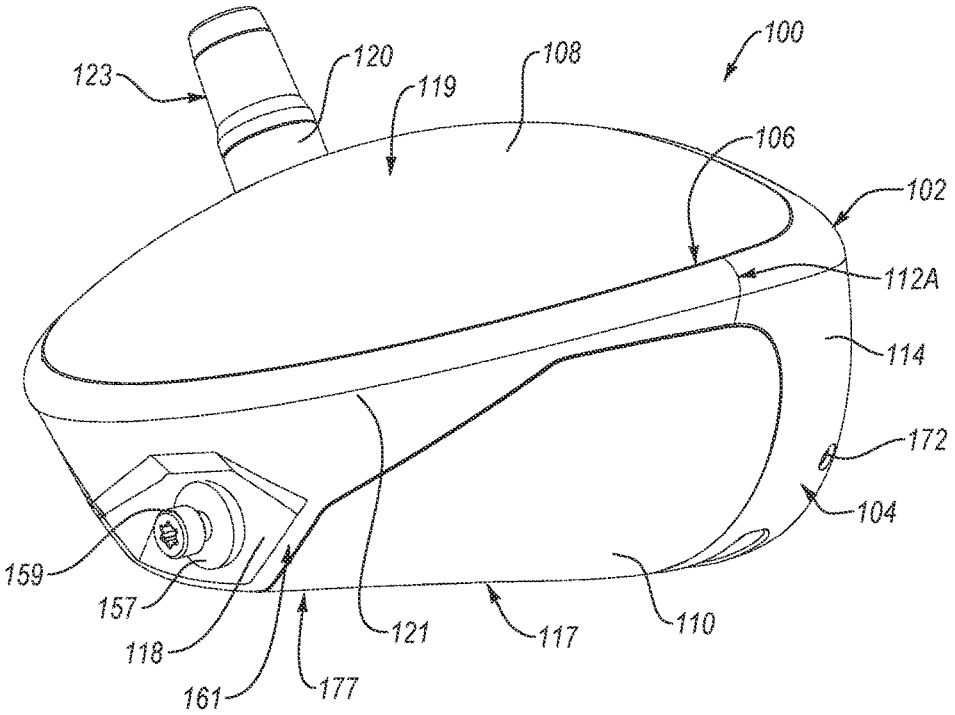
FIG. 2 is a schematic, perspective view of the golf club head of FIG. 1, according to one or more examples of the present disclosure.
Figure 9A:
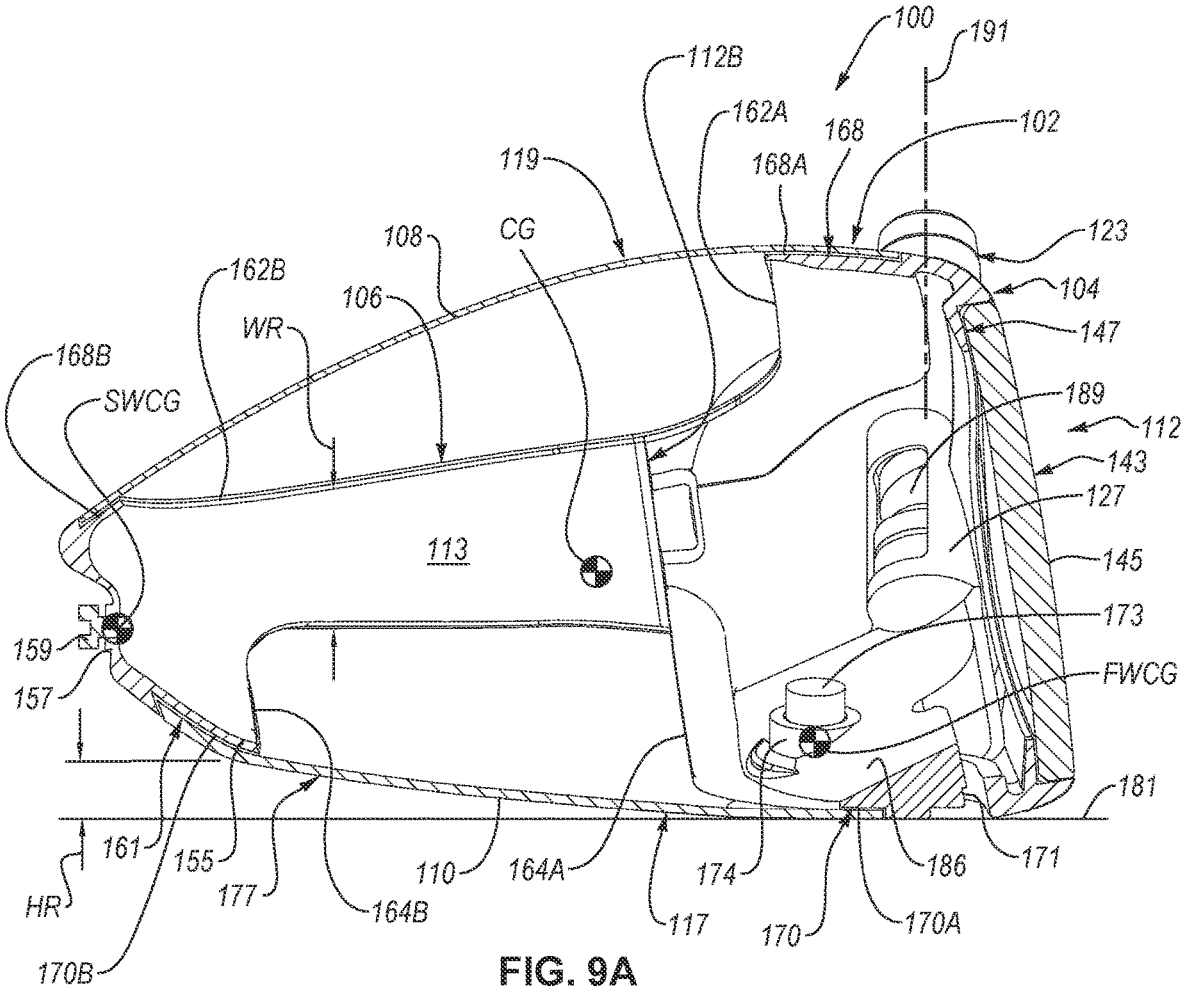
FIG. 9A is a schematic, cross-sectional, side elevation view of the golf club head of FIG. 1, taken along the line 9-9 of FIG. 5, according to one or more examples of the present disclosure.

Referring to FIGS. 1 and 2, according to some examples, the golf club head 100 of the present disclosure includes a toe portion 114 and a heel portion 116, opposite the toe portion 114. Additionally, the golf club head 100 includes a forward portion 112 (e.g., face portion) and a rearward portion 118, opposite the forward portion 112. The golf club head 100 additionally includes a sole portion 117, at a bottom region of the golf club head 100, and a crown portion 119, opposite the sole portion 117 and at a top region of the golf club head 100. Also, the golf club head 100 includes a skirt portion 121 that defines a transition region where the golf club head 100 transitions between the crown portion 119 and the sole portion 117. Accordingly, the skirt portion 121 is located between the crown portion 119 and the sole portion 117 and extends about a periphery of the golf club head 100. Referring to FIG. 9A, the golf club head 100 further includes an interior cavity 113 that is collectively defined and enclosed by the forward portion 112, the rearward portion 118, the crown portion 119, the sole portion 117, the heel portion 116, the toe portion 114, and the skirt portion 121.

The strike face 145 extends along the forward portion 112 from the sole portion 117 to the crown portion 119, and from the toe portion 114 to the heel portion 116. Moreover, the strike face 145, and at least a portion of an interior surface of the forward portion 112, opposite the strike face 145, is planar in a top-to-bottom direction. As further defined, the strike face 145 faces in the generally forward direction. In some examples, the strike face 145 is co-formed with the body 102. In such examples, a minimum thickness of the forward portion 112 at the strike face 145 is between 1.5 mm and 2.5 mm and a maximum thickness of the forward portion 112 at the strike face 145 is less than 3.7 mm. An interior surface of the forward portion 112, opposite the strike face 145, is not chemically etched and has an alpha case thickness of no more than 0.30 mm, in some examples.

Figure 9B:
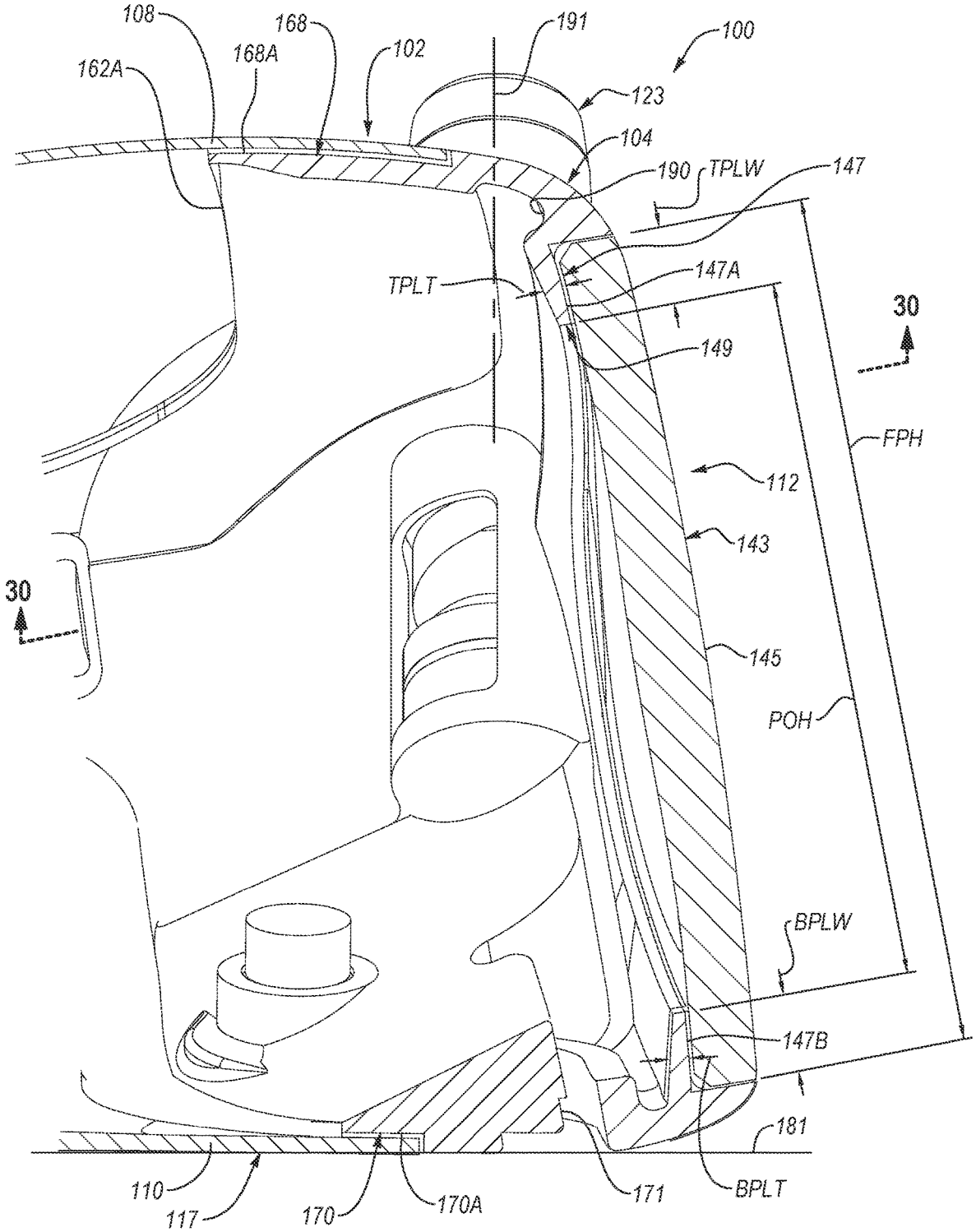
FIG. 9B is a schematic, cross-sectional, side elevation view of a detail of the golf club head of FIG. 9A, according to one or more examples of the present disclosure.

Referring to FIG. 9B, in some examples, the golf club head 100 includes a strike plate 143 that is not co-formed with the body 102. The strike plate 143 is formed separately from the body 102 and attached to the body 102, such as via bonding, welding, brazing, fastening, and the like. As shown, the strike plate 143 defines the strike face 145 of the golf club head 100. In these examples, the body 102 includes a plate opening 149 at the forward portion 112 of the golf club head 100 and a plate-opening recessed ledge that extends continuously about the plate opening 149. An inner periphery of the plate-opening recessed ledge defines the plate opening 149. The plate-opening recessed ledge 147 is divided into at least a top plate-opening recessed ledge 147A, that extends adjacently along the crown portion 119 of the golf club head 100 in a heel-to-toe direction, and a bottom plate-opening recessed ledge 147B, that extends adjacently along the sole portion 117 of the golf club head 100 in a heel-to-toe direction. Although not shown, the plate-opening recessed ledge is further divided into toe and heel plate-opening recessed ledges. Some properties of a plate-opening recessed ledge can be found in U.S. Pat. No. 9,278,267, issued Mar. 8, 2016, which is incorporated herein by reference in its entirety.

The top plate-opening recessed ledge 147A has a width (TPLW) and a thickness (TPLT). The width TPLW is defined as the distance from the inner periphery of the ledge 147A defining the plate opening 149 to the furthest extent of the adhering surface of the ledge 147A away from the inner periphery. The thickness TPLT is defined as the thickness of the material defining the adhering surface of the ledge 147A. In some examples, a recess 190 (e.g., an internal recess) is formed in an internal surface of the body 102 and has depth that extends in a back-to-front direction such that in a sole-to-crown direction, the recess 190 is between the top plate-opening recess ledge 147A and a top of the golf club head 100. In other words, the recess 190 overlaps the top plate-opening recess ledge 147A in a crown-to-sole direction. Notably, rearward of the recess 190 the thickness of the crown may increase locally such that the thickness of the crown portion proximate to where the crown insert joins the club head is thicker than at the recess 190. This may be done to stiffen the overall structure of the crown joint and mitigate stress in the composite crown joint. Otherwise, the composite crown joint may be prone to cracking in that region resulting in a premature failure of the composite crown joint due to the casting cracking and/or the glue failing.

Figure 30:
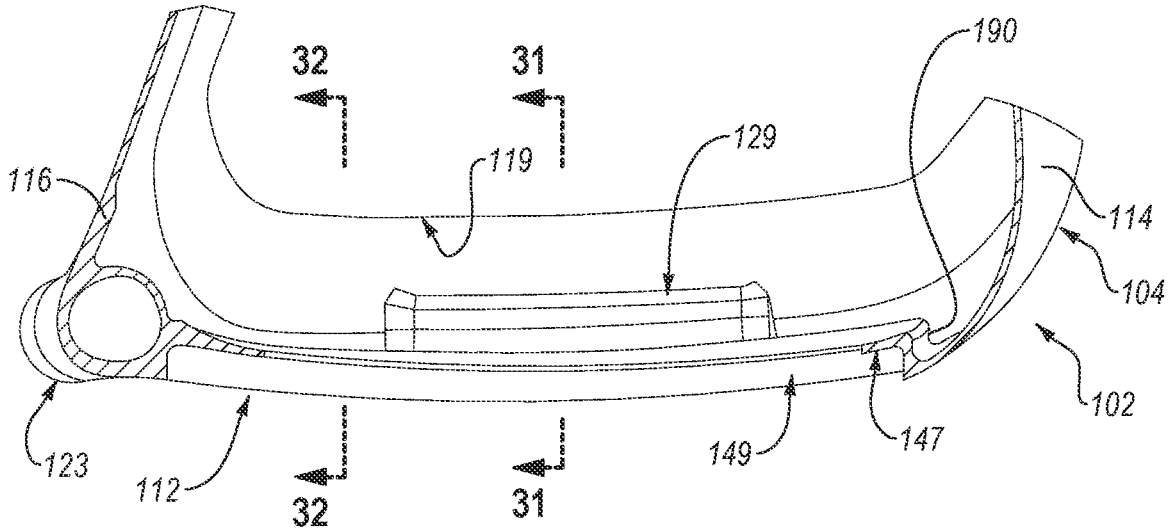
FIG. 30 is a sectional bottom plan view of a golf club head, taken along a line similar to the line 30-30 of FIG. 9B, according to one or more examples of the present disclosure.
Figure 31:
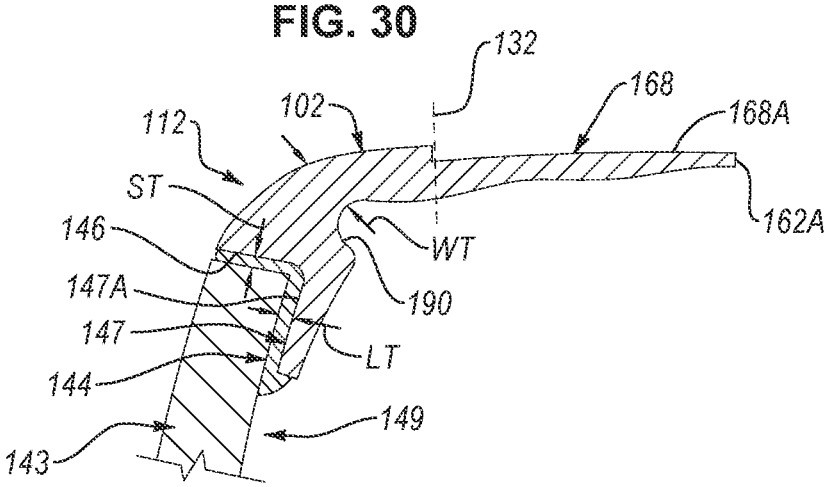
FIG. 31 is a sectional side elevation view of a forward portion and a crown portion of the golf club head of FIG. 30, taken along the line 31-31 of FIG. 30, according to one or more examples of the present disclosure.
Figure 32:
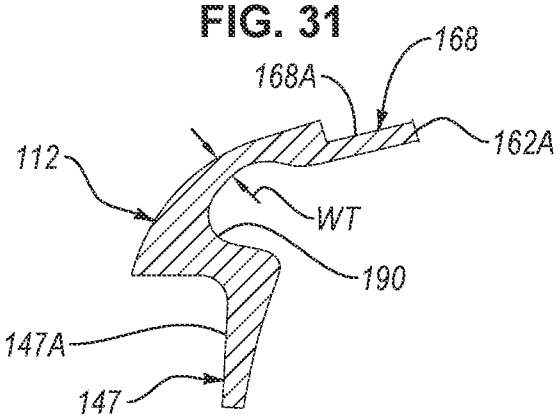
FIG. 32 is a sectional side elevation view of a forward portion and a crown portion of the golf club head of FIG. 30, taken along the line 32-32 of FIG. 30, according to one or more examples of the present disclosure.

Referring to FIGS. 30-32, in some examples, the golf club head 100 further includes an interior mass pad 129 formed in the crown portion 119 at a location adjacent the top plate-opening recess ledge 168. The interior mass pad 129 is also located between and offset (e.g., spaced apart) from the heel portion 116 and the toe portion 114 of the golf club head 100. A portion of the recess 190 is formed in the interior mass pad 129 in some examples. The interior mass pad 129 extends along only a portion of a length of the top plate-opening recess ledge 168. The length of the top plate-opening recess ledge 168 extends in a heel-to-toe direction. According to some examples, a thickness (WT) of the crown portion at the recess 190 is thicker at the interior mass pad 129 (see, e.g., FIG. 31) than away from the interior mass pad 129 (see, e.g., FIG. 32).

In certain examples, the width TPLW of the top plate-opening recessed ledge 147A is greater than 4.5 mm (e.g., greater than 5.0 mm in some instances and greater than 5.5 mm in other instances, but less than 8.0 mm, preferably less than 7.0 mm in some instances). In some examples, a ratio of the width TPLW to a maximum height of the strike plate 143 is between 0.08 and 0.15. In the same or different examples, a ratio of the width TPLW to a maximum height of the plate opening 149 is between 0.07 and 0.15, such as 0.1, where in some examples the maximum height of the plate opening 149 is between 50-60 mm, such as 53 mm.

According to some examples, the thickness TPLT of the top plate-opening recessed ledge 147A is between a minimum value of 0.8 mm and a maximum value of 1.7 mm (e.g., between 0.9 mm and 1.6 mm in some instances and between 0.95 mm and 1.5 mm in other instances). As shown, the thickness TPLT is greater away from the inner periphery of the ledge 147A than at the inner periphery of the ledge 147A. Accordingly, the thickness TPLT varies along the width TPLW of the ledge 147A in some examples. For example, as shown, the thickness TPLT tapers or decreases in a crown-to-sole direction. In some examples, the top ledge thickness TPLT of the top plate-opening recessed ledge 147A varies such that a maximum value of the top ledge thickness TPLT is between 30% and 60% greater than a minimum value of the top ledge thickness TPLT. In certain examples, a ratio of the thickness TPLT to a thickness of the strike plate is between 0.2 and 1.2. According to certain examples, a ratio of the width TPLW to the thickness TPLT is between 2.6 and 10.

The bottom plate-opening recessed ledge 147B has a width (BPLW) and a thickness (BPLT). The width BPLW is defined as the distance from the inner periphery of the ledge 147B defining the plate opening 149 to the furthest extent of the adhering surface of the ledge 147B away from the inner periphery. The thickness BPLT is defined as the thickness of the material defining the adhering surface of the ledge 147B.

In certain examples, the width BPLW of the bottom plate-opening recessed ledge 147B is greater than 4.5 mm (e.g., greater than 5.0 mm in some instances and greater than 5.5 mm in other instances, but less than 8.0 mm, preferably less than 7.0 mm in some instances). In some examples, a ratio of the width BPLW to a maximum height of the strike plate 143 is between 0.08 and 0.15. In the same or different examples, a ratio of the width BPLW to a maximum height of the plate opening 149 is between 0.07 and 0.15, such as 0.1, where in some examples the maximum height of the plate opening 149 is between 50-60 mm, such as 53 mm.

According to some examples, the thickness BPLT of the bottom plate-opening recessed ledge 147B is between 0.8 mm and 1.7 mm (e.g., between 0.9 mm and 1.6 mm in some instances and between 0.95 mm and 1.5 mm in other instances). As shown, the thickness BPLT is greater away from the inner periphery of the ledge 147B than at the inner periphery of the ledge 147B. Accordingly, the thickness BPLT varies along the width BPLW of the ledge 147B in some examples. For example, as shown, the thickness BPLT decreases in a sole-to-crown direction. In some examples, the bottom ledge thickness BPLT of the bottom plate-opening recessed ledge 147B varies such that a maximum value of the bottom ledge thickness BPLT is between 30% and 60% greater than a minimum value of the bottom ledge thickness BPLT. In certain examples, a ratio of the thickness BPLT to a thickness of the strike plate is between 0.2 and 1.2. According to certain examples, a ratio of the width BPLW to the thickness BPLT is between 2.6 and 10.

As shown, the strike plate 143 is attached to the body 102 by fixing the strike plate 143 in seated engagement with at least the top plate-opening recessed ledge 147A and the bottom plate-opening recessed ledge 147B. When joined to the top plate-opening recessed ledge 147A and the bottom plate-opening recessed ledge 147B in this manner, the strike plate 143 covers or encloses the plate opening 149. Moreover, the top plate-opening recessed ledge 147A and the strike plate 143 are sized, shaped, and positioned relative to the crown portion 119 of the golf club head 100 such that the strike plate 143 abuts the crown portion 119 when seatably engaged with the top plate-opening recessed ledge 147A. The strike plate 143, abutting the crown portion 119, defines a topline of the golf club head 100. Moreover, in some examples, the visible appearance of the strike plate 143 contrasts enough with that of the crown portion 119 of the golf club head 100 that the topline of the golf club head 100 is visibly enhanced. Because the strike plate 143 is formed separately from the body 102, the strike plate 143 can be made of a material that is different than that of the body 102. In one example, the strike plate 143 is made of a fiber-reinforced polymeric material, such as described hereafter.

Notably, the TPLW, TPLT, BPLW, and BPLT dimensions are important for controlling the local stiffness of the club head and for ensuring sufficient bonding area to bond the strike plate to the body 102. The modulus of the strike plate if formed from a fiber-reinforced polymeric material will be much different than the modulus of the body if formed from a metal material such that the stiffness or compliance of the two are very different, and during impact the strike plate and the body will move at very different rates due to the different moduli unless precautions are taken in the design to account for the stiffness differences. Recess 190, TPLW, TPLT, BPLW, and BPLT dimensions all play an important role in controlling the overall compliance and rate with which the face and body move during impact. Additionally, TPLW and BPLW contribute to ensuring sufficient bond area and face performance. Too little bond area and the glue joint will fail, too much bond area and the face will not perform i.e. the coefficient of restitution will not be optimized, and in some instances too much bond area will result in the face peeling away from the club head due to the differences in stiffness. Thus, TPLW, TPLT, BPLW, and BPLT dimensions are all important to the overall performance of the club head and for avoiding bond or glue joint failure, which can result from either too little bond area or too much bond area. In some instances, the bond area will range from 850 $mm^2$ to 1800 $mm^2$, preferably between 1,300 $mm^2$ to 1,500 $mm^2$. In some instances a ratio of the bond area to the inner surface area of the strike plate (rear surface area of the strike plate) will range from 21% to 45%. In some instances, a total bond area of the strike plate will be less than a total bond area of the crown insert. In some instances, a ledge width TPLW and/or BPLW will be less than a ledge width of the forward crown-opening recessed ledge 168A (front-back as measured along the y-axis).

Referring to FIG. 31, a layer of adhesive 144 adhesively bonds the strike plate 143 to the body 102. The forward portion 112 includes a sidewall 146 that defines a depth of the plate-opening recessed ledge 147 and defines a radially outer periphery of the plate-opening recessed ledge 147 away from a center of the plate opening 149. The sidewall 146 is angled (e.g., transverse or perpendicular) relative to the plate-opening recessed ledge 147. The layer of adhesive 144 is interposed between the plate-opening recessed ledge 147 and the strike plate 143 and interposed between the sidewall 146 and the strike plate 143. A thickness (LT) of the layer of adhesive 144 between the plate-opening recessed ledge 147 and the strike plate 143 is greater than a thickness (ST) of the layer of adhesive 144 between the sidewall 146 and the strike plate 143, in some examples. According to one particular example, the thickness (LT) of the layer of adhesive 144 between the plate-opening recessed ledge 147 and the strike plate 143 is between 0.25 mm and 0.45 mm, and the thickness (ST) of the layer of adhesive 144 between the sidewall 146 and the strike plate 143 is between 0.15 mm and 0.25 mm.

In some instances, the strike plate may have a maximum face plate height of no more than 55 mm as measured along the z-axis through the club head origin, preferably no more than 55 mm and no less than 40 mm, even more preferably between 49 mm and 54 mm. In some instance, the strike plate formed of fiber-reinforced polymeric material may have a front surface area of no more than 4,180 $mm^2$, and preferably between 3,200 $mm^2$ and 4,180 $mm^2$, more preferably between 3,500 $mm^2$ and 4,180 $mm^2$. According to certain examples, the strike face 145 has a first bulge radius of at least 300 mm and a first roll radius of at least 250 mm. Generally, a bulge radius greater than 300 mm has a better CT creep rate and club heads with a bulge no less 300 mm bulge radius and a roll radius within 30-50 mm of the bulge radius performed well.

Figure 10:
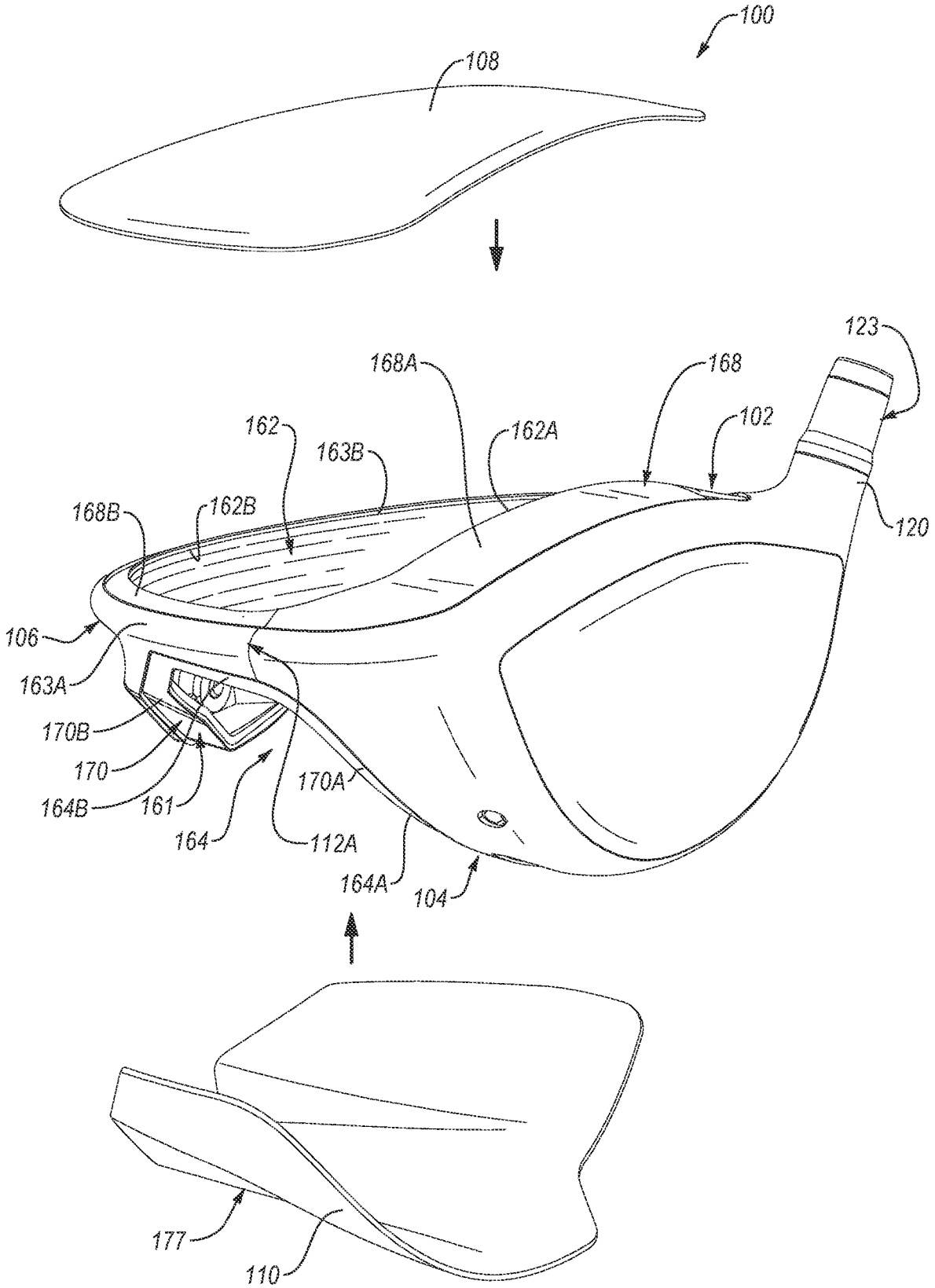
FIG. 10 is a schematic, exploded, perspective view of the golf club head of FIG. 1, according to one or more examples of the present disclosure.
Figure 11:
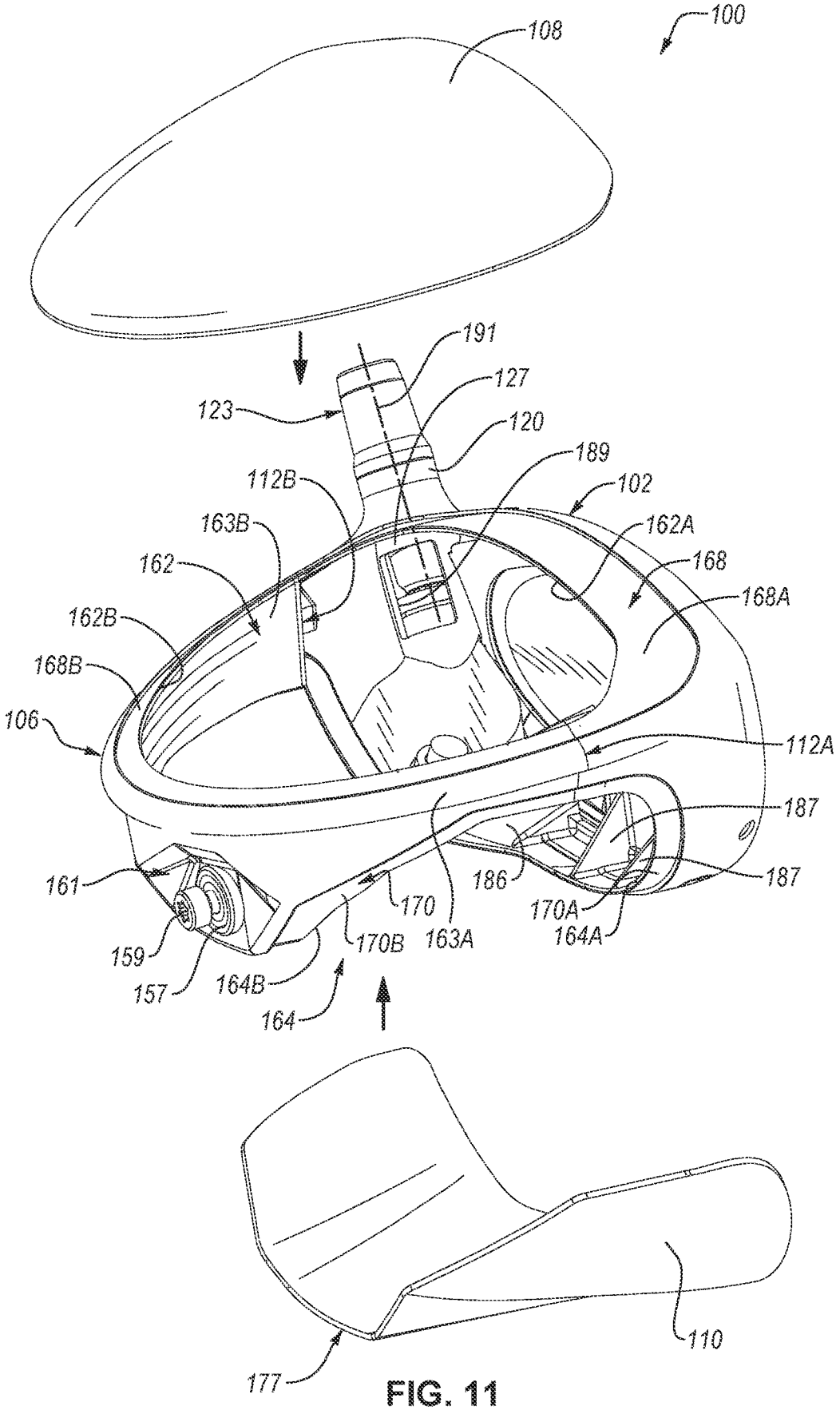
FIG. 11 is another schematic, exploded, perspective view of the golf club head of FIG. 1, according to one or more examples of the present disclosure.
Figure 12:
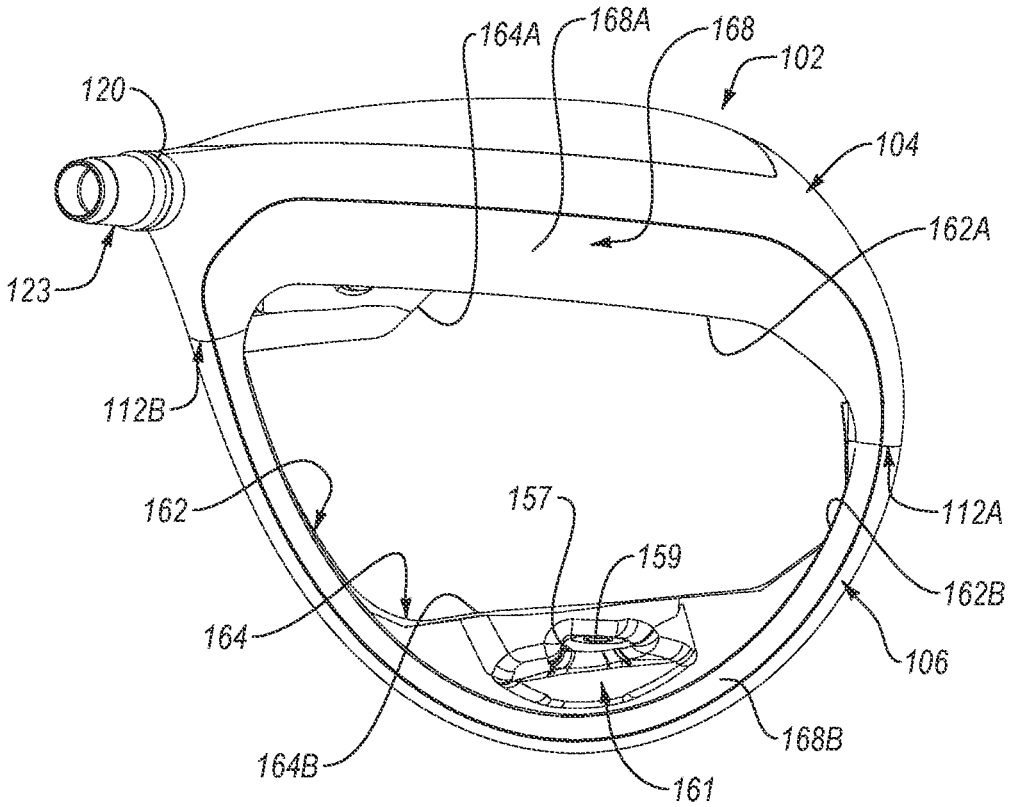
FIG. 12 is a schematic, top plan view of a body of the golf club head of FIG. 1, according to one or more examples of the present disclosure.
Figure 13:
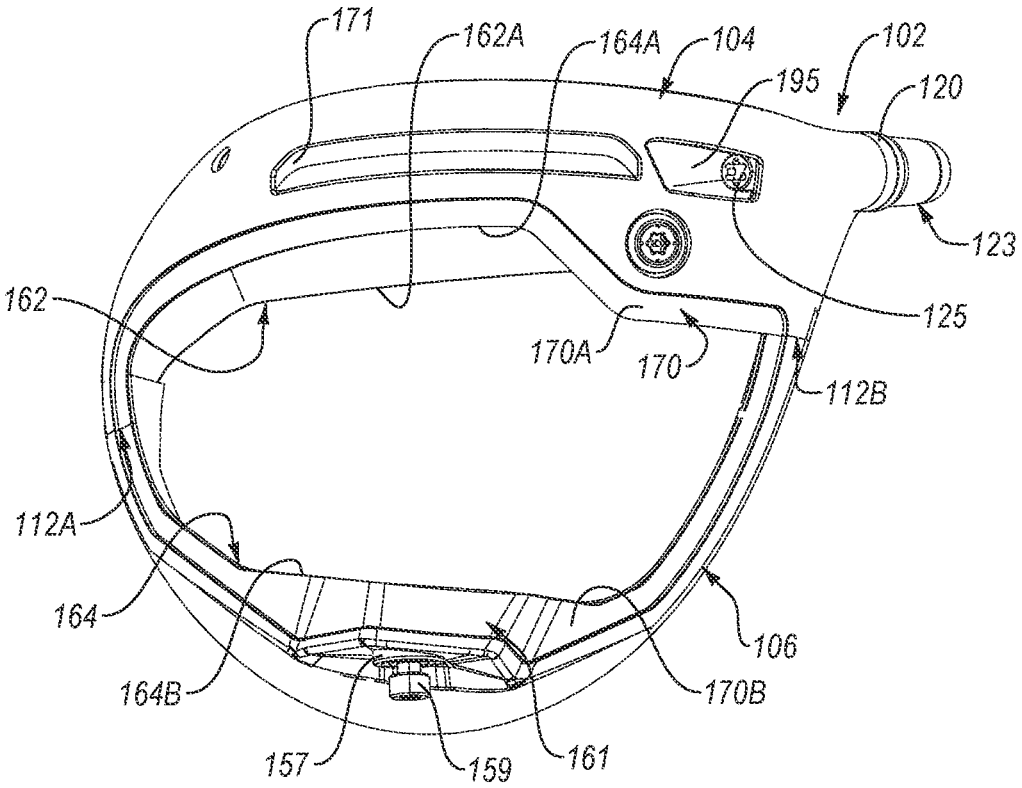
FIG. 13 is a schematic, bottom plan view of the body of the golf club head of FIG. 1, according to one or more examples of the present disclosure.

The golf club head 100 includes a body 102, a crown insert 108 (or crown panel) attached to the body 102 at a top of the golf club head 100, and a sole insert 110 (or sole panel) attached to the body 102 at a bottom of the golf club head 100 (see, e.g. FIGS. 10 and 11). Accordingly, the body 102 effectually provides a frame to which one or more inserts, panels, or plates are attached. The body 102 includes a cast cup 104 and a ring 106 (e.g., a rear ring). The ring 106 is joined to the cast cup 104 at a toe-side joint 112A and a heel-side joint 112B. The cast cup 104 defines at least part of the forward portion 112 of the golf club head 100. The ring 106 defines at least part of the rearward portion 118 of the golf club head 100. Additionally, the cast cup 104 defines part of the crown portion 119, the sole portion 117, the heel portion 116, the toe portion 114, and the skirt portion 121. Similarly, the ring 106 defines part of the heel portion 116, the toe portion 114, and the skirt portion 121.

Figure 14:
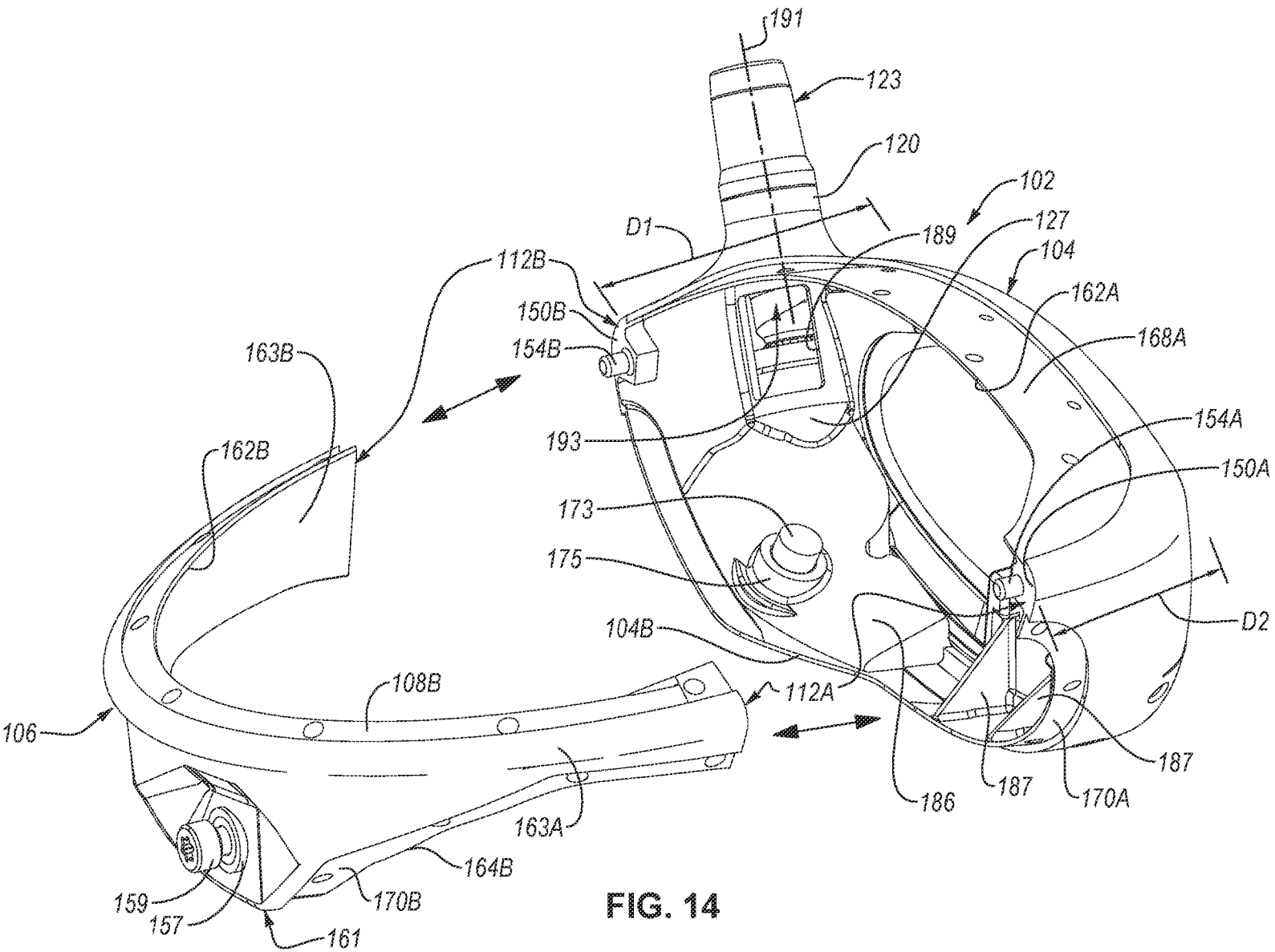
FIG. 14 is a schematic, exploded, perspective view of the body of the golf club head of FIG. 1, according to one or more examples of the present disclosure.

The cast cup 104 (or just cup) is cup-shaped. More specifically, as shown in FIG. 14, the cast cup 104, including the strike face 145, is enclosed on one end by the strike face 145, enclosed on four sides (e.g., by the crown portion 119, the sole portion 117, the toe portion 114, and the heel portion 116), which extend substantially transversely from the strike face 145, and open on an end opposite the strike face 145. Accordingly, the cast cup 104, when coupled with the strike face 145, resembles a cup or a cup-like unit.

The ring 106 is not circumferentially closed or does not form a continuous annular or circular shape. Instead, the ring 106 is circumferentially open and defines a substantially semi-circular shape. Thus, as defined herein, the ring 106 is termed a ring because it has a ring-like, semi-circular shape, and, when joined to the cast cup 104, forms a circumferentially closed or annular shape with the cast cup 104.

The cast cup 104 is formed separately from the ring 106 and the ring 106 is subsequently joined to the cast cup 104. Accordingly, the body 102 has at least a two-piece construction where the cast cup 104 defines one piece of the body 102 and the ring 106 define another piece of the body 102. Accordingly, a seam is defined at each of the toe-side joint 112A and the heel-side joint 112B where the cast cup 104 and the ring 106 are adjoined. The cast cup 104 and the ring 106 are separately formed using any of various manufacturing techniques. In one example, the cast cup 104 and the ring 106 are formed using a casting process. Because the cast cup 104 and the ring 106 are formed separately, the cast cup 104 and the ring 106 can be made of different materials. For example, the cast cup 104 can be made of a first material and the ring 106 can be made of a second material where the second material is different than the first material.

Figure 15:
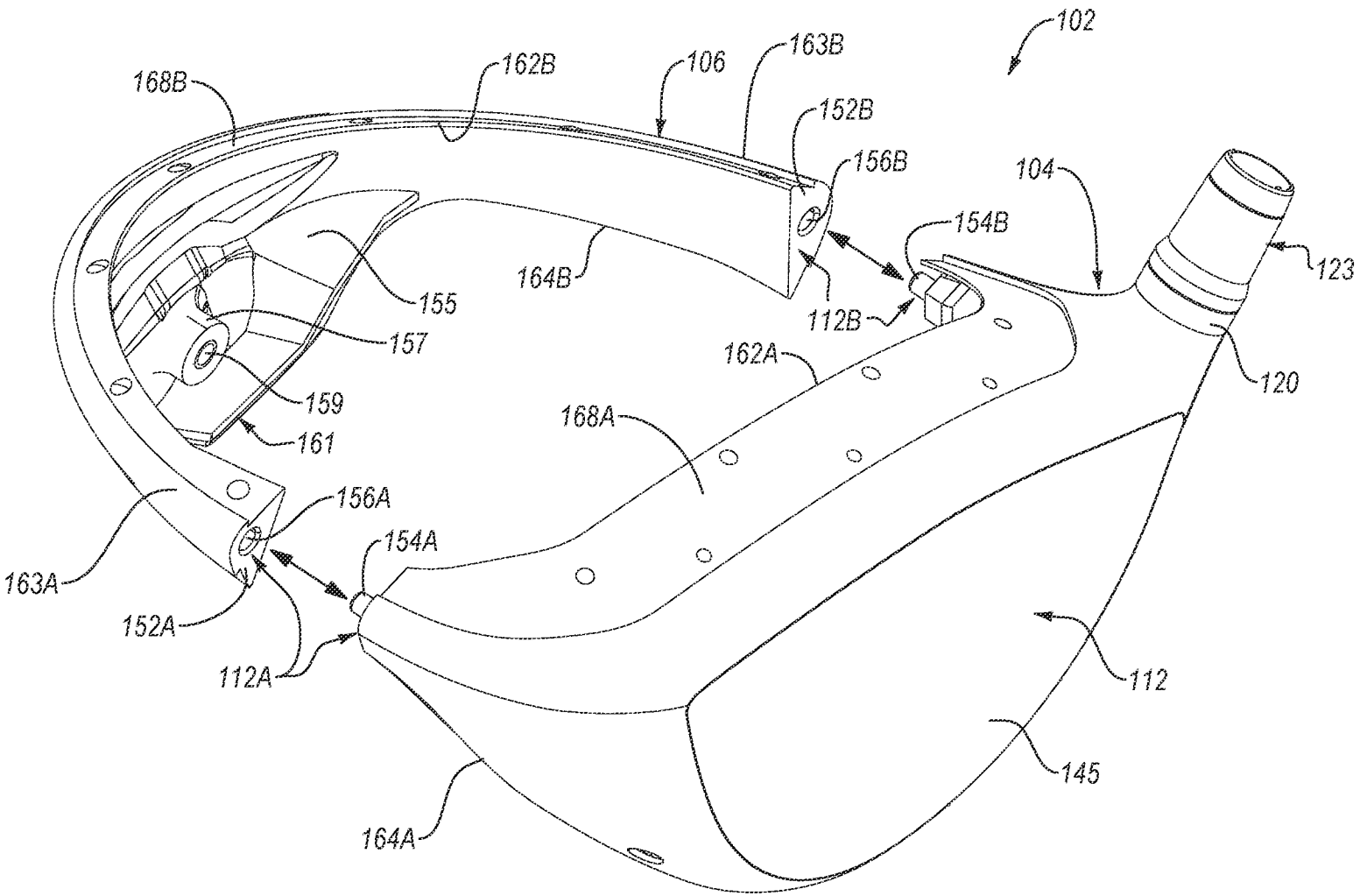
FIG. 15 is another schematic, exploded, perspective view of the body of the golf club head of FIG. 1, according to one or more examples of the present disclosure.

Referring to FIGS. 14 and 15, the cast cup 104 includes a toe ring-engagement surface 150A and a heel ring-engagement surface 150B. Similarly, the ring 106 includes a toe cup-engagement surface 152A and a heel cup-engagement surface 152B. The toe-side joint 112A is formed by abutting and securing together the toe ring-engagement surface 150A of the cast cup 104 and the toe cup-engagement surface 152A of the ring 106 and abutting and securing together the heel ring-engagement surface 150B of the cast cup 104 and the heel cup-engagement surface 152B of the ring 106. The engagement surfaces can be secured together via any suitable securing techniques, such as welding, brazing, adhesives, mechanical fasteners, and the like.

To help strengthen and stiffen the toe-side joint 112A and the heel-side joint 112B, complementary mating elements can be incorporated into or coupled to the engagement surfaces. In the illustrated example, the cast cup 104 includes a toe projection 154A protruding from the toe ring-engagement surface 150A and a heel projection 154B protruding from the heel ring-engagement surface 150B. In contrast, in the illustrated example, the ring 106 includes a toe receptacle 156A formed in the toe cup-engagement surface 152A and a heel receptacle 156B formed in the heel cup-engagement surface 152B. The toe projection 154A mates with (e.g., is received within) the toe receptacle 156A and the heel projection 154B mates with (e.g., is received within) the heel receptacle 156B as the engagement surfaces abut each other to form the joints. Although in the illustrated example, the toe projection 154A and the heel projection 154B form part of the cast cup 104 and the toe receptacle and the heel receptacle 156B form part of the ring 106, in other examples, the mating elements can be reversed such that the toe projection 154A and the heel projection 154B form part of the ring 106 and the toe receptacle and the heel receptacle 156B form part of the cast cup 104. Additionally, different types of complementary mating elements, such as tabs and notches, can be used in addition to or in place of the projections and receptacles.

In some examples, the toe-side joint 112A and the heel-side joint 112B are located a sufficient distance from the strike face 145 to avoid potential failures due to severe impacts undergone by the golf club head 100 when striking a golf ball. For example, each one of the toe-side joint 112A and the heel-side joint 112B can be spaced at least 20 mm, at least 30 mm, at least 40 mm, at least 50 mm, at least 60 mm, and/or from 20 mm to 70 mm rearward of the center face 183 of the strike face 145, as measured along a y-axis (front-to-back direction) of the club head origin coordinate system 185. Referring to FIG. 14, according to certain examples, a first distance D1, from the strike face 145 to the heel ring-engagement surface 150B, is less than a second distance D2, from the strike face 145 to the toe ring-engagement surface 150A. In other words, in some examples, the cast cup 104 extends rearwardly from the strike face 145 a shorter distance at the heel portion 116 than at the toe portion 114.

Referring to FIGS. 10-13, the body 102 comprises a crown opening 162 and a sole opening 164. The crown opening 162 is located at the crown portion 119 of the golf club head 100 and when open provides access into the interior cavity 113 of the golf club head 100 from a top of the golf club head 100. In contrast, the sole opening 164 is located at the sole portion 117 of the golf club head 100 and when open provides access into the interior cavity 113 of the golf club head 100 from a bottom of the golf club head 100. Corresponding sections of the crown opening 162 and the sole opening 164 are defined by the cast cup 104 and the ring 106. More specifically, referring to FIGS. 10-15 a forward section 162A of the crown opening 162 and a forward section 164A of the sole opening 164 are defined by the cast cup 104, and a rearward section 162B of the crown opening 162 and a rearward section 164B of the sole opening 164 are defined by the ring 106. Accordingly, when the cast cup 104 and the ring 106 are joined together, the forward section 162A and the rearward section 162B collectively define the crown opening 162 and the forward section 164A and the rearward section 164B collectively define the sole opening 164.

The cast cup 104 additionally includes a forward crown-opening recessed ledge 168A and a forward sole-opening recessed ledge 170A. The ring 106 includes a rearward crown-opening recessed ledge 168B and a rearward sole-opening recessed ledge 170B. The ledges are offset inwardly, toward the interior cavity 113, from the exterior surfaces of the body 102 surrounding the ledges by distances corresponding with the thicknesses of the crown insert 108 and the sole insert 110. In some examples, the offset of the ledges from the exterior surfaces of the body 102 is approximately equal to the corresponding thicknesses of the crown insert 108 and the sole insert 110, such that the inserts are flush with the corresponding surrounding exterior surfaces of the body 102 when attached to the ledges. However, in some examples, the crown insert 108 and the sole insert 110 need not be flush with (e.g., can be raised or recessed relative to) the surrounding exterior surface of the body 102 when seatably engaged with the corresponding ledges. In some examples, a thickness of the sole insert 110 is greater than a thickness of the crown insert 108. Moreover, the sole insert 110 is made up of a first quantity of stacked plies and the crown insert 108 is made up of a second quantity of stacked plies. In some examples, the first quantity of stacked plies is greater than the second quantity of stacked plies.

When the cast cup 104 and the ring 106 are joined, the forward crown-opening recessed ledge 168A and the rearward crown-opening recessed ledge 168B collectively define a crown-opening recessed ledge 168 of the body 102 and the forward sole-opening recessed ledge 170A and the rearward sole-opening recessed ledge 170B collectively define a sole-opening recessed ledge 170 of the body 102. The inner periphery of the forward crown-opening recessed ledge 168A defines the forward section 162A of the crown opening 162 and the inner periphery of the rearward crown-opening recessed ledge 168B defines the rearward section 162B of the crown opening 162. Likewise, the inner periphery of the forward sole-opening recessed ledge 170A defines the periphery of the forward section 164A of the sole opening 164 and the inner periphery of the rearward sole-opening recessed ledge 170B defines the periphery of the rearward section 164B of the sole opening 164. Accordingly, the inner periphery of the crown-opening recess ledge 168 defines the periphery of the crown opening 162 and the inner periphery of the sole-opening recess ledge 170 defines the periphery of the sole opening 164.

Referring to FIG. 31, a thickness of the body 102 at the crown portion 119 decreases in a rearward-to-forward direction from a forward extent 132 of the crown opening recess ledge 168, and decreases in a forward-to-rearward direction from the forward extent 132 of the crown opening recess ledge 168. This results in a localized increase in thickness at the forward extent 132, which helps to strengthen and stiffen the joint between the body 102 and the crown insert 108.

The crown insert 108 and the sole insert 110 are formed separately from each other and separately from the body 102. Accordingly, the crown insert 108 and the sole insert 110 are attached to the body 102 as shown in FIGS. 10 and 11. In some examples, the crown insert 108 is seated on and adhered to, such as with an adhesive, the crown-opening recessed ledge 168 and the sole insert 110 is seated on and adhered to, such as with an adhesive, the sole-opening recessed ledge 170. In this manner, the crown insert 108 encloses or covers the crown opening 162 and defines, at least in part, the crown portion 119 of the golf club head 100, and the sole insert 110 encloses or covers the sole opening 164 and defines, at least in part, the sole portion 117 of the golf club head 100.

Figure 4:
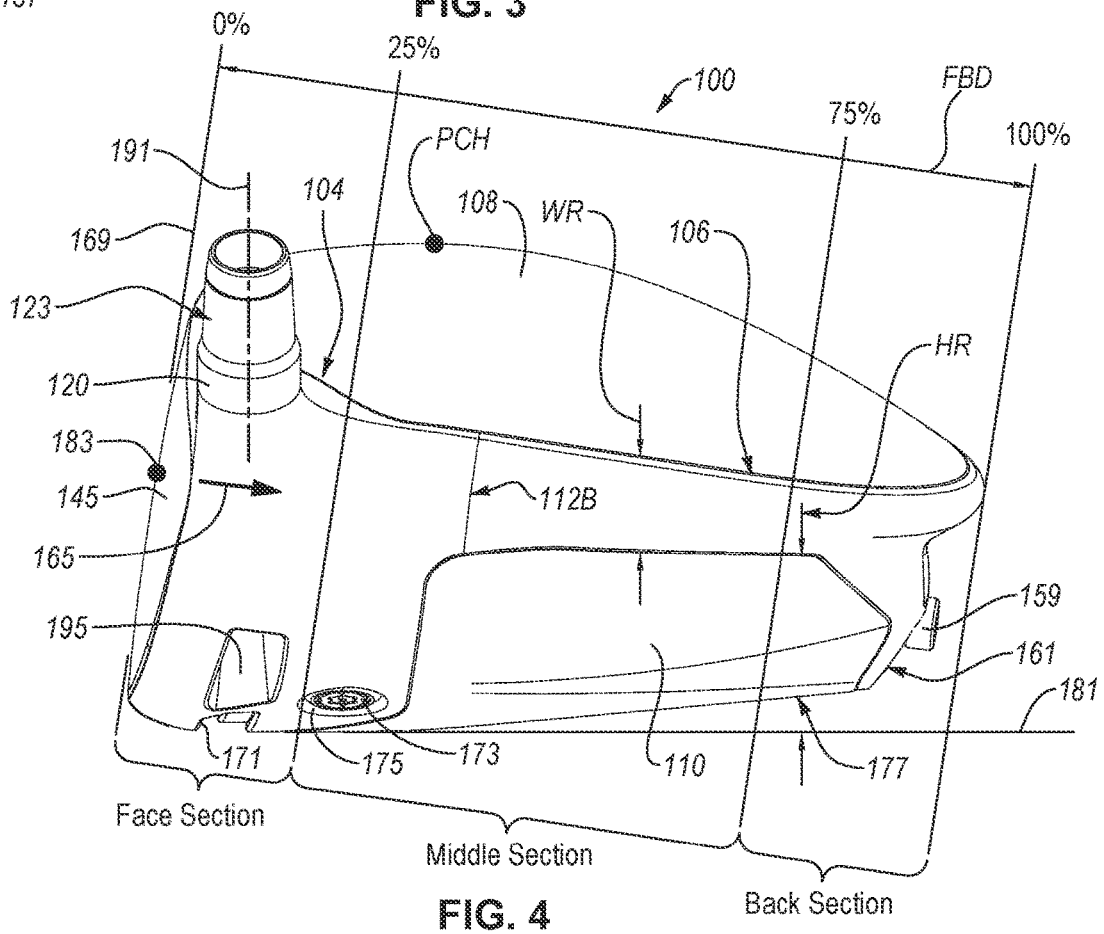
FIG. 4 is another schematic, side elevation view of the golf club head of FIG. 1, according to one or more examples of the present disclosure.

The crown insert 108 and the sole insert 110 can have any of various shapes. Referring to FIG. 4, in one example, the crown insert 108 is shaped such that a location (PCH), corresponding with the peak crown height of the golf club head 100, is rearward of a hosel 120 of the golf club head 100 and rearward of the hosel axis 191 of the hosel 120 of the golf club head 100. The peak crown height is the maximum crown height of a golf club head where the crown height at a given location along the golf club head is the distance from the ground plane 181, when the golf club head is in the address position on the ground plane, to an uppermost point on the crown portion at the given location. In some examples, the crown height of the golf club head 100 increases and then decreases in a front-to-rear direction away from the strike face 145. In certain examples, the portion or exterior surface of the crown portion that defines the peak crown height is made of the at least one first material. According to some examples, a first crown height is defined at a face-to-crown transition region in the forward crown area where the club face connects to the crown portion of the club head, a second crown height is defined at a crown-to-skirt transition region where the crown portion connects to a skirt of the golf club head near a rear end of the golf club head, and a maximum crown height is defined rearward of the first crown height and forward of the second crown height, where the maximum crown height is greater than both the first and second crown heights. In some examples, the maximum crown height occurs toeward of a geometric center of the strike face. According to certain examples, the maximum crown height is formed by a non-metal composite crown insert.

Figure 3:
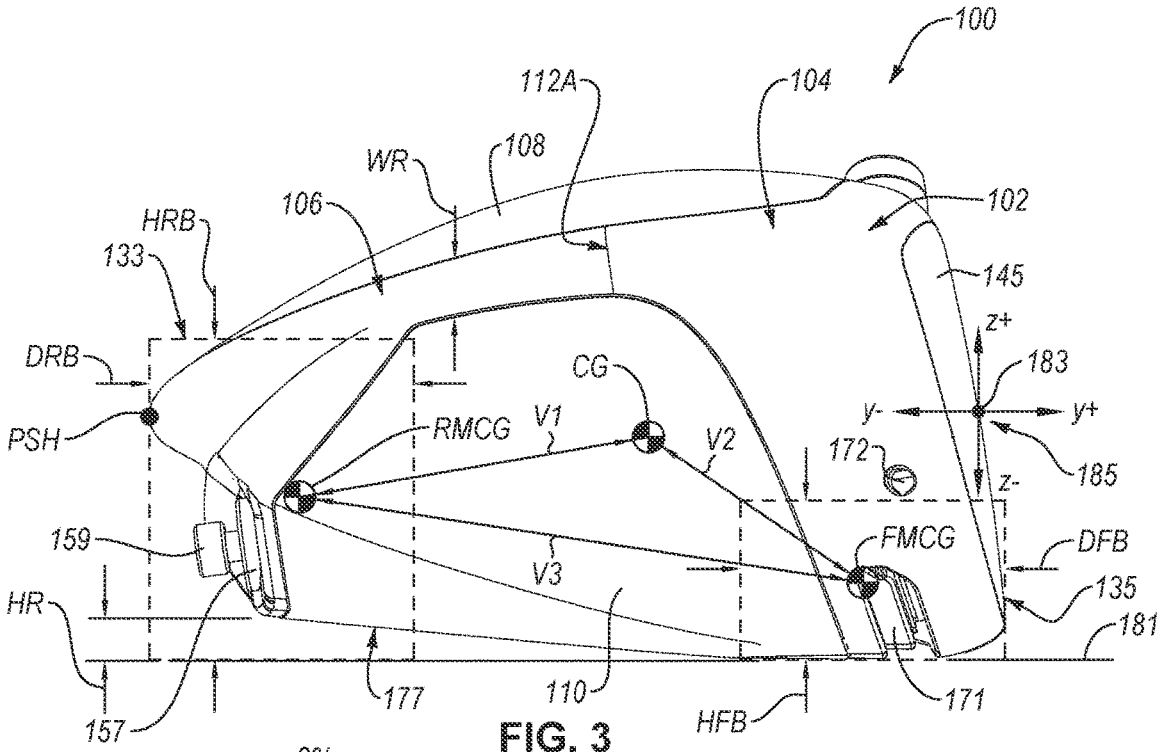
FIG. 3 is a schematic, side elevation view of the golf club head of FIG. 1, according to one or more examples of the present disclosure.

Referring to FIG. 3, a peak skirt height (shown associated with a location (PSH)) is the maximum skirt height of a golf club head, where the skirt height at a given location along the golf club head is the distance from the ground plane, when the golf club head is in the address position on the ground plane, to an uppermost point on the skirt portion at the rearwardmost point of the skirt portion on the golf club head.

According to some examples, a ratio of a peak crown height of the crown portion 119 to a peak skirt height of the skirt portion 121 ranges between about 0.45 to 0.59, preferably 0.49-0.55, and in one embodiment the skirt height is about 34 mm and the peak crown height is about 65 mm resulting in a ratio of peak skirt height to peak crown height of about 0.52. A peak skirt height typically ranges between 28 mm and 38 mm, preferably between 31 mm and 36 mm. A peak crown height typically ranges between 60 mm and 70 mm, preferably between 62 mm and 67 mm. It is desirable to limit a difference between the peak crown height and the peak skirt height to no more than 40 mm, preferably between 27 mm and 35 mm. It is desirable for the peak skirt height to be the same as or greater than a Z-up value for the golf club head i.e. the vertical distance along a z-axis from the ground plane 181 to the center of gravity. It is desirable for the peak crown height to be two times (2×) larger than a Z-up value for the golf club head. A greater peak skirt height may help with better aerodynamics and better air flow attachment especially for faster swing speeds. Likewise, if the difference between the peak crown height and peak skirt height is too great there will be a greater likelihood of the flow separating early from the golf club head i.e. increased likelihood of turbulent flow.

The construction and material diversity of the golf club head 100 enables the golf club head 100 to have a desirable center-of-gravity (CG) location and peak crown height location. In one example, a y-axis coordinate, on the y-axis of the club head origin coordinate system 185, of the location (PCH) of the peak crown height is between about 26 mm and about 42 mm. In the same or a different example, a distance parallel to the z-axis of the club head origin coordinate system 185, from the ground plane 181, when the golf club head 100 is in the address position, of the location (PCH) of the peak crown height ranges between 60 mm and 70 mm, preferably between 62 mm and 67 mm as described above. According to some examples, a y-axis coordinate, on the y-axis of the head origin coordinate system 185, of the center-of-gravity (CG) of the golf club head 100 ranges between 25 mm and 50 mm, preferably between 32 mm and 38 mm, more preferably between 36.5 mm and 42 mm, an x-axis coordinate, on the x-axis of the head origin coordinate system 185, of the center-of-gravity (CG) of the golf club head 100 ranges between −10 mm and 10 mm, preferably between −6 mm and 6 mm, and more preferably between −7 mm and 7 mm, and a z-axis coordinate, on the z-axis of the head origin coordinate system 185, of the center-of-gravity (CG) of the golf club head 100 is less than 2 mm, such as ranges between −10 mm and 2 mm, preferably between −7 mm and −2 mm.

Figure 5:
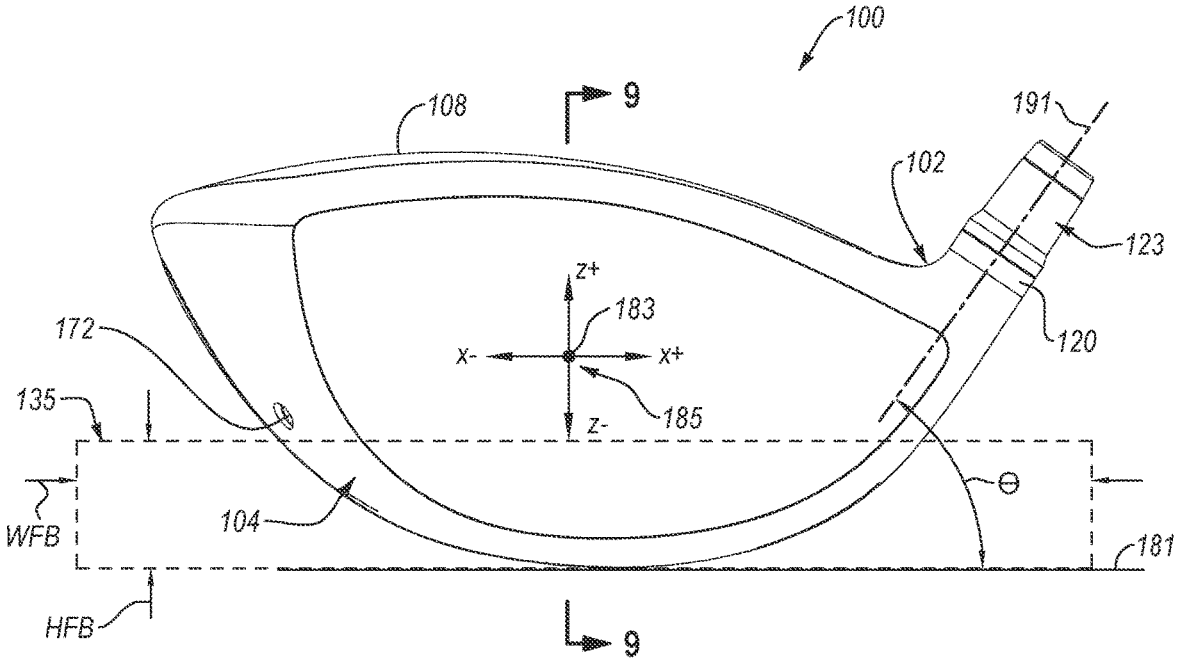
FIG. 5 is a schematic, front view of the golf club head of FIG. 1, according to one or more examples of the present disclosure.
Figure 6:
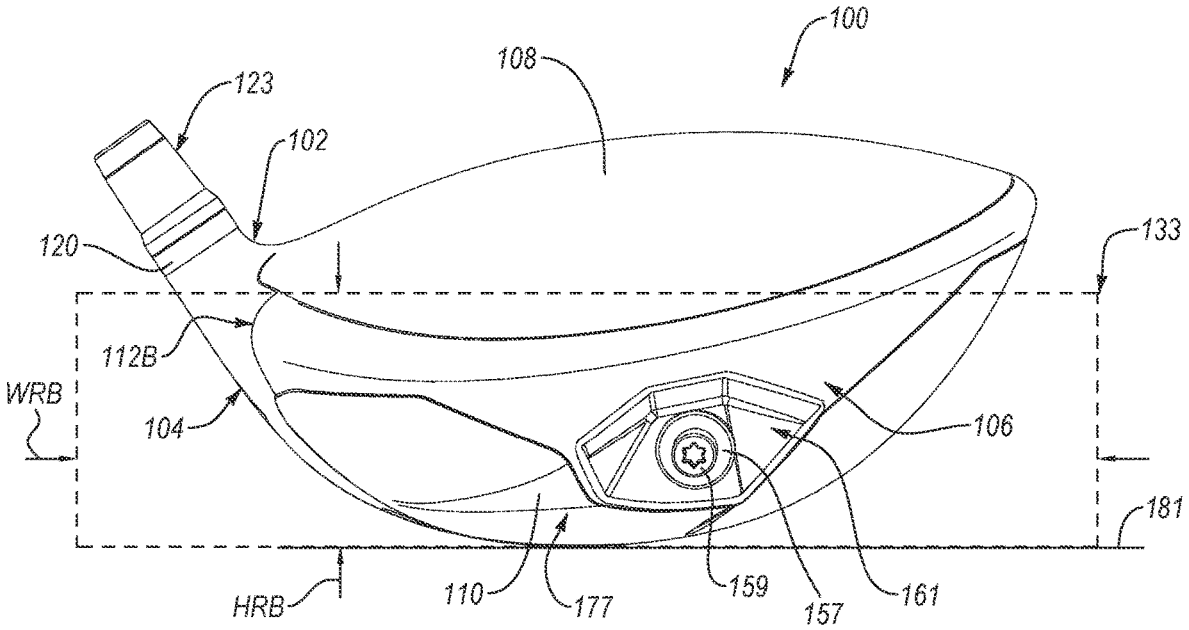
FIG. 6 is a schematic, rear view of the golf club head of FIG. 1, according to one or more examples of the present disclosure.

Additionally, the construction and material diversity of the golf club head 100 enables the golf club head 100 to have desirable mass distribution properties. Referring to FIGS. 3, 5, and 6, the golf club head 100 includes a rearward mass and a forward mass. The rearward mass of the golf club head 100 is defined as the mass of the golf club head 100 within an imaginary rearward box 133 having a height (HRB), parallel to a crown-to-sole direction (parallel to z-axis of golf club head origin coordinate system 185), of 35 mm, a depth (DRB), in a front-to-rear direction (parallel to y-axis of golf club head origin coordinate system 185), of 35 mm, and a width (WRB), in a toe-to-heel direction (parallel to x-axis of golf club head origin coordinate system 185), greater than a maximum width of the golf club head 100. As shown, a rear side of the imaginary rearward box 133 is coextensive with a rearmost end of the golf club head 100 and a bottom side of the imaginary rearward box 133 is coextensive with the ground plane 181 when the golf club head 100 is in the address position on the ground plane 181. The forward mass of the golf club head 100 is defined as the mass of the golf club head 100 within an imaginary forward box 135 having a height (HFB), parallel to the crown-to-sole direction, of 20 mm, a depth (DFB), in the front-to-rear direction, of 35 mm, and a width (WFB), in the toe-to-heel direction, greater than a maximum width of the golf club head 100. As shown, a forward side of the imaginary forward box 135 is coextensive with a forwardmost end of the golf club head 100 and a bottom side of the imaginary forward box 135 is coextensive with the ground plane 181 when the golf club head 100 is in the address position on the ground plane 181.

According to some examples, a first vector distance (V1) from a center-of-gravity of the rearward mass (RMCG) to a CG of the driver-type golf club head is between 49 mm and 64 mm (e.g., 55.7 mm), a second vector distance (V2) from a center-of-gravity of the forward mass (FMCG) to the CG of the driver-type golf club head is between 22 mm and 34 mm (e.g., 29.0 mm), and a third vector distance (V3) from the CG of the rearward mass (RMCG) to the CG of the forward mass (FMCG) is between 75 mm and 82 mm (e.g., 79.75 mm). In certain examples, V1 is no more than 56.3 mm. In some examples, V2 is no less than 23.7 mm, preferably no less than 25 mm, or even more preferably no less than 27 mm. Some additional values of V1 and V2 relative to Zup and CGy values for various examples of the golf club head 100 are provided in Table 1 below. As defined herein, Zup measures the center-of-gravity of the golf club head 100 relative to the ground plane 181 along a vertical axis (e.g., parallel to the z-axis of the club head origin coordinate system 185) when the golf club head 100 is in the proper address position on the ground plane 181. CGy is the coordinate of the center-of-gravity of the golf club head 100 on the y-axis of the club head origin coordinate system 185.

TABLE 1

| Example | Zup | CGy | V1 | V2 |
|---|---|---|---|---|
| 1 | 26 mm | 37 mm | 55.7 mm | 29.0 mm |
| 2 | 30 mm | 37 mm | 56.3 mm | 31.8 mm |
| 3 | 22 mm | 37 mm | 55.2 mm | 27.3 mm |
| 4 | 25 mm | 32 mm | 61.0 mm | 23.7 mm |
| 5 | 25 mm | 40 mm | 52.7 mm | 30.76 mm |

The crown insert 108 has a crown-insert outer surface that defines an outward-facing surface or exterior surface of the crown portion 119. Similarly, the sole insert 110 has a sole-insert outer surface that defines an outward-facing surface or exterior surface of the sole portion 117. As defined herein, the crown-insert outer surface and the sole-inert outer surface includes the combined outer surfaces of multiple crown inserts and multiple sole inserts, respectively, if multiple crown inserts or multiple sole inserts are used. In one example, a total surface area of the sole-insert outer surface is smaller than a total surface area of the crown-insert outer surface. According to one example, the total surface area of the crown-insert outer surface is at least 9,482 $mm^2$. In one example, the total surface area of the sole-insert outer surface is at least 8,750 $mm^2$ and the sole insert has a maximum width, parallel to a heel-to-toe direction, of at least between 80 mm and 120 mm. The total surface area of the crown-insert outer surface ranges between 5,300 mm^2 to 11,000 mm^2, preferably between 9,200 mm^2 and 10,300 mm^2, preferably between 5,300 mm^2 and 7,000 mm^2. The total surface area of the sole-insert outer surface ranges between 4,300 mm^2 to 10,200 mm^2, preferably between 7,700 mm^2 and 9,900 mm^2, preferably between 4,300 mm^2 and 6,600 mm^2.

Preferably the total surface area of the sole-insert outer surface is greater than the total surface area of the sole-insert outer surface in the instance when at least a portion of the sole is formed of a composite material. A ratio of total surface area of the crown-insert outer surface formed of composite material to the total surface area of the sole-insert outer surface formed of composite material may be at least 2:1 in some instances, in other instance the ratio may be between 0.95 and 1.5, more preferably between 1.03 and 1.4, even more preferably between 1.05 and 1.3. In this instance a composite material will generally have a density between about 1 g/cc and about 2 g/cc, and preferably between about 1.3 g/cc and about 1.7 g/cc.

In some embodiments, the total exposed composite surface area in square centimeters multiplied by the CGy in centimeters and the resultant divided by the volume in cubic centimeters may range from 1.22 to 2.1, preferably between 1.24 and 1.65, even more preferably between 1.49 and 2.1, and even more preferably 1.7 and 2.1.

Moreover, the total mass of the crown insert 108 is less than a total mass of the sole insert 110 in some examples. According to some examples, where the crown insert 108 and the sole insert 110 are made of a fiber-reinforced polymeric material and the body 102 is made of a metallic material, a ratio of a total exposed surface area of the body 102 to a total exposed surface area (e.g., the surface area of the outward-facing surfaces) of the crown insert 108 and the sole insert 110 is between 0.95 and 1.25 (e.g., 1.08). The crown insert 108, whether a single piece or split into multiple pieces, has a mass of 9 grams and the sole insert 110, whether a single piece or split into multiple pieces, has a mass of 13 grams, in some examples. Moreover, in certain examples, the crown insert 108 is about 0.65 mm thick and the sole insert 110 is about 1.0 mm thick. However, in certain examples, the minimum thickness of the crown portion 119 is less than 0.6 mm. According to some examples, an areal weight of the crown portion 119 of the golf club head 100 is less than 0.35 g/cm$^2$ over more than 50% of an entire surface area of the crown portion 119 and/or at least part of the crown portion 119 is formed of a non-metal material with a density between about 1 g/cm$^3$ to about 2 g/cm$^3$. These and other properties of the crown insert 108 and the sole insert 110 can be found in U.S. Patent Application Publication No. 2020/0121994, published Apr. 23, 2020, which is incorporated herein by reference in its entirety. In certain examples, an areal weight of the sole portion 117 is less than about 0.35 g/cm$^2$ over more than about 50% of an entire surface area of the sole portion 117. In certain examples, an areal weight of the crown insert 108 is less than an areal weight of the sole insert 110. At least 50% of the crown portion 119 has a variable thickness that changes at least 25% along at least 50% of the crown portion 119, in certain examples.

The cast cup 104 of the body 102 also includes the hosel 120, which defines the hosel axis 191 extending coaxially through a bore 193 of the hosel 120 (see, e.g., FIG. 14). The hosel 120 is configured to be attached to a shaft of a golf club. In some examples, the hosel 120 facilitates the inclusion of a flight control technology (FCT) system 123 between the hosel 120 and the shaft to control the positioning of the golf club head 100 relative to the shaft.

The FCT system 123 may include a fastener 125 that is accessible through a lower opening 195 formed in a sole region of the cast cup 104. An additional example of the FCT system 123 is shown in association with the golf club head 400 of FIGS. 19 and 20, which has a hosel 420 and a lower opening 495 to facilitate attachment of the FCT system 123 to the body 102. The FCT system 123 includes multiple movable parts that fit within the and extend from the hosel 120. The fastener 125 facilitates adjustability of the FCT system 123 system by loosening the fastener 125 and maintaining an adjustable position of the golf club head relative to the shaft by tightening the fastener 125. The lower opening 195 is open to the bore 193 of the hosel 120. To promote an increase in discretionary mass, an internal portion 127 of the hosel 120 (i.e., a portion of the hosel 120 that is within the interior cavity 113) includes a lateral opening 189 that is open to the interior cavity 113. Because of the lateral opening 189, the internal portion 127 of the hosel 120 only partially surrounds FCT components extending through the bore 193 of the hosel 120. In some examples a height of the lateral opening 189, in a direction parallel to the hosel axis 191, is between 10 mm and 15 mm, a width of the lateral opening 189, in a direction perpendicular to the hosel axis 191, is at least 1 radian, and/or a projected area of the lateral opening 189 is at least 75 mm$^2$.

Referring to FIG. 15, in some examples, the cast cup 104 includes the strike face 145. In other words, in some examples, the strike face 145 is co-formed (e.g., co-cast) with all other portions of the cast cup 104. Accordingly, in these examples, the strike face 145 is made of the same material as the rest of the cast cup 104. However, in other examples, similar to those associated with the golf club heads of FIGS. 17 and 18, the strike face 145 is defined by a strike plate that is formed separate from the cast cup 104 and separately attached to the cast cup 104. According to certain examples, the portion of the golf club head 100 defining the strike face 145 or the strike plate defining the strike face 145 includes variable thickness features similar to those described in more detail in U.S. patent application Ser. No. 12/006,060; and U.S. Pat. Nos. 6,997,820; 6,800,038; and 6,824,475, which are incorporated herein by reference in their entirety.

Figure 21:
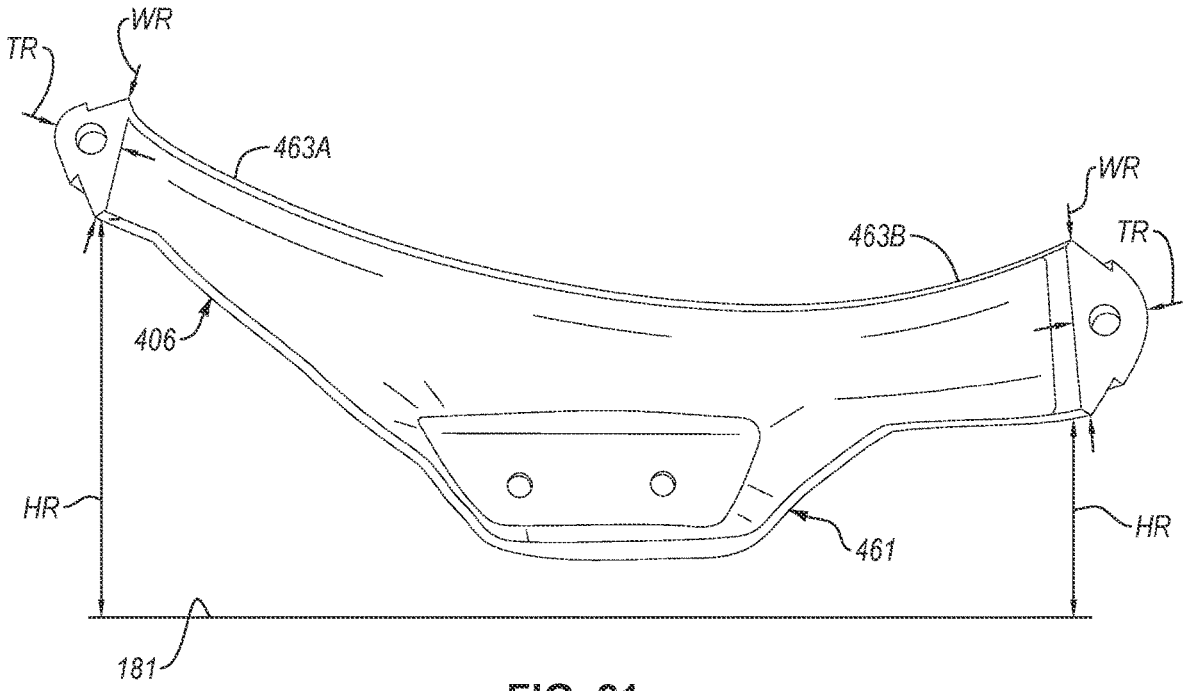
FIG. 21 is a schematic, front elevation view of a ring of the golf club head of FIG. 19, according to one or more examples of the present disclosure.
Figure 22:
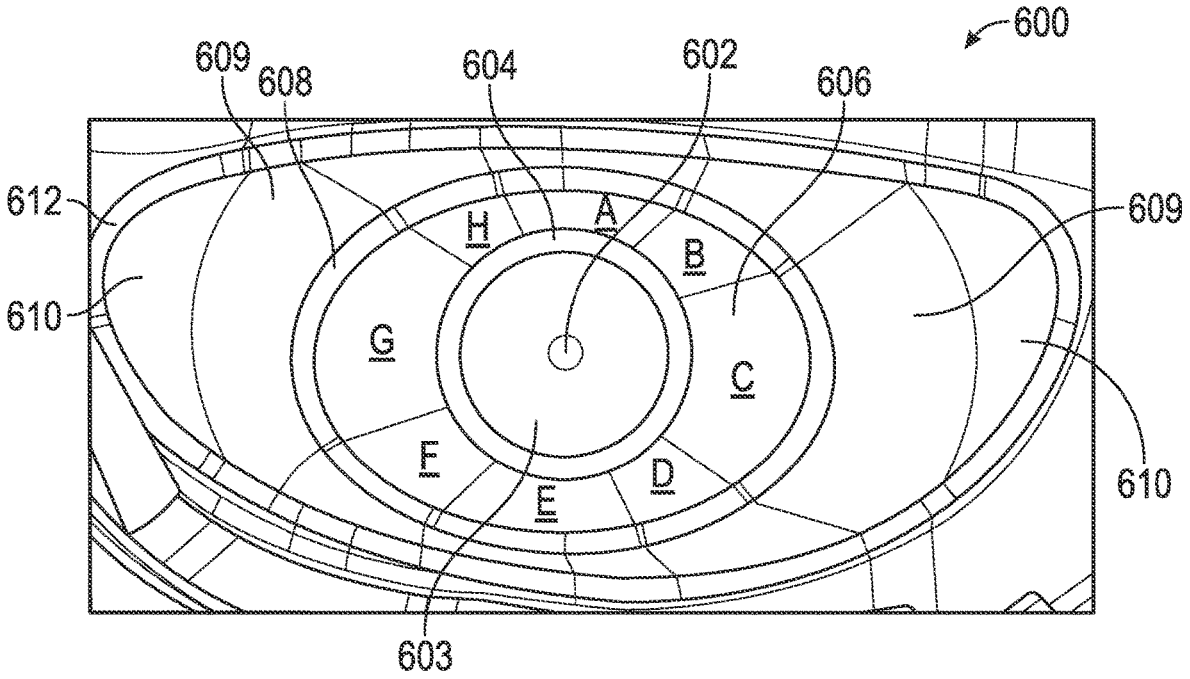
FIG. 22 is a rear view of a face portion of a golf club head, according to one or more examples of the present disclosure.
Figure 23:
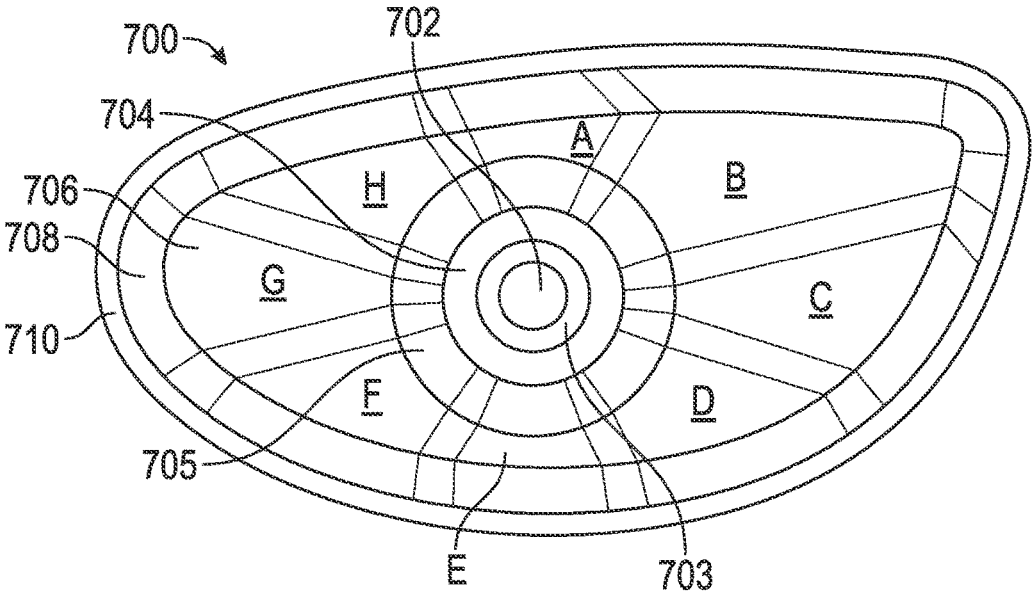
FIG. 23 is a rear view of a face portion of a golf club head, according to one or more examples of the present disclosure.
Figure 24:
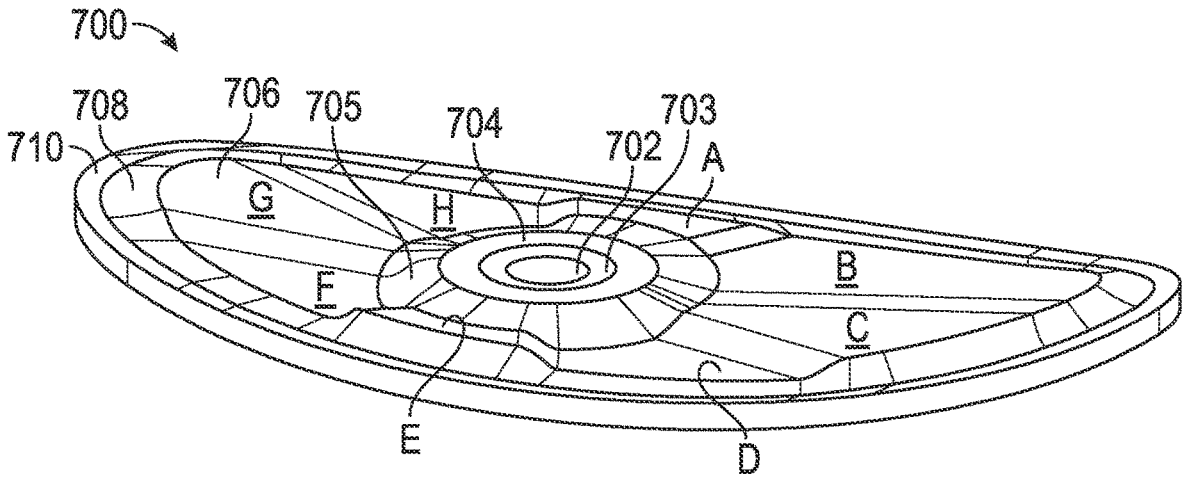
FIG. 24 is a perspective view of the face portion of FIG. 23, according to one or more examples of the present disclosure.

FIG. 21 illustrates an exemplary rear surface of a face portion 600 of one or more of the golf club heads disclosed herein. In FIG. 21, the rear surface is viewed from the rear with the hosel/heel to the left and the toe to the right. FIGS. 22 and 23 illustrate another exemplary face portion 700 having a variable thickness profile, and FIG. 24 illustrates yet another exemplary face portion 800 having a variable thickness profile. The variable thickness profile of the face portion 700 is formed by a cone-shaped projection, which can have a geometric center that is toeward of a geometric center of the strike face in some examples. The face portions disclosed herein can be formed as a result of a casting process and optional post-casting modifications to the face portions. Accordingly, the face portion can have a great variety of novel thickness profiles. For example, in one instances, a thickness of the forward portion, at the strike face, changes at least 25% along the strike face. By casting the face into a desired geometry, rather than forming the face plate from a flat rolled sheet of metal in a traditional process, the face can be created with greater variety of geometries and can have different material properties, such as different grain direction and chemical impurity content, which can provide advantages for a golf performance and manufacturing.

In a traditional process, the face plate is formed from a flat sheet of metal having a uniform thickness. Such a sheet of metal is typically rolled along one axis to reduce the thickness to a certain uniform thickness across the sheet. This rolling process can impart a grain direction in the sheet that creates a different material properties in the rolling axis direction compared to the direction perpendicular to the rolling direction. This variation in material properties can be undesirable and can be avoided by using the disclosed casting methods instead to create face portion.

Furthermore, because a conventional face plate starts off as a flat sheet of uniform thickness, the thickness of the whole sheet has to be at least as great as the maximum thickness of the desired end product face plate, meaning much of the starting sheet material has to be removed and wasted, increasing material cost. By contrast, in the disclosed casting methods, the face portion is initially formed much closer to the final shape and mass, and much less material has to be removed and wasted. This saves time and cost.

Still further, in a conventional process, the initial flat sheet of metal has to be bent in a special process to impart a desired bulge and roll curvature to the face plate. Such a bending process is not needed when using the disclosed casting methods.

The unique thickness profiles illustrated in FIGS. 22-25 are made possible using casting methods, such as those disclosed in U.S. Pat. No. 10,874,915 issued Dec. 29, 2020, and were previously not possible to achieve using conventional processes, such as starting from a sheet of metal having a uniform thickness, mounting the sheet in a lathe or similar machine and turning the sheet to produce a variable thickness profile across the rear of the face plate. In such a turning process, the imparted thickness profile must be symmetrical about the central turning axis, which limits the thickness profile to a composition of concentric circular ring shapes each having a uniform thickness at any given radius from the center point. In contrast, no such limitations are imposed using the disclosed casting methods, and more complex face geometries can be created.

By using casting methods, large numbers of the disclosed club heads can be manufacture faster and more efficiently. For example, 50 or more heads can be cast at the same time on a single casting tree, whereas it would take much longer and require more resources to create the novel face thickness profiles on face plates using a conventional milling methods using a lathe, one at a time.

In FIG. 22, the rear face surface or interior surface of the face portion 600 includes a non-symmetrical variable thickness profile, illustrating just one example of the wide variety of variable thickness profiles made possible using the disclosed casting methods. The center 602 of the face can have a center thickness, and the face thickness can gradually increase moving radially outwardly from the center across an inner blend zone 603 to a maximum thickness ring 604, which can be circular. The face thickness can gradually decrease moving radially outwardly from the maximum thickness ring 604 across an variable blend zone 606 to a second ring 608, which can be non-circular, such as elliptical. The face thickness can gradually decrease moving radially outwardly from the second ring 608 across an outer blend zone 609 to heel and toe zones 610 of constant thicknesses (e.g., minimum thickness of the face portion) and/or to a radial perimeter zone 612 defining the extent of the face portion 600 where the face transitions to the rest of the golf club head 100.

The second ring 608 can itself have a variable thickness profile, such that the thickness of the second ring 608 varies as a function of the circumferential position around the center 602. Similarly, the variable blend zone 606 can have a thickness profile that varies as a function of the circumferential position around the center 602 and provides a transition in thickness from the maximum thickness ring 604 to the variable and less thicknesses of the second ring 608. For example, the variable blend zone 606 to a second ring 608 can be divided into eight sectors that are labeled A-H in FIG. 22, including top zone A, top-toe zone B, toe zone C, bottom-toe zone D, bottom zone E, bottom-heel zone F, heel zone G, and top-heel zone H. These eight zones can have differing angular widths as shown, or can each have the same angular width (e.g., one eighth of 360 degrees). Each of the eight zones can have its own thickness variance, each ranging from a common maximum thickness adjacent the ring 604 to a different minimum thickness at the second ring 608. For example, the second ring can be thicker in zones A and E, and thinner in zones C and G, with intermediate thicknesses in zones B, D, F, and H. In this example, the zones B, D, F, and H can vary in thickness both along a radial direction (thinning moving radially outwardly) and along a circumferential direction (thinning moving from zones A and E toward zones C and G).

One example of the face portion 600 can have the following thicknesses: 3.1 mm at center 602, 3.3 mm at ring 604, the second ring 608 can vary from 2.8 mm in zone A to 2.2 mm in zone C to 2.4 mm in zone E to 2.0 mm in zone G, and 1.8 mm in the heel and toe zones 610.

According to one example, the ring 604 can be about 8 mm away from the center 602 and the ring 608 can be about 19 mm away from the center 602. The thickness of the face portion 600 at the center 602 can be between 2.8 mm and 3.0 mm. The thickness of the face portion 600 along the ring 604 can be between 2.9 mm and 3.1 mm. The thickness of the face portion 600 along the ring 608 proximate zone A can be between 2.35 mm and 2.55 mm, proximate zone C can be between 2.3 mm and 2.5 mm, proximate zone E can be between 2.1 mm and 2.3 mm, and proximate zone G can be between 2.6 mm and 2.8 mm. The thickness of the face portion 600 at approximately 35 mm away from the center 602 can be between 1.7 mm and 1.9 mm.

According to yet another example, the thickness of the face portion 600 at the center 602 is between 2.95 mm and 3.35 mm, at about 9 mm away from the center 602 is between 3.3 mm and 3.65 mm, at about 16 mm away from the center 602 is between 2.95 mm and 3.36 mm, and at about 28 mm away from the center 602 is between 2.03 mm and 2.27 mm. The thickness of the face portion 600 greater than 28 mm away from the center 602 can be between 1.8 mm and 1.95 mm on a toe side of the face portion 600 and between 1.83 mm and 1.98 mm on a heel side of the face portion 600.

FIGS. 23 and 24 show the rear face surface of another exemplary face portion 700 that includes a non-symmetrical variable thickness profile. The center 702 of the face can have a center thickness, and the face thickness can gradually increase moving radially outwardly from the center across an inner blend zone 703 to a maximum thickness ring 704, which can be circular. The face thickness can gradually decrease moving radially outwardly from the maximum thickness ring 704 across a variable blend zone 705 to an outer zone 706 comprised of a plurality of wedge shaped sectors A-H having varying thicknesses. As best shown in FIG. 24, sectors A, C, E, and G can be relatively thicker, while sectors B, D, F, and H can be relatively thinner. An outer blend zone 708 surrounding the outer zone 706 transitions in thickness from the variable sectors down to a perimeter ring 710 having a relatively small yet constant thickness. The outer zone 706 can also include blend zones between each of the sectors A-H that gradually transition in thickness from one sector to an adjacent sector.

One example of the face portion 700 can have the following thicknesses: 3.9 mm at center 702, 4.05 mm at ring 704, 3.6 mm in zone A, 3.2 mm in zone B, 3.25 mm in zone C, 2.05 mm in zone D, 3.35 mm in zone E, 2.05 mm in zone F, 3.00 mm in zone G, 2.65 mm in zone H, and 1.9 mm at perimeter ring 710.

Figure 25:
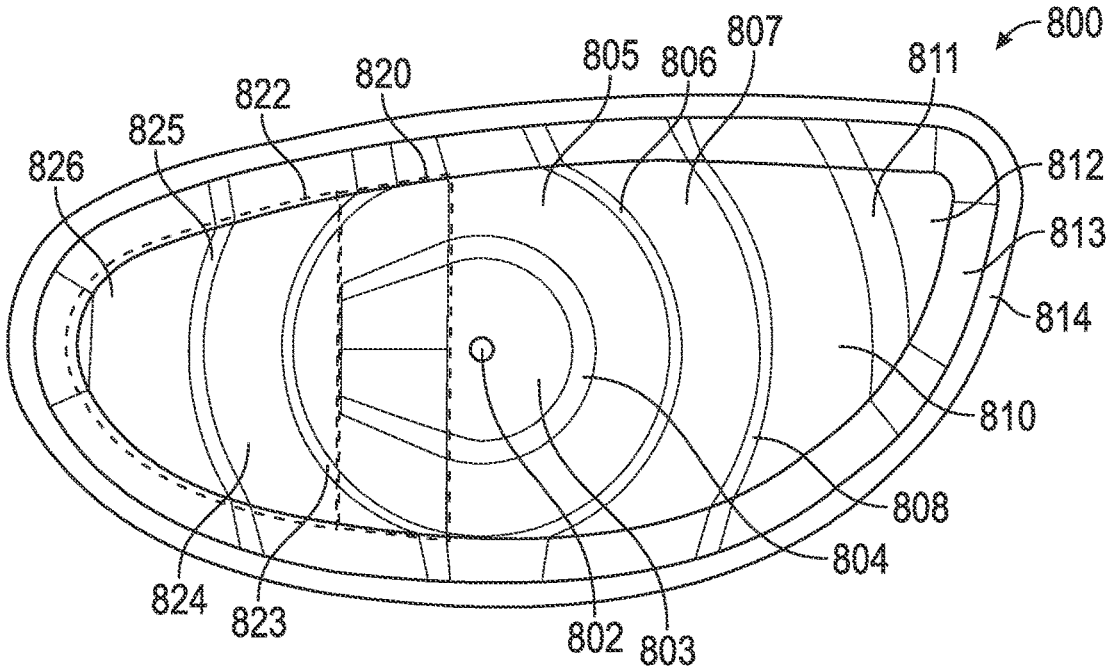
FIG. 25 is a rear view of a face portion of a golf club head, according to one or more examples of the present disclosure.

FIG. 25 shows the rear face of another exemplary face portion 800 that includes a non-symmetrical variable thickness profile having a targeted thickness offset toward the heel side (left side). The center 802 of the face has a center thickness, and to the toe/top/bottom the thickness gradually increases across an inner blend zone 803 to inner ring 804 having a greater thickness than at the center 802. The thickness then decreases moving radially outwardly across a second blend zone 805 to a second ring 806 having a thickness less than that of the inner ring 804. The thickness then decreases moving radially outwardly across a third blend zone 807 to a third ring 808 having a thickness less than that of the second ring 806. The thickness then decreases moving radially outwardly across a fourth blend zone 810 to a fourth ring 811 having a thickness less than that of the third ring 808. A toe end zone 812 blends across an outer blend zone 813 to an outer perimeter 814 having a relatively small thickness.

To the heel side, the thicknesses are offset by set amount (e.g., 0.15 mm) to be slightly thicker relative to their counterpart areas on the toe side. A thickening zone 820 (dashed lines) provides a transition where all thicknesses gradually step up toward the thicker offset zone 822 (dashed lines) at the heel side. In the offset zone 822, the ring 823 is thicker than the ring 806 on the heel side by a set amount (e.g., 0.15 mm), and the ring 825 is thicker that the ring 808 by the same set amount. Blend zones 824 and 826 gradually decrease in thickness moving radially outwardly, and are each thicker than their counterpart blend zones 807 and 810 on the toe side. In the thickening zone 820, the inner ring 804 gradually increases in thickness moving toward the heel.

One example of the face portion 800 can have the following thicknesses: 3.8 mm at the center 802, 4.0 mm at the inner ring 804 and thickening to 4.15 mm across the thickening zone 820, 3.5 mm at the second ring 806 and 3.65 mm at the ring 823, 2.4 mm at the third ring 808 and 2.55 mm at the ring 825, 2.0 mm at the fourth ring 811, and 1.8 mm at the perimeter ring 814.

The targeted offset thickness profile shown in FIG. 25 can help provide a desirable CT profile across the face. Thickening the heel side can help avoid having a CT spike at the heel side of the face, for example, which can help avoid having a non-conforming CT profile across the face. Such an offset thickness profile can similarly be applied to the toe side of the face, or to both the toe side and the heel side of the face to avoid CT spikes at both the heel and toe sides of the face. In other embodiments, an offset thickness profile can be applied to the upper side of the face and/or toward the bottom side of the face.

As shown in FIGS. 2, 4, 8, 9A, and 13, in some examples, the cast cup 104 further includes a slot 171 located in the sole portion 117 of the golf club head 100. The slot 171 is open to an exterior of the golf club head 100 and extends lengthwise from the heel portion 116 to the toe portion 114. More specifically, the slot 171 is elongate in a lengthwise direction substantially parallel to, but offset from, the strike face 145. Generally, the slot 171 is a groove or channel formed in the cast cup 104 at the sole portion 117 of the golf club head 100. In some implementations, the slot 171 is a through-slot, or a slot that is open to the interior cavity 113 from outside of the golf club head 100. However, in other implementations, the slot 171 is not a through-slot, but rather is closed on an interior cavity side or interior side of the slot 171. For example, the slot 171 can be defined by a portion of the side wall of the sole portion 117 of the body 102 that protrudes into the interior cavity 113 and has a concave exterior surface having any of various cross-sectional shapes, such as a substantially U-shape, V-shape, and the like.

In some examples, the slot 171 is offset from the strike face 145 by an offset distance, which is the minimum distance between a first vertical plane passing through a center of the strike face 145 and the slot at the same x-axis coordinate as the center of the strike face 145, between about 5 mm and about 50 mm, such as between about 5 mm and about 35 mm, such as between about 5 mm and about 30 mm, such as between about 5 mm and about 20 mm, or such as between about 5 mm and about 15 mm.

Although not shown, the cast cup 104 and/or the ring 106 may include a rearward slot, with a configuration similar to the slot 171, but oriented in a forward-to-rearward direction, as opposed to a heel-to-toe direction. The cast cup 104 includes a rearward slot, but no slot 171 in some examples, and both a rearward slot and the slot 171 in other examples. In one example, the rearward slot is positioned rearwardly of the slot 171. The rearward slot can act as a weight track in some implementations. Moreover, the rearward track can be offset from the strike face 145 by an offset distance, which is the minimum distance between a first vertical plane passing through the center of the strike face 145 and the rearward track at the same x-axis coordinate as the center of the strike face 145, between about 5 mm and about 50 mm, such as between about 5 mm and about 40 mm, such as between about 5 mm and about 30 mm, or such as between about 10 mm and about 30 mm.

In certain embodiments, the slot 171, as well as the rearward slot if present, has a certain slot width, which is measured as a horizontal distance between a first slot wall and a second slot wall. For the slot 171, as well as the rearward slot, the slot width may be between about 5 mm and about 20 mm, such as between about 10 mm and about 18 mm, or such as between about 12 mm and about 16 mm. According to some embodiments, a depth of the slot 171 (i.e., the vertical distance between a bottom slot wall and an imaginary plane containing the regions of the sole portion 117 adjacent opposing slot walls of the slot 171) may be between about 6 mm and about 20 mm, such as between about 8 mm and about 18 mm, or such as between about 10 mm and about 16 mm.

Additionally, the slot 171, as well as the rearward slot if present, has a certain slot length, which can be measured as the horizontal distance between a slot end wall and another slot end wall. For both the slot 171 and rearward slot, their lengths may be between about 30 mm and about 120 mm, such as between about 50 mm and about 100 mm, or such as between about 60 mm and about 90 mm. Additionally, or alternatively, the length of the slot 171 may be represented as a percentage of a total length of the strike face 145. For example, the slot 171 may be between about 30% and about 100% of the length of the strike face 145, such as between about 50% and about 90%, or such as between about 60% and about 80% mm of the length of the strike face 145.

In some instances, the slot 171 is a feature to improve and/or increase the coefficient of restitution (COR) across the strike face 145. With regards to a COR feature, the slot 171 may take on various forms such as a channel or through slot. The COR of the golf club head 100 is a measurement of the energy loss or retention between the golf club head 100 and a golf ball when the golf ball is struck by the golf club head 100. Desirably, the COR of the golf club head 100 is high to promote the efficient transfer of energy from the golf club head 100 to the ball during impact with the ball. Accordingly, the COR feature of the golf club head 100 promotes an increase in the COR of the golf club head 100. Generally, the slot 171 increases the COR of the golf club head 100 by increasing or enhancing the pelipeter flexibility of the strike face 145. In some examples of the golf club heads disclosed herein, the COR is at least 0.8 for at least 25% of the strike face within the central region, as defined below. According to certain examples, the golf club head of the present disclosure is configured such that the COR, at the geometric center of the strike face, is at least 0.79 or at least 0.81. For example, the golf club head of the present disclosure can have a COR of the strike face, within a surface area of the strike face of at least 200 $mm^2$, of at least 250 $mm^2$, of at least 300 $mm^2$, of at least 350 $mm^2$, or of at least 400 $mm^2$, that is at least 0.79.

Further details concerning the slot 171 as a COR feature of the golf club head 100 can be found in U.S. patent application Ser. Nos. 13/338,197, 13/469,031, 13/828,675, filed Dec. 27, 2011, May 10, 2012, and Mar. 14, 2013, respectively, U.S. patent application Ser. No. 13/839,727, filed Mar. 15, 2013, U.S. Pat. No. 8,235,844, filed Jun. 1, 2010, U.S. Pat. No. 8,241,143, filed Dec. 13, 2011, U.S. Pat. No. 8,241,144, filed Dec. 14, 2011, all of which are incorporated herein by reference.

The slot 171 can be any of various flexible boundary structures (FBS) as described in U.S. Pat. No. 9,044,653, filed Mar. 14, 2013, which is incorporated by reference herein in its entirety. Additionally, or alternatively, the golf club head 100 can include one or more other FBS at any of various other locations on the golf club head 100. The slot 171 may be made up of curved sections, or several segments that may be a combination of curved and straight segments. Furthermore, the slot 171 may be machined or cast into the golf club head 100. Although shown in the sole portion 117 of the golf club head 100, the slot 171 may, alternatively or additionally, be incorporated into the crown portion 119 of the golf club head 100.

In some examples, the slot 171 is filled with a filler material. However, in other examples, the slot 171 is not filled with a filler material, but rather maintains an open, vacant, space within the slot 171. The filler material can be made from a non-metal, such as a thermoplastic material, thermoset material, and the like, in some implementations. The slot 171 may be filled with a material to prevent dirt and other debris from entering the slot and possibly the interior cavity 113 of the golf club head 100 when the slot 171 is a through-slot. The filler material may be any relatively low modulus materials including polyurethane, elastomeric rubber, polymer, various rubbers, foams, and fillers. The filler material should not substantially prevent deformation of the golf club head 100 when in use as this would counteract the flexibility of the golf club head 100.

According to one embodiment, the filler material is initially a viscous material that is injected or otherwise inserted into the slot 171. Examples of materials that may be suitable for use as a filler to be placed into a slot, channel, or other flexible boundary structure include, without limitation: viscoelastic elastomers; vinyl copolymers with or without inorganic fillers; polyvinyl acetate with or without mineral fillers such as barium sulfate; acrylics; polyesters; polyurethanes; polyethers; polyamides; polybutadienes; polystyrenes; polyisoprenes; polyethylenes; polyolefins; styrene/isoprene block copolymers; hydrogenated styrenic thermoplastic elastomers; metallized polyesters; metallized acrylics; epoxies; epoxy and graphite composites; natural and synthetic rubbers; piezoelectric ceramics; thermoset and thermoplastic rubbers; foamed polymers; ionomers; low-density fiber glass; bitumen; silicone; and mixtures thereof. The metallized polyesters and acrylics can comprise aluminum as the metal. Commercially available materials include resilient polymeric materials such as Scotchweld™ (e.g., DP-105™) and Scotchdamp™ from 3M, Sorbothane™ from Sorbothane, Inc., DYAD™ and GP™ from Soundcoat Company Inc., Dynamat™ from Dynamat Control of North America, Inc., NoViFlex™ Sylomer™ from Pole Star Maritime Group, LLC, Isoplast™ from The Dow Chemical Company, Legetolex™ from Piqua Technologies, Inc., and Hybrar™ from the Kuraray Co., Ltd. In some embodiments, a solid filler material may be press-fit or adhesively bonded into a slot, channel, or other flexible boundary structure. In other embodiments, a filler material may poured, injected, or otherwise inserted into a slot or channel and allowed to cure in place, forming a sufficiently hardened or resilient outer surface. In still other embodiments, a filler material may be placed into a slot or channel and sealed in place with a resilient cap or other structure formed of a metal, metal alloy, metallic, composite, hard plastic, resilient elastomeric, or other suitable material.

Referring to FIGS. 4, 8, 9A, and 14, in some examples, the golf club head 100 further includes a weight 173 attached to the cast cup 104. The cast cup 104 includes a threaded port 175 that receives and retains the weight 173. The threaded port 175 is open to an exterior and the interior cavity 113 of the golf club head 100 and includes internal threads in certain examples. In other examples, the threaded port 175 is closed to the interior cavity 113. The weight 173 includes external threads that threadably engage with the internal threads of the threaded port 175 to retain the weight 173 within the threaded port 175. When the threaded port 175 is open to the interior cavity 113, the weight 173 effectually closes the threaded port 175 to prevent access to the interior cavity 113 when threadably attached to the cast cup 104 within the threaded port 175. As shown, when the threaded port 175 is open to the interior cavity 113, a portion of the weight 173 is located external to the interior cavity 113 and another portion is located within the interior cavity 113. In contrast, in other examples, such as when the threaded port 175 is closed to the interior cavity 113, an entirety of the weight 173 is located external to the interior cavity 113. Although not shown, in one example, the threaded port 175 can be open to the interior cavity 113 and closed to an exterior of the golf club head 100 (e.g., the threaded port 175 faces inwardly as opposed to outwardly). In such an example, the entirety of the weight 173 would be located internally within the interior cavity 113. As defined herein, when any portion of the weight 173 is internal relative to or within the interior cavity 113, the weight 173 is considered internal to the interior cavity 113 and when any portion of the weight 173 is external relative to the interior cavity 113, the weight 173 is alternatively, or also, considered external to the interior cavity 113.

In some examples, as shown, the threaded port 175, and thus the weight 173, is located in the sole portion 117 of the golf club head 100. Moreover, according to certain examples, the threaded port 175 and the weight 173 are located closer to the heel portion 116 than the toe portion 114. In one example, the threaded port 175 and the weight are located closer to the heel portion 116 than the slot 171. The weight 173 has a mass between about 3 g and about 23 g (e.g., 6 g) in some examples.

Referring to FIGS. 9A, 11, and 14, the cast cup 104 further comprises a mass pad 186 attached to or co-formed with the rest of the cast cup 104. The mass pad 186 has a thickness greater than any other portion of the cast cup 104. In the illustrated example, the mass pad 186 is located proximate the sole portion 117 of the golf club head 100, and thus a sole region of the cast cup 104. Additionally, in certain examples, a portion of the mass pad 186 is located proximate the heel portion 116 of the golf club head 100, and thus a heel region of the cast cup 104. As defined herein, when located at the sole portion 117 of the golf club head 100, the mass pad 186 is considered a sole mass pad, and when located at the heel portion 116 of the golf club head 100, the mass pad 186 is considered a heel mass pad. It is recognized that when the mass pad 186 is located at both the sole portion 117 and the heel portion 116, the mass pad 186 is considered to be a sole mass pad and a heel mass pad.

Referring to FIGS. 11 and 14, in some examples, the cast cup 104 further includes internal ribs 187 co-formed with other portions of the cast cup 104. The internal ribs 187 can be in any of various locations within the cast cup 104. In the illustrated example, the internal ribs 187 are located (e.g., formed in) a sole region of the cast cup 104 closer to a toe region of the cast cup 104 than a heel region of the cast cup 104. The internal ribs 187 help to stiffen and promote desirable acoustic properties of the golf club head 100.

Referring to FIGS. 11, 14, and 15, the ring 106 includes a cantilevered portion 161, and a toe arm portion 163A and a heel arm portion 163B extending from the cantilevered portion 161. The toe arm portion 163A and the heel arm portion 163B are on opposite sides of the golf club head 100, initiate at the cantilevered portion 161, and terminate at a corresponding one of the toe cup-engagement surface 152A and the heel cup-engagement surface 152B. The cantilevered portion 161 defines at least part of the rearward portion 118 of the golf club head 100 and further defines a rearmost end of the golf club head 100. Moreover, in the illustrated examples, the cantilevered portion 161 extends from the crown portion 119 to the sole portion 117. Accordingly, the cantilevered portion 161 defines part of the sole portion 117 of the golf club head 100 in some examples, such as defining an outwardly-facing surface of the sole portion 117 of the golf club head 100.

In some examples, the cantilevered portion 161 is close to the ground plane 181 when the golf club head 100 is in the address position. According to certain examples, a ratio of the peak crown height to a vertical distance from the peak crown height to a lowest surface of the cantilevered portion 161 of the ring 106 is at least 6.0, at least 5.0, at least 4.0, or more preferably at least 3.0. Alternatively, or additionally, in some examples, a vertical distance from the peak skirt height of the skirt portion to a lowermost surface of the cantilevered portion 161 of the ring 106, when the golf club head 100 is in the address position, is no less than between 20 mm and 30 mm.

The toe arm portion 163A and the heel arm portion 163B define a toe side of the skirt portion 121 and a heel side of the skirt portion 121, respectively, as well as part of the toe portion 114 and heel portion 116, respectively, of the golf club head 100. The cantilevered portion 161 extends downwardly away from the toe arm portion 163A and the heel arm portion 163B, while the toe arm portion 163A and the heel arm portion 163B extend forwardly away from the cantilevered portion 161. Accordingly, the cantilevered portion 161 is closer to the ground plane 181 than the toe arm portion 163A and the heel arm portion 163B when the golf club head 100 is in the address position. In other words, referring to FIGS. 3, 4, and 9A, a height (HR) of the lowest surface of the ring 106 above the ground plane 181, in a vertical direction when the golf club head 100 is in the address position, at any location along the cantilevered portion 161 is less than at any location along the toe arm portion 163A and the heel arm portion 163B.

In some examples, the height HR of the lowest surface of the toe arm portion 163A at the toe portion 114 of the golf club head 100 is different than the height HR of the lowest surface of the heel arm portion 163B at the heel portion 116 of the golf club head 100. More specifically, in one example, the height HR of the lowest surface of the toe arm portion 163A at the toe portion 114 of the golf club head 100 is greater than the height HR of the lowest surface of the heel arm portion 163B at the heel portion 116 of the golf club head 100.

According to certain examples, as shown in FIGS. 3, 4, and 9A, a width (WR) of the of the ring 106, as measured in a vertical direction when the golf club head 100 is in the address position, varies in a forward-to-rearward direction (e.g., along a length of the ring 106). In one example, the width WR increases from a minimum width to a maximum width in the forward-to-rearward direction. In other words, the width WR of the ring 106 varies in the forward-to-rearward direction in certain examples. In some examples, the maximum width WR of the ring 106 is at the rearmost end of the golf club head 100. In one example, the maximum width WR of the ring 106 is as least 20 mm. According to certain examples, as shown in FIG. 14, the width WR of the ring 106 at the toe portion 114 is less than the width WR of the ring 106 at the heel portion 116. According to some additional examples, a thickness of the ring 106 can vary along the ring 106 in a forward-to-rearward direction.

Referring to FIGS. 2-4, 6, 8, 9A, and 11-15, in some examples, the golf club head 100 further includes a mass element 159 attached to the cantilevered portion 161 of the ring 106, such as at a rearmost end of the golf club head 100. The mass element 159 can be selectively removable from (e.g., interchangeable with differently weighted mass elements) or permanently attached to the cantilevered portion 161. According to one example, the mass element 159 and the weight 173 are interchangeably coupleable to the cast cup 104 and the cantilevered portion 161 of the ring 106. Accordingly, in some examples, the flight control technology component of the golf club head 100, the mass element 159, and the weight 173 are adjustable relative to the golf club head 100. In certain examples, the flight control technology component of the golf club head 100, the mass element 159, and the weight 173 are configured to be adjustable via a single or the same tool.

In one example, the mass element 159 includes external threads. The golf club head 100 can additionally include a mass receptacle 157 attached to the cantilevered portion 161 of the ring 106. The mass receptacle 157 can include a threaded aperture, with internal threads, that threadably engages the mass element 159 to secure the mass element 159 to the cantilevered portion 161. The mass receptacle 157 is welded to the cantilevered portion 161 in some examples and adhered to the cantilevered portion 161 in other examples. In certain examples, the mass receptacle 157 is co-formed with the cantilevered portion 161. The cantilevered portion 161 also includes a mass pad 155 (see, e.g., FIGS. 9A, 12, and 15) or a portion of the cantilevered portion 161 with a localized increase in thickness and thus mass. The mass receptacle 157 can be formed in the mass pad 155 of the cantilevered portion 161. The mass element 159 has a mass between about 15 g and about 35 g (e.g., 24 g) in some examples.

Figure 16:
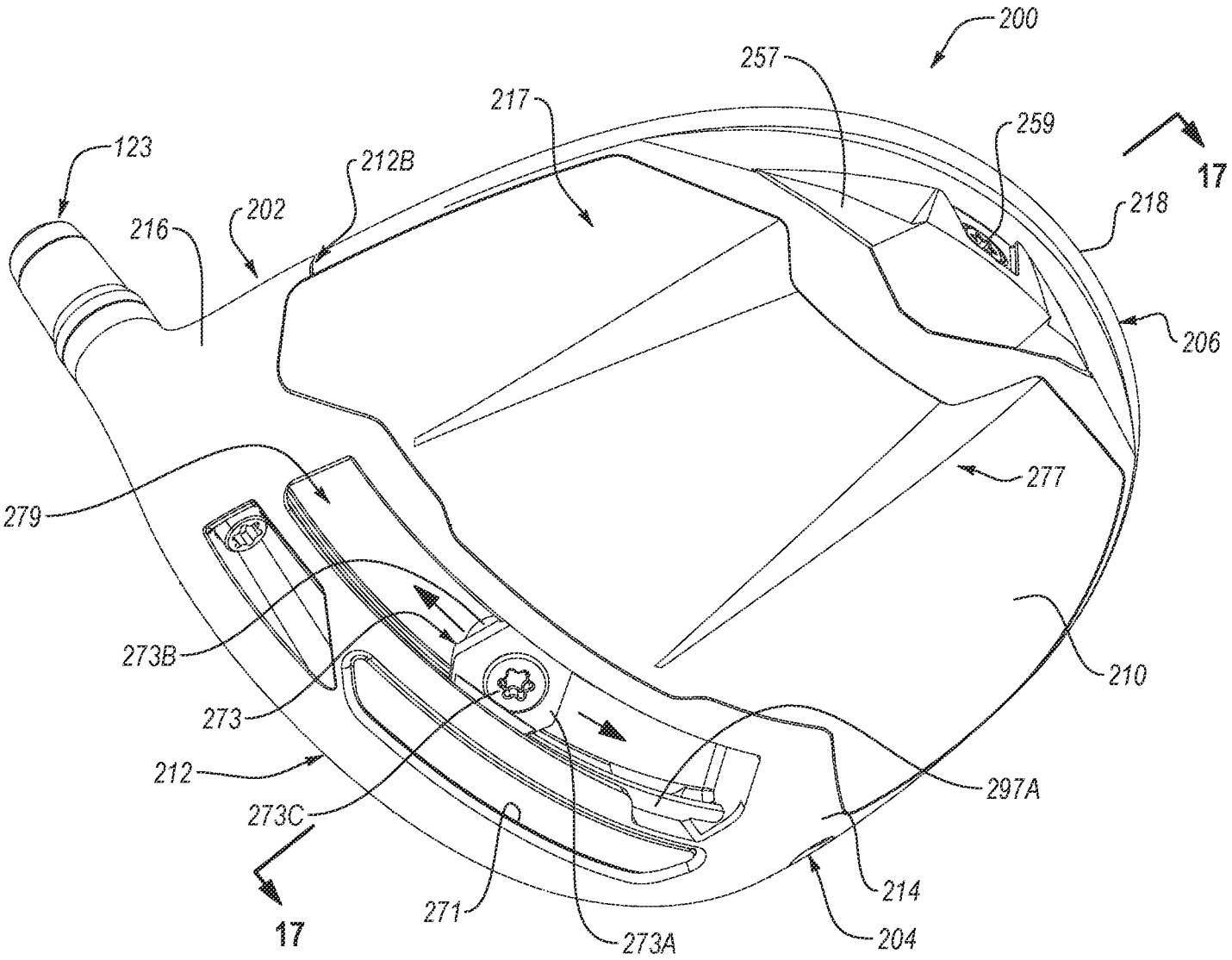
FIG. 16 is a schematic, perspective view of another golf club head, according to one or more examples of the present disclosure.

The outer peripheral shape of one or both of the mass element 159 and the weight 173 in the illustrated examples is circular. Accordingly, an orientation of one or both of the mass element 159 and the weight 173 is rotatable about a central axis of the mass element 159 and the weight 173, respectively, in any of various orientations between 0-degrees and 360-degrees. However, in other examples, the outer peripheral shape of at least one or both of the mass element 159 and the weight 173 is non-circular, such as ovular, triangular, trapezoidal, square, and the like. For example, as shown in FIG. 16, the weight 273 has an outer peripheral shape that is trapezoidal or rectangular. In certain examples, the mass element 159 and/or the weight 173, having a non-circular outer peripheral shape, is rotatable about the central axis of the mass element 159 and the weight 173, respectively, in any of various orientations between 0-degrees and at least 90-degrees in certain implementations and 0-degrees and at least 180-degrees in other implementations.

The construction and material diversity of the golf club head 100 enables flexibility of the position of the weight 173 (e.g., first weight or forward weight) relative to the position of the mass element 159 (e.g., second weight or rearward weight). In some examples, the relative positions of the weight 173 and the mass element 159 can be similar to those disclosed in U.S. patent application Ser. No. 16/752,397, filed Jan. 24, 2020. Referring to FIG. 9A, according to one example, a z-axis coordinate of the CG of the first weight (FWCG), on the z-axis of the head origin coordinate system 185, is between −30 mm and −10 mm (e.g., −21 mm), a y-axis coordinate of the CG of the first weight (FWCG), on the y-axis of the head origin coordinate system 185 is between 10 mm and 30 mm (e.g., 23 mm), and an x-axis coordinate of the CG of the first weight (FWCG), on the x-axis of the head origin coordinate system 185 is between 15 mm and 35 mm (e.g., 22 mm). According to the same, or a different, example, a z-axis coordinate of the CG of the second weight (SWCG), on the z-axis of the head origin coordinate system 185, is between −30 mm and 10 mm (e.g., −11 mm), a y-axis coordinate of the CG of the second weight (SWCG), on the y-axis of the head origin coordinate system 185 is between 90 mm and 120 mm (e.g., 110 mm), and an x-axis coordinate of the CG of the second weight (SWCG), on the x-axis of the head origin coordinate system 185 is between −20 mm and 10 mm (e.g., −7 mm).

In certain examples, the sole portion 117 of the golf club head 100 includes an inertia generating feature 177 that is elongated in a lengthwise direction. The lengthwise direction is perpendicular or oblique to the strike face 145. According to some examples, the inertia generating feature 177 includes the same features and provides the same advantages as the inertia generator disclosed in U.S. patent application Ser. No. 16/660,561, filed Oct. 22, 2019, which is incorporated herein by reference in its entirety. In the illustrated examples, the sole insert 110 forms at least a portion of the inertia generating feature 177. More specifically, in some examples, the sole insert 110 forms all or a majority of the inertia generating feature 177. The cantilevered portion 161 of the ring 106 also forms part, such as a rearmost part, of the inertia generating feature 177 in certain examples. The inertia generating feature 177 helps to increase the inertia of the golf club head 100 and lower the center-of-gravity (CG) of the golf club head 100.

The inertia generating feature 177 includes a raised or elevate platform that extends from a location rearwardly of the hosel 120 to a location proximate the rearward portion 118 of the golf club head 100. The inertia generating feature 177 includes a substantially flat or planar surface that is raised above (or protrudes from, depending on the orientation of the golf club head 100) the surrounding external surface of the sole portion 117. In certain examples, at least a portion of the inertia generating feature 177 is raised above the surrounding external surface of the sole portion 117 by at least 1.5 mm, at least 1.8 mm, at least 2.1 mm, or at least 3.0 mm. The inertia generating feature 177 also has a width that is less than an entire width (e.g., less than half the entire width) of the sole portion 117. In view of the foregoing, the inertia generating feature 177 has a complex curved geometry with multiple inflection points. Accordingly, the sole insert 110, which defines the inertia generating feature 177, has a complex curved surface that has multiple inflection points.

Referring to FIGS. 1-3 and 5, in some examples, the golf club head 100 includes a through-aperture 172 in the body 102 at the toe portion 114. The through-aperture 172 extends entirely through the wall of the body 102 such that the interior cavity 113 is accessible through the aperture 172. The aperture 172 can be used to insert a stiffener into the interior cavity 113 against an interior surface of the forward portion 112 to help set the CT of the strike face 145. Further details of the stiffener, the insertion process, and the effect of the stiffener on the CT of the strike face 145 can be found in U.S. Patent Application Publication No. 2019/0201754, published Jul. 4, 2019, which is incorporated herein by reference in its entirety. As shown, the through-aperture 172 is not located in the forward portion 112 (e.g., the strike face 145). Accordingly, in some examples, the strike face 145 is void of through-apertures open to the interior cavity 113 or the hollow interior region of the golf club head 100. Moreover, in some examples, no material having a shore D value greater than 10, greater than 5, or greater than 1 contacts an interior surface of the forward portion 112, opposite the strike face 145 and open to the hollow interior region, at a location toeward and/or heelward of the geometric center of the strike face 145. In yet other examples, no material, regardless of hardness, contacts an interior surface of the forward portion 112, opposite the strike face 145 and open to the hollow interior region.

The CT properties of the golf club heads disclosed herein can be defined as CT values within a central region of the strike face 145. The central region, is forty millimeter by twenty millimeter rectangular area centered on a center of the strike face and elongated in a heel-to-toe direction. The center of the strike face 145 can be a geometric center of the strike face 145 in some examples. Within the central region, the strike face 145 has a characteristic time (CT) of no more than 257 microseconds. In some examples, the CT of at least 60% of the strike face, within the central region, is at least 235 microseconds. According to some examples, the CT of at least 35% of the strike face, within the central region, is at least 240 microseconds.

The CT of the strike face 145, at the geometric center of the strike face, has an initial CT value. The initial CT value is the CT value of the strike face 145 before any impacts with a standard golf ball. As defined herein, an impact with the standard golf ball is an impact of the standard golf ball when the golf ball is traveling at a velocity of 52 meters per second. According to some examples, the initial CT value is at least 244 microseconds. In certain examples, the driver-type golf club heads disclosed herein, including the golf club head 100, are configured such that after 500 impacts of a standard golf ball at the geometric center of the strike face 145, the CT of the strike face at any point within the central region is less than 256 microseconds and the CT at the geometric center of the strike face is no more than five microseconds different than (e.g., greater than) the initial CT value.

In certain examples, the driver-type golf club heads disclosed herein, including the golf club head 100, are configured such that after 1,000, 1,500, 2,000, 2,500, or 3,000 impacts of the standard golf ball at the geometric center of the strike face, the CT of the strike face at any point within the central region is less than 256 microseconds. According to some examples, after 2,000 impacts of the standard golf ball at the geometric center of the strike face, the CT of the strike face 145 at any point within the central region is no more than seven microseconds or nine microseconds different that the initial CT value. Moreover, in certain examples, after 2,000 impacts of the standard golf ball at the geometric center of the strike face, the CT of the strike face 145 at the geometric center of the strike face is no less than 249 microseconds and no more than ten microseconds different than the initial CT value. According to some examples, after 3,000 impacts of the standard golf ball at the geometric center of the strike face, the CT of the strike face 145 at any point within the central region is no more than nine microseconds or thirteen microseconds different that the initial CT value. In certain examples, such as those where the strike face 145 is made of a metallic material, an inward face progression of the strike face 145 is less than 0.01 inches after 500 impacts of the standard golf ball at the geometric center of the strike face.

According to various examples, the initial CT value is at least 237 microseconds, 239 microseconds, or 242 microseconds. In certain examples, the driver-type golf club heads disclosed herein, including the golf club head 100, are configured such that after 500 impacts of a standard golf ball at the geometric center of the strike face 145, the CT of the strike face at any point within the central region is less than 251 microseconds, in one example, and less than, or no more than, 245 microseconds, in another example, and the CT at the geometric center of the strike face is no more than five microseconds, in some examples, or three microseconds, in other examples, different than (e.g., greater than) the initial CT value, which can be at least 245 microseconds in some examples and no more than 245 microseconds in other examples. In certain examples, the driver-type golf club head is configured such that after 500 impacts of a standard golf ball at the geometric center of the strike face, where at each impact the standard golf ball has a velocity of 52 meters per second, the CT of the strike face at the geometric center of the strike face is no more than 245 microseconds.

In certain examples, the driver-type golf club heads disclosed herein, including the golf club head 100, are configured such that after 1,000, 1,500, 2,000, 2,500, or 3,000 impacts of the standard golf ball at the geometric center of the strike face, the CT of the strike face, at the geometric center of the strike face, is no more than five microseconds, in some examples, and three microseconds, in other examples, different that the initial CT value at the geometric center. Moreover, in these and other examples, the driver-type golf club heads disclosed herein, including the golf club head 100, are configured such that after 500, 1,000, 1,500, 2,000, 2,500, or 3,000 impacts of the standard golf ball at the geometric center of the strike face, the CT of the strike face, at any point within the central region, is no more than between 3 microseconds and 5 microseconds more than the initial CT value or is no more than between 1% and 2% greater than the initial CT value.

As defined herein, a standard golf ball is a golf ball that has a pole size (i.e., a diameter that includes the poles of the golf ball) and an equator size (i.e., diameter about the equator of the golf ball) of 1.684 inches (±0.004 inches), a weight of 45.6 grams (±0.30 grams, in one example, and ±1.0 gram, in another example), a cover having a Shore D hardness of 65 (±4, in one example, and ±10, in another example), and a PGA standard ball compression rating of between 95 and 97 (±5, in one example, and ±10, in another example).

Referring to Table 1A below, examples of the driver-type golf club heads disclosed herein can have various initial CT values at the geometric center of the strike face (i.e., "CF") and at other locations on the strike face relative to the geometric center of the strike face.

TABLE 1A

| | Characteristic Time (CT) (microseconds) | | |
|---|---|---|---|
| Strike Face Location | Example 1 | Example 2 | Example 3 |
| CF | 248 | 242 | 245 |
| 5 mm Toeward | 250 | 242 | 247 |
| 10 mm Toeward | 250 | 241 | 246 |
| 10 mm Toeward/5 mm Upward | 251 | 243 | 246 |
| 15 mm Toe/5 mm Upward | 246 | 240 | 244 |

The driver-type golf club heads of Examples 1-3 of Table 1A include a strike plate made of a fiber-reinforced polymer with a variable thickness. According to Examples 1 and 2 of Table 1A, the fiber-reinforced polymer of the strike plate has a maximum thickness of 4.25 mm (+/−0.1 mm) and a minimum thickness of 3.8 mm (+/−0.1 mm), which does not include a cover (see, e.g., cover 349) applied onto the fiber-reinforced polymer. According to Example 3 of Table 1A, the fiber-reinforced polymer of the strike plate has a maximum thickness of at least 4.5 mm (+/−0.1 mm) and a minimum thickness of at most 3.9 mm (+/−0.1 mm), which does not include a cover (see, e.g., cover 349) applied onto the fiber-reinforced polymer. However, in other examples, the fiber-reinforced polymer of the strike plate has a maximum thickness greater than 4.5 mm, such as at least 4.7 in an example, at least 4.8 mm, in one example, at least 5.0 mm, in another example, and at least 5.2 mm, in yet a further example. According to some examples, a minimum thickness of the strike plate, such as at a peripheral edge of the strike plate, is at most 3.75 mm. Such thickness ranges can help reduce CT creep for strike plates made of fiber-reinforced polymers. The cover can have a thickness of between 0.4 mm and 0.45 mm (+/−0.1 mm).

Figure 17:
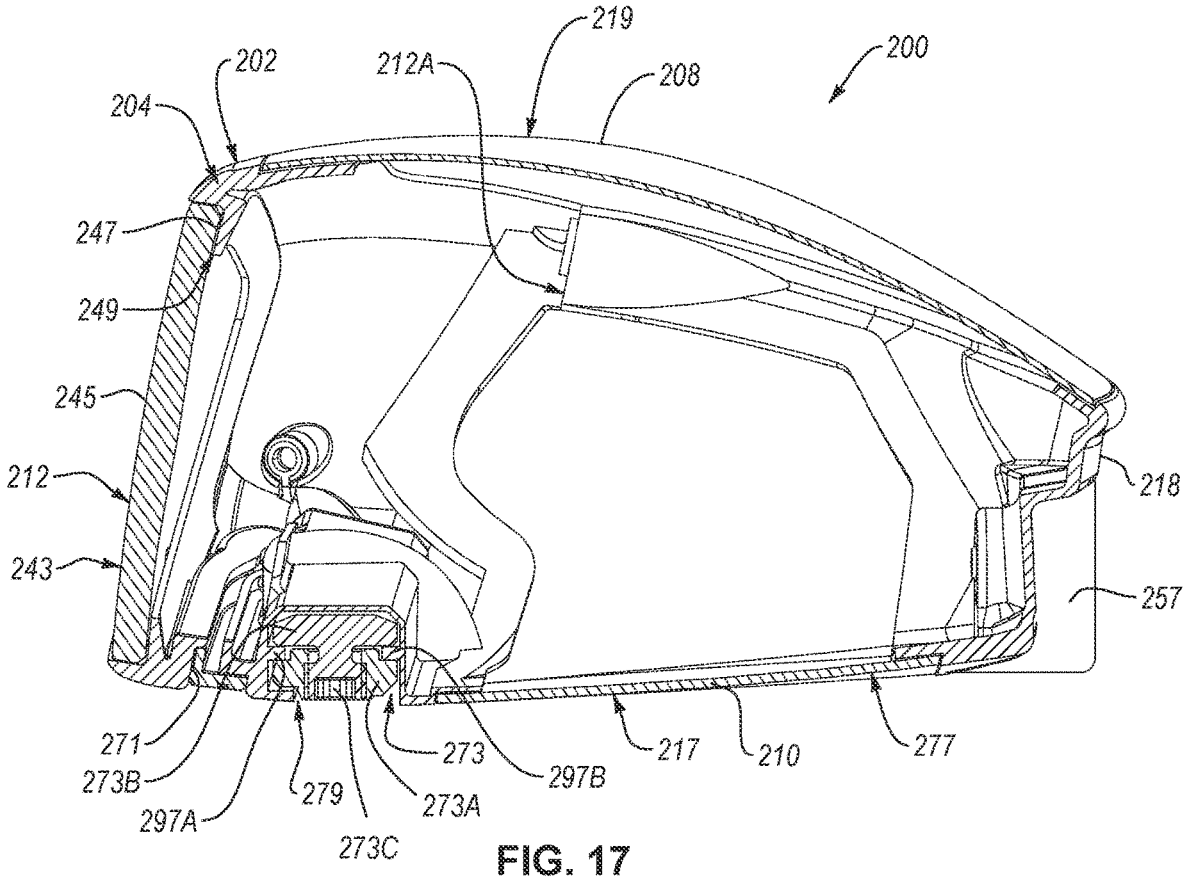
FIG. 17 is a schematic, cross-sectional, side elevation view of the golf club head of FIG. 16, taken along the line 16-16 of FIG. 16, according to one or more examples of the present disclosure.

Referring to FIGS. 16 and 17, and according to another example of a golf club head disclosed herein, a golf club head 200 is shown. The golf club head 200 includes features similar to the features of the golf club head 100, with like numbers (e.g., same numbers but in 200-series) referring to like features. For example, like the golf club head 100, the golf club head 200 includes a toe portion 214 and a heel portion 216, opposite the toe portion 214. Additionally, the golf club head 200 includes a forward portion 212 and a rearward portion 218, opposite the forward portion 212. The golf club head 200 additionally includes a sole portion 217 (including an inertia generating feature 277), at a bottom region of the golf club head 200, and a crown portion 219, opposite the sole portion 217 and at a top region of the golf club head 200. Also, the golf club head 200 includes a skirt portion 221 that defines a transition region where the golf club head 200 transitions between the crown portion 219 and the sole portion 217. The golf club head 200 further includes an interior cavity 213 that is collectively defined and enclosed by the forward portion 212, the rearward portion 218, the crown portion 219, the sole portion 217, the heel portion 216, the toe portion 214, and the skirt portion 221. Additionally, the forward portion 212 includes a strike face 245 that extends along the forward portion 212 from the sole portion 217 to the crown portion 219, and from the toe portion 214 to the heel portion 216. Additionally, the golf club head 200 further includes a body 202, a crown insert 208 attached to the body 202 at a top of the golf club head 200, and a sole insert 210 attached to the body 202 at a bottom of the golf club head 200. The body 202 includes a cast cup 204 and a ring 206. The ring 206 is joined to the cast cup 204 at a toe-side joint 212A and a heel-side joint 212B. The cast cup 204 of the body 202 also includes a slot 271 in the sole portion 217 of the golf club head 200. Further, the golf club head 200 additionally includes a mass element 259 and a mass receptacle 257 attached to the ring 206 of the body 202, as well as a weight 273 attached to the cast cup 204. Accordingly, in view of the foregoing, the golf club head 200 shares some similarities with the golf club head 100.

Additionally, unlike the golf club head 100, the cast cup 204 includes a weight track 279 in the sole portion 217 of the golf club head 200. The weight track 279 extends lengthwise in a heel-to-toe direction along the sole portion 217. In examples where the cast cup 204 also includes the slot 271, such as shown, the weight track 279 is substantially parallel to the slot 271 and offset from the slot 271 in a front-to-rear direction. The weight track 279 includes at least one ledge that extends lengthwise along the length of the weight track 279. In the illustrated example, the weight track 279 includes a forward ledge 297A and a rearward ledge 297B, which are spaced apart from each other in the front-to-rear direction. The weight 273, which positioned within the weight track 279, is selectively clampable to the ledge or ledges of the weight track 279 to releasably fix the weight 273 to the weight track 279. In the illustrated example, the weight 273 is selectively clampable to both the forward ledge 297A and the rearward ledge 297B. When unclamped to the one or more ledges of the weight track 279, the weight 273 is slidable along the one or more ledges, as shown by directional arrows in FIG. 16, to change a position of the weight 273 relative to the weight track 279 and, when re-clamped to the one or more ledges, adjust the mass distribution, center-of-gravity (CG), and other performance characteristics of the golf club head 200.

According to one example, the weight 273 includes a washer 273A, a nut 273B, and a fastening bolt 273C that interconnects with the washer 273A and the nut 273B to clamp down on the ledges 297A, 297B of the weight track 279. The washer 273A has a non-threaded aperture and the nut 273B has a threaded aperture. The fastening bolt 273C is threaded and passes through the non-threaded aperture of the washer 273A to threadably engage the threaded aperture of the nut 273B. Threadable engagement between the fastening bolt 273C and the nut 273B allows a gap between the washer 273A and the nut 273B to be narrowed, which facilitates the clamping of the ledge or ledges between the washer 273A and the nut 273B, or widened, which facilitates the un-clamping of the ledge or ledges from between the washer 273A and the nut 273B. The fastening bolt 273C can be rotatable relative to both the washer 273A and the nut 273B or form a one-piece monolithic construction and be co-rotatable with one of the washer 273A and the nut 273B.

To reduce the weight of the golf club head 200 and the depth of the weight track 279, the fastening bolt 273C is short. For example, the length of the fastening bolt 273C, when the weight 273 is clamped on the ledges 297A, 297B, extends no more than 3 mm past the nut 273B (or the washer 273A if the position of the nut 273B and the washer 273A are reversed). In some examples, the entire length of the fastening bolt 273C is no more than 15% greater than the combined thicknesses of the washer 273A, the nut 273B, and one of the ledges 297A, 297B.

As shown, an outer peripheral shape of the washer 273A is non-circular, such as trapezoidal or rectangular. Similarly, the outer peripheral shape of the nut 273B can be non-circular, such as trapezoidal or rectangular. Alternatively, as shown, the outer peripheral shape of the nut 273B is circular and the outer peripheral shape of the washer 273A is non-circular.

Figure 18:
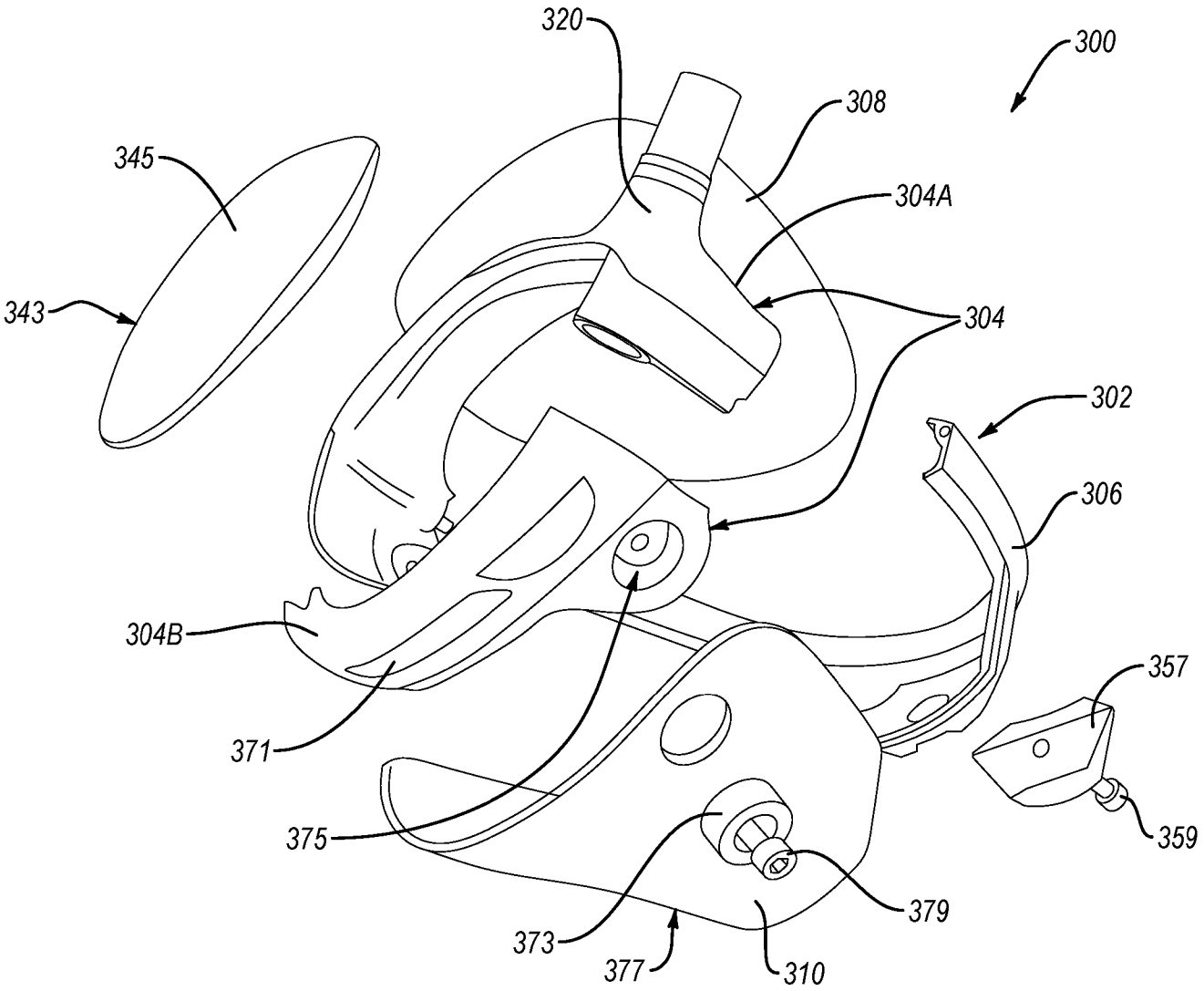
FIG. 18 is a schematic, exploded, perspective view of another golf club head, according to one or more examples of the present disclosure.

Referring to FIG. 18, and according to another example of a golf club head disclosed herein, a golf club head 300 is shown. The golf club head 300 includes features similar to the features of the golf club head 100 and the golf club head 200, with like numbers (e.g., same numbers but in 300-series) referring to like features. For example, like the golf club head 100 and the golf club head 200, the golf club head 300 includes a body 302, a crown insert 308 attached to the body 302 at a top of the golf club head 300, and a sole insert 310 attached to the body 302 at a bottom of the golf club head 300, and an inertia generating feature 377. The body 302 includes a cast cup 304 and a ring 306. The ring 306 is joined to the cast cup 304 at a toe-side joint and a heel-side joint. The cast cup 304 of the body 302 also includes a slot 371 in the sole portion of the golf club head 300. Further, the golf club head 300 additionally includes a mass element 359 and a mass receptacle 357 attached to the ring 306 of the body 302, as well as a weight 373 attached to the cast cup 304 via a fastener 379. Additionally, like the golf club head 200, the golf club head 300 includes a strike plate 343, defining a strike face 345, that is formed separate from and attached to the cast cup 304. Accordingly, in view of the foregoing, the golf club head 300 shares some similarities with the golf club head 100 and the golf club head 200.

Unlike the illustrated examples of the cast cup 104 of the golf club head 100 and the cast cup 204 of the golf club head 200, however, the cast cup 304 has a multi-piece construction. More specifically, the cast cup 304 includes an upper cup piece 304A and a lower cup piece 304B. The upper cup piece 304A is formed separately from the lower cup piece 304B. Accordingly, the upper cup piece 304A and the lower cup piece 304B are joined or attached together to form the cast cup 304. Because the upper cup piece 304A and the lower cup piece 304B are formed separately, the upper cup piece 304A can be made of a material that is different than that of the lower cup piece 304B. The cast cup 304 includes a hosel 320 where a portion of the hosel 320 is formed into the upper cup piece 304A and another portion of the hosel 320 is formed into the lower cup piece 304B.

According to some examples, the upper cup piece 304A is made of a material that is different than that of the lower cup piece 304B. For example, the upper cup piece 304A can be made of a material with a density that is lower than the material of the lower cup piece 304B. In one example, the upper cup piece 304A is made of a titanium alloy and the lower cup piece 304B is made of a steel alloy. According to another example, the upper cup piece 304A is made of an aluminum alloy and the lower cup piece 304B is made of a steel alloy or a tungsten alloy, such as 10-17 density tungsten. Such configurations help to increase the mass of the cast cup 304 and lower the center-of-gravity (CG) of the cast cup 304 and the golf club head 300 compared to the single-piece cast cup 104 of the golf club head 100. In alternative configurations, according to some examples, the upper cup piece 304A is made of an aluminum alloy and the lower cup piece 304B is made of a titanium alloy. These later configurations help to lower the overall mass of the cast cup 304. According to some examples, the upper cup piece 304A and the lower cup piece 304B are made using different manufacturing techniques. For example, the upper cup piece 304A can be made by stamping, forging, and/or metal-injection-molding (MIM) and the lower cup piece 304B can be made by another one or a different combination of stamping, forging, and/or metal-injection-molding (MIM).

Various examples of combinations of materials and mass properties for the upper cup piece 304A and the lower cup piece 304B are shown in Table 2 below.

TABLE 2

| | Material | | Density (g/cc) | | Mass (g) | | CG (z-axis) (mm) | | Mass (g) | Delta-CG | Delta-CG |
|---|---|---|---|---|---|---|---|---|---|---|---|
| Example | Upper | Lower | Upper | Lower | Upper | Lower | Upper | Lower | Combined | Combined | Total Head |
| 1 | Ti-64 | Ti-64 | 4.4 | 4.4 | 37.5 | 37.5 | 15 | −15 | 75 | 0 | 0 |
| 2 | Ti-64 | Steel | 4.4 | 7.8 | 37.5 | 66.5 | 15 | −15 | 104.0 | −4.2 | −2.2 |
| 3 | Al-7075 | Steel | 2.8 | 7.8 | 23.9 | 66.5 | 15 | −15 | 90.3 | −7.1 | −3.2 |
| 4 | Al-7075 | W-10 | 2.8 | 10 | 23.9 | 85.2 | 15 | −15 | 109.1 | −8.4 | −4.6 |
| 5 | Al-7075 | Ti-64 | 2.8 | 4.4 | 23.9 | 37.5 | 15 | −15 | 61.4 | −3.3 | −1.0 |
| 6 | Al-7075 | Al-7075 | 2.8 | 2.8 | 23.9 | 23.9 | 15 | −15 | 47.7 | 0.0 | 0.0 |

As previously presented, in some examples, the strike plate 343, and other strike plates disclosed herein, are made of a fiber-reinforced polymer. Because a fiber-reinforced polymer has less mass, per unit volume, than a titanium alloy or a steel alloy, the golf club head 300 has less mass at the forward portion of the golf club head 300 than if the strike plate 343 were made of a titanium alloy or a steel alloy. The lower mass at the forward portion of the golf club head 300 promotes an increase in discretionary mass that can be strategically placed throughout the golf club head 300 to improve the performance of the golf club head 300. However, because less mass is located at the forward portion of the golf club head 300, at a location away from the center of gravity of the golf club head 300, and the inertia of the golf club head 300 is dependent on the distance of the mass of the golf club head 300 away from the center of gravity, the strike plate 343 made of a fiber-reinforced polymer causes a reduction in the inertia of the golf club head 300. As is well documented, the higher the inertia of a golf club head, the higher the forgiveness of the golf club head.

Accordingly, to counter the drop in inertia, caused by the strike plate 343 being made of a fiber-reinforced polymer, the lower cup piece 304B is made of a material with a relatively high density, such as steel, to promote a concentration of mass away from the center of gravity and thus promote an increase in the inertia of the golf club head 300. More specifically, the lower cup piece 304B, being located in a forward portion of the golf club head 300 and being made of a high-density material, counteracts the drop in mass of the strike plate 343 being made of a low-density material. Additionally, because the upper cup piece 304A is made of a material with a lower density than the lower cup piece 304B, the mass at the forward portion is more concentrated at a location low on the golf club head 300 (e.g., below the center of gravity), which promotes a desirable center of gravity projection value. In view of the foregoing, the use of a two-piece cast cup 304 that has a high-density lower cup piece 304B and a low-density upper cup piece 304A helps promote a higher inertia and lower center of gravity projection when the strike plate 343 is made of a fiber-reinforced polymer.

As shown, the cast cup 304 includes a port 375 that receives and retains the weight 373. The port 375 is configured to retain the weight 373 in a fixed location on the sole portion of the golf club head 300. However, in other examples, the port 375 can be replaced with a weight track, similar to the weight track 279 of the golf club head 200, such that the weight 373 can be selectively adjustable and moved into any of various positions along the weight track. In this manner, a weight track, and a corresponding ledge or ledges of the weight track, can form part of one piece of a multi-piece cast cup.

Although the cast cup 304 is shown to have a two-piece construction, in other examples, the cast cup 304 has a three-piece construction or constructed with more than three pieces. According to one instance, the cast cup 304 has a crown-toe piece, a crown-heel piece, and a sole piece. The crown-toe piece and the crown-heel piece are made of titanium alloys and the sole piece is made of a steel alloy in certain implementations. The titanium alloy of the crown-toe piece can be the same as or different than the titanium alloy of the crown-heel piece.

Figure 19:
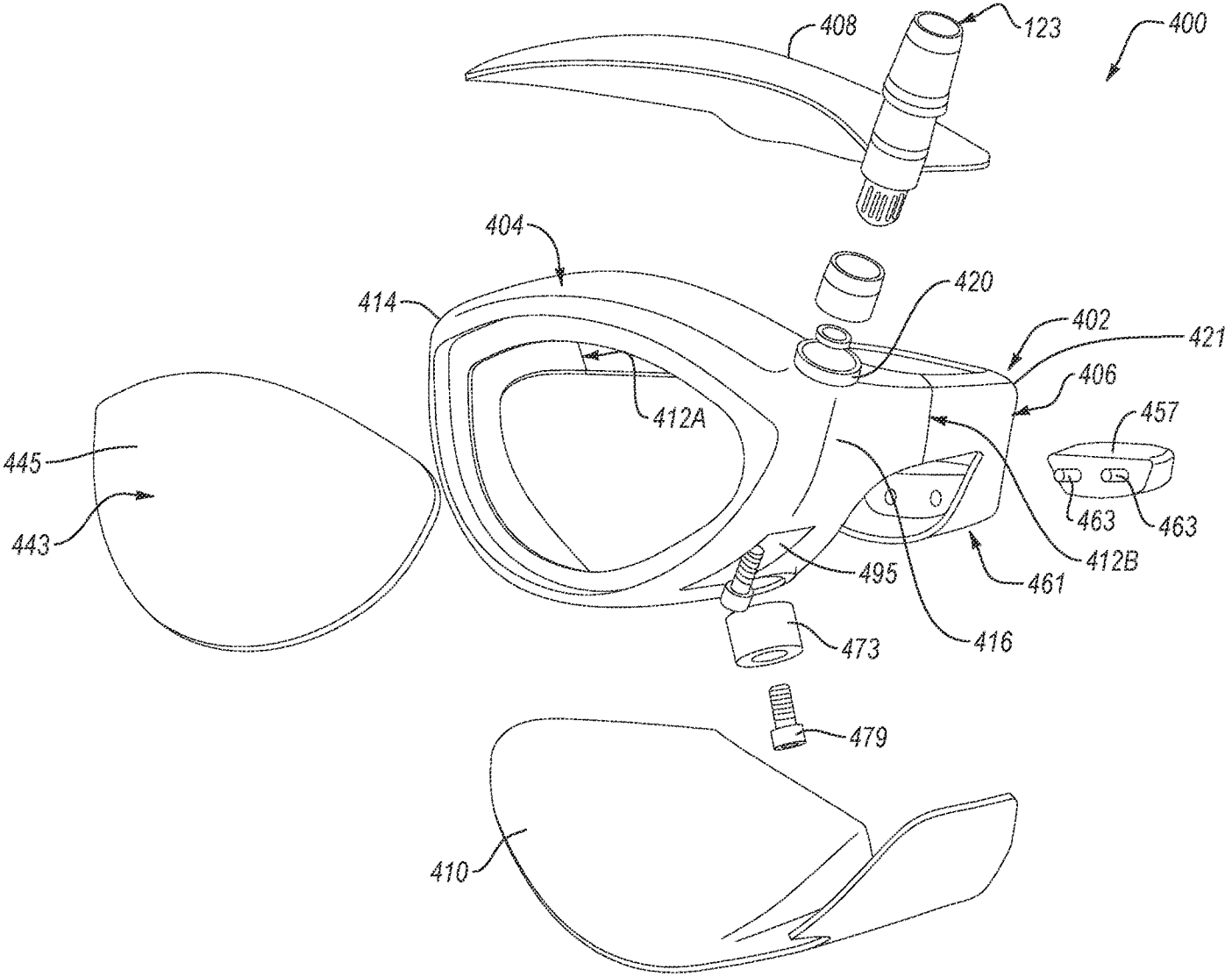
FIG. 19 is a schematic, exploded, perspective view of yet another golf club head, according to one or more examples of the present disclosure.
Figure 20:
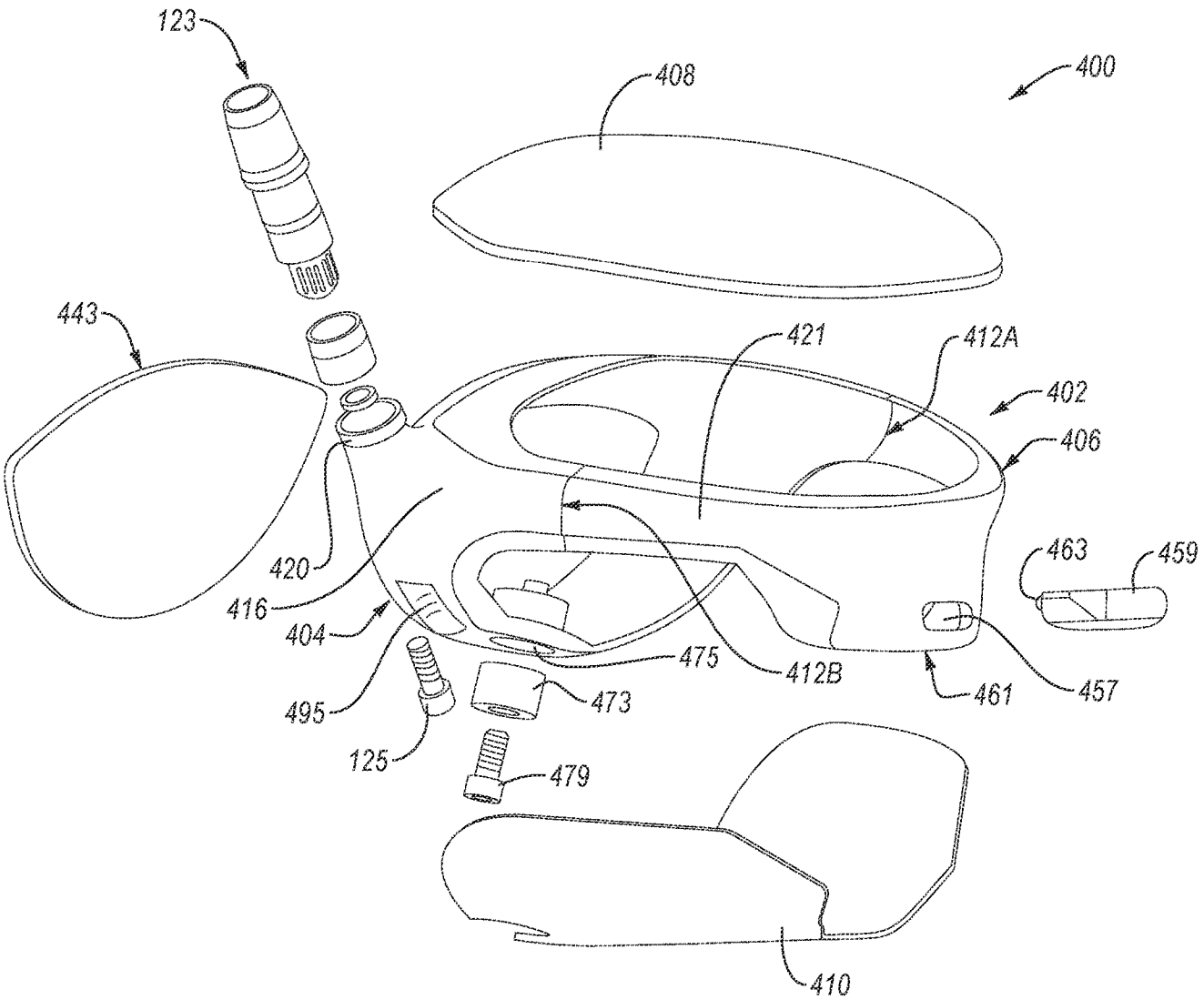
FIG. 20 is a schematic, exploded, perspective view of the golf club head of FIG. 19, according to one or more examples of the present disclosure.

Referring to FIGS. 19 and 20, and according to another example of a golf club head disclosed herein, a golf club head 400 is shown. The golf club head 400 includes features similar to the features of the golf club head 100, the golf club head 200, and the golf club head 300, with like numbers (e.g., same numbers but in 400-series) referring to like features. For example, like the golf club head 100, the golf club head 200, and the golf club head 300, the golf club head 400 includes a body 402, a crown insert 408 attached to the body 402 at a top of the golf club head 400, and a sole insert 410 attached to the body 402 at a bottom of the golf club head 400. The body 402 includes a cast cup 404 and a ring 406. The ring 406 is joined to the cast cup 404 at a toe-side joint 412A and a heel-side joint 412B. Additionally, like the golf club head 200 and the golf club head 300, the golf club head 400 includes a strike plate 443, defining a strike face 445, that is formed separate from and attached to the cast cup 404. Accordingly, in view of the foregoing, the golf club head 400 shares some similarities with the golf club head 100, the golf club head 200, and the golf club head 300.

Furthermore, the golf club head 400 additionally includes a weight 473 attached to the cast cup 404 via a fastener 479. As shown, the cast cup 404 includes a port 475 that receives and retains the weight 473. The port 475 is configured to retain the weight 473 in a fixed location on the sole portion of the golf club head 400. However, in other examples, the port 475 can be replaced with a weight track, similar to the weight track 279 of the golf club head 200, such that the weight 473 can be selectively adjustable and moved into any of various positions along the weight track. In this manner, a weight track, and a corresponding ledge or ledges of the weight track, can form part of the cast cup 404.

Also, like the golf club head 100, the golf club head 200, and the golf club head 300, the golf club head 400 additionally includes a mass element 459 and a mass receptacle 457. However, unlike some examples, of the receptacles of the previously discussed golf club heads, the mass receptacle 457 of the golf club head 400 forms a one-piece monolithic construction with a cantilevered portion 461 of the ring 406. Accordingly, in certain examples, the mass receptacle 457 is co-cast with the ring 406. The mass receptacle 457 includes an opening or recess that is configured to nestably receive the mass element 459. The mass element 459 can be made of a material, such as tungsten, that is different (e.g., denser) than the material of the ring 406. The mass element 459 is bonded, such as via an adhesive, to the ring 406 to secure the mass element 459 within the mass receptacle 457. In some examples, the mass element 459 includes prongs 463 that engage corresponding apertures in the mass receptacle 457 when bonded to the ring 406. Engagement between the prongs 463 and the corresponding apertures of the mass receptacle 457 help to strengthen and stiffen the coupling between the mass element 459 and the ring 406.

Referring to FIG. 21, the ring 406 includes a toe arm portion 463A that defines a toe side of a skirt portion 421 of the golf club head 400 and a heel arm portion 463B that defines a heel side of the skirt portion 421. Moreover, the toe arm portion 463A and the heel arm portion 463B define part of a toe portion 414 and a heel portion 416, respectively, of the golf club head 400 (see, e.g., FIGS. 19 and 20). The cantilevered portion 461 extends downwardly away from the toe arm portion 463A and the heel arm portion 463B, while the toe arm portion 463A and the heel arm portion 463B extend forwardly away from the cantilevered portion 461. Accordingly, the cantilevered portion 461 is closer to the ground plane 181 than the toe arm portion 463A and the heel arm portion 463B when the golf club head 400 is in the address position. In FIG. 21, the ring 406 is shown in a position corresponding with the position of the ring 406 when the golf club head 400 is in the address position relative to the ground plane 181.

In some examples, the height HR of the lowest surface (and in some examples, an entirety) of the toe arm portion 463A at the toe portion 414 of the golf club head 400 is different than the height HR of the lowest surface (and in some examples, an entirety) of the heel arm portion 463B at the heel portion 416 of the golf club head 400. More specifically, in one example, the height HR of the lowest surface of the toe arm portion 463A at the toe portion 414 of the golf club head 400 is greater than the height HR of the lowest surface of the heel arm portion 463B at the heel portion 416 of the golf club head 100.

According to certain examples, the width WR of the toe arm portion 463A of the ring 406 at the toe portion 414 is less than the width WR of the heel arm portion 463B of the ring 406 at the heel portion 416. According to some additional examples, a thickness (TR) of the ring 406 can vary along the ring 406 in a forward-to-rearward direction. For example, in some instances, the thickness TR of the ring 406 varies from a minimum thickness to a maximum thickness in a forward-to-rearward direction. In certain examples, as shown, the thickness TR of the toe arm portion 463A of the ring 406 at the toe portion 414 is less than the thickness TR of the heel arm portion 463B of the ring 406 at the heel portion 416.

The golf club heads disclosed herein, including the golf club head 100, the golf club head 200, and the golf club head 300, each has a volume, equal to the volumetric displacement of the golf club head, that is between 390 cubic centimeters ($cm^3$ or cc) and about 600 $cm^3$. In more particular examples, the volume of each one of the golf club heads disclosed herein is between about 350 $cm^3$ and about 500 $cm^3$ or between about 420 $cm^3$ and about 500 $cm^3$. The total mass of each one of the golf club heads disclosed herein is between about 145 g and about 245 g, in some examples, and between 185 g and 210 g in other examples.

The golf club heads disclosed herein have a multi-piece construction. For example, with regards to the golf club head 100, the cast cup 104, the ring 106, the crown insert 108, and the sole insert 110 each comprises one piece of the multi-piece construction. Because each piece of the multi-piece construction is separately formed and attached together, each piece can be made of a material different than at least one other of the pieces. Such a multi-material construction allows for flexibility of the material composition, and thus the mass composition and distribution, of the golf club heads.

The following properties of the golf club heads disclosed herein proceeds with reference to the golf club head 100. However, unless otherwise noted, the properties described with reference to the golf club head 100 also apply to the golf club head 200, the golf club head 300, and the golf club head 400. The golf club head 100 is made from at least one first material, having a density between 0.9 g/cc and 3.5 g/cc, at least one second material, having a density between 3.6 g/cc and 5.5 g/cc, and at least one third material, having a density between 5.6 g/cc and 20.0 g/cc. In a first example, the cast cup 104 is made of the third material, the ring 106 is made of the second material, and the crown insert 108 and the sole insert 110 are made of the first material. In this first example, according to one instance, the cast cup 104 is made of a steel alloy, the ring 106 is made of a titanium alloy, and the crown insert 108 and the sole insert 110 are made of a fiber-reinforced polymeric material. In a second example, the cast cup 104 is made of the second and third material, the ring 106 is made of the first or the second material, and the crown insert 108 and the sole insert 110 are made of the first material. In this second example, according to one instance, the cast cup 104 is made of a steel alloy and a titanium alloy, the ring 106 is made of a titanium alloy, aluminum alloy, or plastic, and the crown insert 108 and the sole insert 110 are made of a fiber-reinforced polymeric material.

According to some examples, the at least one first material has a first mass no more than 55% of the total mass of the golf club head 100 and no less than 25% of the total mass of the golf club head 100 (e.g., between 50 g and 110 g). In certain examples, the first mass of the at least one first material is no more than 45% of the total mass of the golf club head 100 and no less than 30% of the total mass of the golf club head 100. The first mass of the at least one first material can be greater than the second mass of the at least one second material. Alternatively, or additionally, the first mass of the at least one first material can be within 10 g of the second mass of the at least one second material.

In some examples, the at least one second material has a second mass no more than 65% of the total mass of the golf club head 100 and no less than 20% of the total mass of the golf club head 100 (e.g., between 40 g and 130 g). According to certain examples, the second mass of the at least one second material is no more than 50% of the total mass of the golf club head 100. The second mass of the at least one second material is less than two times the first mass of the at least one first material in certain examples. The second mass of the at least one second material is between 0.9 times and 1.8 times the first mass of the at least one first material in some examples. In one example, the second mass of the at least one second material is less than 0.9 times, or less than 1.8 times, the first mass of the at least one first material.

The at least one third material has a third mass equal to the total mass of the golf club head 100 less the first mass of the at least one first material and the second mass of the at least one second material. In one example, the third mass of the at least one third material is no less than 5% of the total mass of the golf club head 100 and no more than 50% of the total mass of the golf club head 100 (e.g., between 10 g and 100 g). According to another example, the third mass of the at least one third material is no less than 10% of the total mass of the golf club head 100 and no more than 20% of the total mass of the golf club head 100.

According to one example, the cast cup 104 of the body 102 of the golf club head 100 is made from the at least one first material and the at least one first material is a first metal material that has a density between 4.0 g/cc and 8.0 g/cc. In this example, the ring 106 of the body 102 of the golf club head 100 is made of a material that has a density between 0.5 g/cc and 4.0 g/cc. According to certain implementations, the first metal material of the cast cup 104 is a titanium alloy and/or a steel alloy and the material of the ring 106 is an aluminum alloy and/or a magnesium alloy. In some implementations, the first metal material of the cast cup 104 is a titanium alloy and/or a steel alloy and the material of the ring 106 is a non-metal material, such as a plastic or polymeric material. Accordingly, in some examples, the ring 106 is made of any of various materials, such as titanium alloys, aluminum alloys, and fiber-reinforced polymeric materials.

The ring 106, in some examples, is made of one of 6000-series, 7000-series, or 8000-series aluminum, which can be anodized to have a particular color the same as or different than the cast cup 104. According to some examples, the ring 106 can be anodized to have any one of an array of colors, including blue, red, orange, green, purple, etc. Contrasting colors between the ring 105 and the cast cup 104 may help with alignment or suit a user's preferences. In one example, the ring 106 is made of 7075 aluminum. According to some examples, the ring 106 is made of a fiber-reinforced polycarbonate material. The ring 106 can be made from a plastic with a non-conductive vacuum metallizing coating, which may also have any of various colors. Accordingly, in certain examples, the ring 106 is made of a titanium alloy, a steel alloy, a boron-infused steel alloy, a copper alloy, a beryllium alloy, composite material, hard plastic, resilient elastomeric material, carbon-fiber reinforced thermoplastic with short or long fibers. The ring 106 can be made via an injection molded, cast molded, physical vapor deposition, or CNC milled technique.

As described herein, the ring (e.g., the ring 106) of any of the club heads disclosed herein can comprise various different materials and features, and be made of different materials and have different properties than the cast cup (e.g., the cast cup 104), which is formed separately and later coupled to the ring. In addition to or alternative to other materials described herein, the ring can comprise metallic materials, polymeric materials, and/or composite materials, and can include various external coatings.

In some embodiments, the ring comprises anodized aluminum, such as 6000, 7000, and 8000 series aluminum. In one specific example, the ring comprises 7075 grade aluminum. The anodized aluminum can be colored, such as red, green, blue, gray, white, orange, purple, pink, fuchsia, black, clear, yellow, gold, silver, or metallic colors. In some embodiments, the ring can have a color that contrasts from a majority color located on other parts of the club head (e.g., the crown insert, the sole insert, the cup, the rear weight, etc.).

In some embodiments, the ring can comprise any combination of metals, metal alloys (e.g., Ti alloys, steel, boron infused steel, aluminum, copper, beryllium), composite materials (e.g., carbon fiber reinforced polymer, with short or long fibers), hard plastics, resilient elastomers, other polymeric materials, and/or other suitable materials. Any material selection for the ring can also be combined with any of various formation methods, such as any combination of the following: casting, injection molding, sintering, machining, milling, forging, extruding, stamping, and rolling.

A plastic ring (fiber reinforced polycarbonate ring) may offer both mass savings e.g. about 5 grams compared to an aluminum ring, cost savings as well, give greater design flexibility due to processes used to form the ring e.g. injection molded thermoplastic, and perform similarly to an aluminum ring in abuse testing e.g. slamming the club head into a concrete cart path (extreme abuse) or shaking it in a bag where other metal clubs can repeatedly impact it (normal abuse).

In some embodiments, the ring can comprise a polymeric material (e.g., plastic) with a non-conductive vacuum metallizing (NCVM) coating. For example, in some embodiments, the ring may include a primer layer having an average thickness of about 5-11 micrometers (μm) or about 8.5 μm, and under coating layer on top of the primer layer having an average thickness of about 5-11 μm or about 8.5 μm, a NCVM layer on top of under coating layer having an average thickness of about 1.1-3.5 μm or about 2.5 μm, a color coating layer on top of the NCVM layer having an average thickness of about 25-35 μm or about 29 μm, and a top coating (UV protection coat) outer layer on top of the color coating layer having an average thickness of about 20-35 μm or about 26 μm. In general, for a NCVM coated part or ring the NCVM layer will be the thinnest and the color coating layer and the top coating layers will be the thickest and generally about 8-15 times thicker than NCVM layer. Generally, all the layers will combine to have a total average thickness of about 60-90 μm or about 75 μm. The described layers and NCVM coating could be applied to other parts other than the ring, such as the crown, sole, forward cup, and removable weights, and it can be applied prior to assembly.

In some embodiments, the ring can comprise a physical vapor deposition (PVD) coating or film layer. In some embodiments, the ring can include a paint layer, or other outer coloring layer. Conventionally, painting a golf club heads is all done by hand and requires masking various components to prevent unwanted spray on unwanted surfaces. Hand painting, however, can lead to great inconsistency from club to club. Separately forming the ring not only allows for greater access to the rearward portion of the face for milling operations to remove unwanted alpha case and allows for machining in various face patterns, but it also eliminates the need for masking off various components. The ring can be painted in isolation prior to assembly. Or in the case of anodized aluminum, no painting may be necessary, eliminating a step in the process such that the ring can simply be bonded or attached to a cup that may also be fully finished. Similarly if the ring is coated using PVD or NCVM, this coating can be applied to the ring prior to assembly, again eliminating several steps. This also allows for attachment of various color rings that may be selectable by an end user to provide an alignment or aesthetic benefit to the user. Whether the ring is a NCVM coated ring or a PVD coated ring, as mentioned above, it can be colored an array of colors, such as red, green, blue, gray, white, orange, purple, pink, fuchsia, black, clear, yellow, gold, silver, or metallic colors.

The following properties of the golf club heads disclosed herein proceeds with reference to the golf club head 100. However, unless otherwise noted, the properties described with reference to the golf club head 100 also apply to the golf club head 200, the golf club head 300, and the golf club head 400. The golf club head 100 is made from two of at least one first material, having a density between 0.9 g/cc and 3.5 g/cc, at least one second material, having a density between 3.6 g/cc and 5.5 g/cc, and at least one third material, having a density between 5.6 g/cc and 20.0 g/cc. In a first example, the cast cup 104 is made of the second material and the ring 106, the crown insert 108, and the sole insert 110 are made of the first material. In this first example, according to one instance, the cast cup 104 is made of a titanium alloy, the ring 106 is made of an aluminum alloy, and the crown insert 108 and the sole insert 110 are made of a fiber-reinforced polymeric material. In this first example, according to another instance, the cast cup 104 is made of a titanium alloy, the ring 106 is made of plastic, and the crown insert 108 and the sole insert 110 are made of a fiber-reinforced polymeric material. According to a second example, the cast cup 104 is made of the second material, the ring 106 is made of the second material, and the crown insert 108 and the sole insert 110 are made of the first material. In this second example, according to one instance, the cast cup 104 and the ring 106 are made of a titanium alloy and the crown insert 108 and the sole insert 110 are made of a fiber-reinforced polymeric material.

In some examples, the at least one first material is a fiber-reinforced polymeric material that includes continuous fibers embedded in a polymeric matrix (e.g., epoxy or resin), which is a thermoset polymer is certain examples. The continuous fibers can be long fibers having a length of at least 3 millimeters, 10 millimeters, or even 50 millimeters. In other embodiments, shorter fibers can be used having a length of between 0.5 and 2.0 millimeters. Incorporation of the fiber reinforcement increases the tensile strength, however it may also reduce elongation to break therefore a careful balance can be struck to maintain sufficient elongation. Therefore, one embodiment includes 35-55% long fiber reinforcement, while in an even further embodiment has 40-50% long fiber reinforcement. The continuous fibers, as well as the fiber-reinforced polymeric material in general, can be the same or similar to that described in Paragraph 295 of U.S. Patent Application Publication No. 2016/0184662, published Jun. 30, 2016, now U.S. Pat. No. 9,468,816, issued Oct. 18, 2016, which is incorporated herein by reference in its entirety. In several examples, the crown insert 108 and the sole insert 110 are made of the fiber-reinforced polymeric material. Accordingly, in some examples, each one of the continuous fibers of the fiber-reinforced polymeric material does not extend from the crown portion 119 to the sole portion 117 of the golf club head 100. Alternatively, or additionally, in certain examples, each one of the continuous fibers of the fiber-reinforced polymeric material does not extend from the crown portion 119 to the forward portion 112 of the golf club head 100. The crown insert 108 is made of a material that has a density between 0.5 g/cc and 4.0 g/cc in one example. The sole insert 110 is made of a material that has a density between 0.5 g/cc and 4.0 g/cc in one example.

In certain examples, the first material is a fiber-reinforced polymeric material as described in U.S. patent application Ser. No. 17/006,561, filed Aug. 28, 2020. Composite materials that are useful for making club-head components comprise a fiber portion and a resin portion. In general the resin portion serves as a "matrix" in which the fibers are embedded in a defined manner. In a composite for club-heads, the fiber portion is configured as multiple fibrous layers or plies that are impregnated with the resin component. The fibers in each layer have a respective orientation, which is typically different from one layer to the next and precisely controlled. The usual number of layers for a striking face is substantial, e.g., forty or more. However for a sole or crown, the number of layers can be substantially decreased to, e.g., three or more, four or more, five or more, six or more, examples of which will be provided below. During fabrication of the composite material, the layers (each comprising respectively oriented fibers impregnated in uncured or partially cured resin; each such layer being called a "prepreg" layer) are placed superposedly in a "lay-up" manner. After forming the prepreg lay-up, the resin is cured to a rigid condition. If interested a specific strength may be calculated by dividing the tensile strength by the density of the material. This is also known as the strength-to-weight ratio or strength/weight ratio.

In tests involving certain club-head configurations, composite portions formed of prepreg plies having a relatively low fiber areal weight (FAW) have been found to provide superior attributes in several areas, such as impact resistance, durability, and overall club performance. FAW is the weight of the fiber portion of a given quantity of prepreg, in units of $g/m^2$. FAW values below 100 $g/m^2$, and more desirably below 70 $g/m^2$, can be particularly effective. A particularly suitable fibrous material for use in making prepreg plies is carbon fiber, as noted. More than one fibrous material can be used. In other embodiments, however, prepreg plies having FAW values below 70 $g/m^2$ and above 100 $g/m^2$ may be used. Generally, cost is the primary prohibitive factor in prepreg plies having FAW values below 70 $g/m^2$.

In particular embodiments, multiple low-FAW prepreg plies can be stacked and still have a relatively uniform distribution of fiber across the thickness of the stacked plies. In contrast, at comparable resin-content (R/C, in units of percent) levels, stacked plies of prepreg materials having a higher FAW tend to have more significant resin-rich regions, particularly at the interfaces of adjacent plies, than stacked plies of low-FAW materials. Resin-rich regions tend to reduce the efficacy of the fiber reinforcement, particularly since the force resulting from golf-ball impact is generally transverse to the orientation of the fibers of the fiber reinforcement. The prepreg plies used to form the panels desirably comprise carbon fibers impregnated with a suitable resin, such as epoxy.

Figure 26:
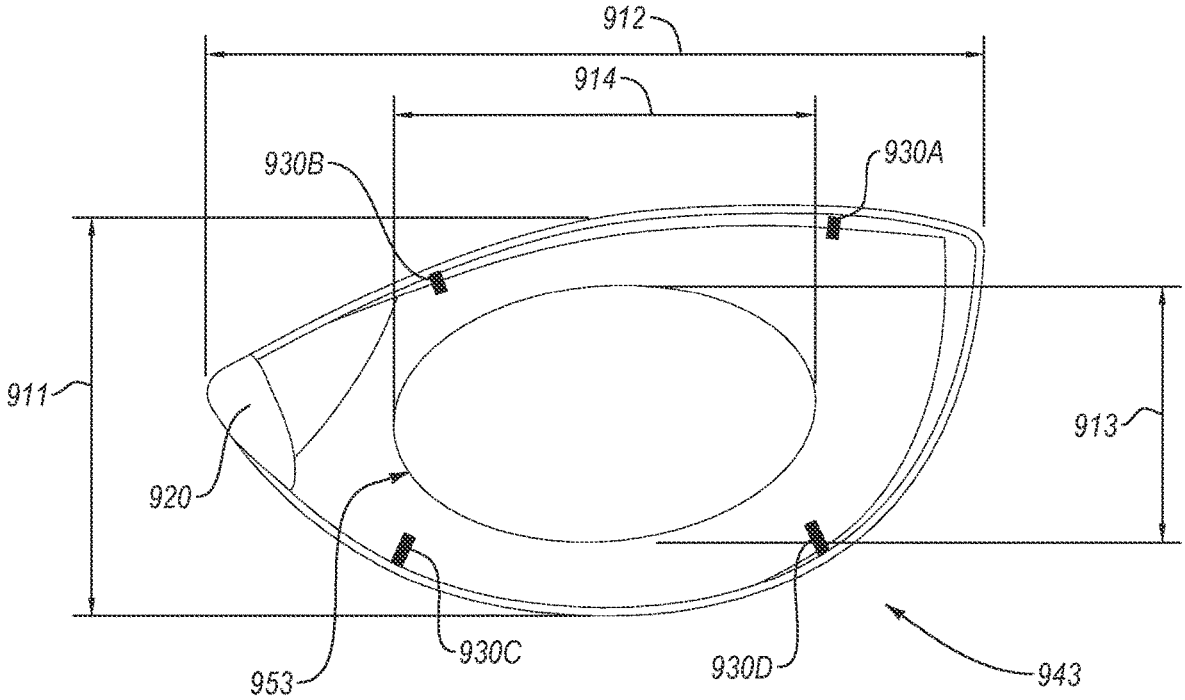
FIG. 26 is a front elevation view of a strike plate of a golf club head, according to one or more examples of the present disclosure.

FIG. 26 is a front elevation view of a strike plate 943, which can replace any one of the strike plates disclosed herein. The strike plate 943 is made of composite materials, and can be termed a composite strike plate in some examples. The non-metal or composite material of the strike plate 943 comprises a fiber-reinforced polymer comprising fibers embedded in a resin. A percent composition of the resin in the fiber-reinforced polymer is between 38% and 44%. Further details concerning the construction and manufacturing processes for the composite strike plate 943 are described in U.S. Pat. No. 7,871,340 and U.S. Published Patent Application Nos. 2011/0275451, 2012/0083361, and 2012/0199282, which are incorporated herein by reference. The composite strike plate 943 is attached to an insert support structure located at the opening at the front portion of a golf club head, such as one disclosed herein.

In some examples, the strike plate 943 can be machined from a composite plaque. In an example, the composite plaque can be substantially rectangular with a length between about 90 mm and about 130 mm or between about 100 mm and about 120 mm, preferably about 110 mm±1.0 mm, and a width between about 50 mm and about 90 mm or between about 6 mm and about 80 mm, preferably about 70 mm 1.0 mm plaque size and dimensions. The strike plate 943 is then machined from the plaque to create a desired face profile. For example, the face profile length 912 can be between about 80 mm and about 120 mm or between about 90 mm and about 110 mm, preferably about 102 mm. The face profile width 911 can be between about 40 mm and about 65 mm or between about 45 mm and about 60 mm, preferably about 53 mm. The height 913 of a preferred impact zone 953 on the strike face, defined by the strike plate 943 and centered on a geometric center of the strike face, can be between about 25 mm and about 50 mm, between about 30 mm and about 40 mm, or between about 17 mm and about 45 mm, such as preferably about 34 mm. The length 914 of the preferred impact zone 953 can be between about 40 mm and about 70 mm, between about 28 mm and about 65 mm, or between about 45 mm and about 65 mm, preferably about 55.5 mm or 56 mm. In certain examples, the preferred impact zone 953 of the strike face defined by the strike plate 943 has an area between 500 $mm^2$ and 1,800 $mm^2$. Alternatively, the strike plate 943 can be molded to provide the desired face dimensions and profile.

Figure 27:
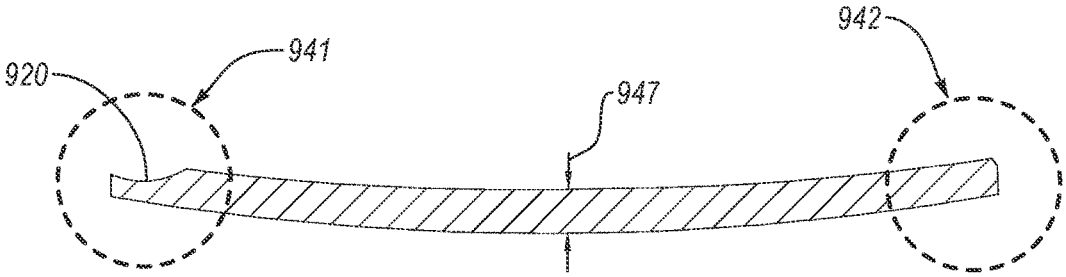
FIG. 27 is a bottom view of a strike plate of a golf club head, according to one or more examples of the present disclosure.

Additional features can be machined or molded into face the strike plate 943 to create the desired face profile. For example, as shown in FIG. 27, a notch 920 can be machined or molded into the backside of a heel portion of the strike plate 943. The notch 920 in the back of the strike plate 943 allows for the golf club head to utilize flight control technology (FCT) in the hosel, in some examples. The notch 920 can be configured to accept at least a portion of the hosel within the strike plate 943. Alternatively or additionally, the notch 920 can be configured to accept at least a portion of the club head body within the strike plate 943. The notch may allow for the reduction of center-face y-axis location (CFY) by accommodating at least a portion of the hosel and/or at least a portion of the club body within the strike plate 943, allowing the preferred impact zone 953 of the strike plate 943 to be closer to a plane passing through a center point location of the hosel. The strike plate 943 can be configured to provide a CFY no more than about 18 mm and no less than about 9 mm, preferably between about 11.0 mm and about 16.0 mm, and more preferably no more than about 15.5 mm and no less than about 11.5 mm. The strike plate 943 can be configured to provide face progression no more than about 21 mm and no less than about 12 mm, preferably no more than about 19.5 mm and no less than about 13 mm and more preferably no more than about 18 mm and no less than about 14.5 mm. In some embodiments, a difference between CFY and face progression is at least 3 mm and no more than 12 mm.

In another example, backside bumps 4230A, 4230B, 4230C, 4230D may be machined or molded into the backside of the strike plate 943. The backside bumps 4230A, 4230B, 4230C, 4230D can be configured to provide for a bond gap. A bond gap is an empty space between the club head body and the strike plate 943 that is filled with adhesive during manufacturing. The backside bumps 4230A, 4230B, 4230C, 4230D protrude to separate the face from the club head body when bonding the strike plate 943 to the club head body during manufacturing. In some instances, too large or too small of a bond gap may lead to durability issues of the club head, the strike plate 943, or both. Further, too large of a bond gap can allow too much adhesive to be used during manufacturing, adding unwanted additional mass to the club head. The backside bumps 4230A, 4230B, 4230C, 4230D can protrude between about 0.1 mm and 0.5 mm, preferably about 0.25 mm. In some embodiments, the backside bumps are configured to provide for a minimum bond gap, such as a minimum bond gap of about 0.25 mm and a maximum bond gap of about 0.45 mm.

Further, one or more of the edges of the strike plate 943 can be machined or molded with a chamfer. In an example, the strike plate 943 includes a chamfer substantially around the inside perimeter edge of the strike plate 943, such as a chamfer between about 0.5 mm and about 1.1 mm, preferably 0.8 mm.

FIG. 27 is a is a bottom perspective view of the strike plate 943. The strike plate 943 has a heel portion 941 and a toe portion 942. The notch 920 is machined or molded into the heel portion 941. In this example, the strike plate 943 has a variable thickness, such as with a peak thickness 947 within the preferred impact zone 953. The peak thickness 947 can be between about 2 mm and about 7.5 mm, between about 4.3 mm and 5.15 mm, between about 4.0 mm and about 5.15 or 5.5 mm, or between about 3.8 mm and about 4.8 mm, preferably 4.1 mm±0.1 mm, 4.25 mm±0.1 mm, or 4.5 mm±0.1 mm. The peak thickness 947 can be located at the geometric center of the strike face defines by the strike plate 943. A minimum thickness of the strike plate 943 is between 3.0 mm and 4.0 mm in some examples.

Additionally, in certain examples, the preferred impact zone 953 is off-center or offset relative to the geometric center of the strike face, and can be thicker toeward of the geometric center of the strike face. In some examples, the thickness of the strike plate 943 within the preferred impact zone 953 is variable (e.g., between about 3.5 mm and about 5.0 mm) and the thickness of the strike plate 943 outside of the preferred impact zone 953 is constant (e.g., between 3.5 mm and 4.2 mm) and less than within preferred impact zone 953.

The strike plate 943 has a toe edge region and a heel edge region outside of the preferred impact zone 953 such that the preferred impact zone is between the toe edge region and the heel edge region. The toe edge region is closer to the toe portion than the heel edge region. The heel edge region is closer to the heel portion than the toe edge region. The toe edge region thickness is less than the maximum thickness. A thickness of the strike plate 943 transitions from the maximum thickness, within the preferred impact zone 953, to a toe edge region thickness, within the toe edge region, between 3.85 mm and 4.5 mm.

In some embodiments, the strike plate 943 is manufactured from multiple layers of composite materials. Exemplary composite materials and methods for making the same are described in U.S. patent application Ser. No. 13/452,370 (published as U.S. Pat. App. Pub. No. 2012/0199282), which is incorporated by reference. In some embodiments, an inner and outer surface of the composite face can include a scrim layer, such as to reinforce the strike plate 943 with glass fibers making up a scrim weave. Multiple quasi-isotropic panels (Q's) can also be included, with each Q panel using multiple plies of unidirectional composite panels offset from each other. In an exemplary four-ply Q panel, the unidirectional composite panels are oriented at 90°, −45°, 0°, and 45°, which provide for structural stability in each direction. Clusters of unidirectional strips (C's) can also be included, with each C using multiple unidirectional composite strips. In an exemplary four-strip C, four 27 mm strips are oriented at 0°, 125°, 90°, and 55°. C's can be provided to increase thickness of the strike plate 943 in a localized area, such as in the center face at the preferred impact zone. Some Q's and C's can have additional or fewer plies (e.g., three-ply rather than four-ply), such as to fine tune the thickness, mass, localized thickness, and provide for other properties of the strike plate 943, such as to increase or decrease COR of the strike plate 943.

In some embodiments, the strike face, such as the strike plate 243, of some examples of the golf club head disclosed herein is manufactured from multiple layers of composite materials. Exemplary composite materials and methods for making the same are described in U.S. patent application Ser. No. 13/452,370 (published as U.S. Pat. App. Pub. No. 2012/0199282), which is incorporated by reference. In some embodiments, an inner and outer surface of the composite face can include a scrim layer, such as to reinforce the strike face with glass fibers making up a scrim weave. Multiple quasi-isotropic panels (Q's) can also be included, with each Q panel using multiple plies of unidirectional composite panels offset from each other. In an exemplary four-ply Q panel, the unidirectional composite panels are oriented at 90°, −45°, 0°, and 45°, which provide for structural stability in each direction. Clusters of unidirectional strips (C's) can also be included, with each C using multiple unidirectional composite strips. In an exemplary four-strip C, four 27 mm strips are oriented at 0°, 125°, 90°, and 55°. C's can be provided to increase thickness of the strike face, or other composite features, in a localized area, such as in the center face at the preferred impact zone. Some Q's and C's can have additional or fewer plies (e.g., three-ply rather than four-ply), such as to fine tune the thickness, mass, localized thickness, and provide for other properties of the strike face, such as to increase or decrease COR of the strike face.

Additional composite materials and methods for making the same are described in U.S. Pat. Nos. 8,163,119 and 10,046,212, which is incorporated by reference. For example, the usual number of layers for a strike plate is substantial, e.g., fifty or more. However, improvements have been made in the art such that the layers may be decreased to between 30 and 50 layers.

Table 3 below provide examples of possible layups of one or more of the composite parts of the golf club head disclosed herein. These layups show possible unidirectional plies unless noted as woven plies. The construction shown is for a quasi-isotropic layup. A single layer ply has a thickness of ranging from about 0.065 mm to about 0.080 mm for a standard FAW of 70 gsm with about 36% to about 40% resin content. The thickness of each individual ply may be altered by adjusting either the FAW or the resin content, and therefore the thickness of the entire layup may be altered by adjusting these parameters.

TABLE 3

| ply 1 | ply 2 | ply 3 | ply 4 | ply 5 | ply 6 | ply 7 | ply 8 | AW g/m$^2$ |
|---|---|---|---|---|---|---|---|---|
| 0 | −60 | +60 | | | | | | 290-360 |
| 0 | −45 | +45 | 90 | | | | | 390-480 |
| 0 | +60 | 90 | −60 | 0 | | | | 490-600 |
| 0 | +45 | 90 | −45 | 0 | | | | 490-600 |
| 90 | +45 | 0 | −45 | 90 | | | | 490-600 |
| +45 | 90 | 0 | 90 | −45 | | | | 490-600 |
| +45 | 0 | 90 | 0 | −45 | | | | 490-600 |
| −60 | −30 | 0 | +30 | 60 | 90 | | | 590-720 |
| 0 | 90 | +45 | −45 | 90 | 0 | | | 590-720 |
| 90 | 0 | +45 | −45 | 0 | 90 | | | 590-720 |
| 0 | 90 | 45 | −45 | −45 | 45 | 0/90 woven | | 680-840 |
| 90 | 0 | 45 | −45 | −45 | 45 | 90/0 woven | | 680-840 |
| +45 | −45 | 90 | 0 | 0 | 90 | −45/45 woven | | 680-840 |
| 0 | 90 | 45 | −45 | −45 | 45 | 90 UD | | 680-840 |
| 0 | 90 | 45 | −45 | 0 | −45 | 45 | 0/90 woven | 780-960 |
| 90 | 0 | 45 | −45 | 0 | −45 | 45 | 90/0 woven | 780-960 |

The Area Weight (AW) is calculated by multiplying the density times the thickness. For the plies shown above made from composite material the density is about 1.5 g/cm$^3$ and for titanium the density is about 4.5 g/cm$^3$.

In general, a composite face plate or composite face insert may have a peak thickness that varies between about 3.8 mm and 5.15 mm. In general, the composite face plate is formed from multiple composite plies or layers. The usual number of layers for a composite striking face is substantial, e.g., forty or more, preferably between 30 to 75 plies, more preferably, 50 to 70 plies, even more preferably 55 to 65 plies.

In an example, a first composite face insert can have a peak thickness of 4.1 mm and an edge thickness of 3.65 mm, including 12 Q's and 2 C's, resulting in a mass of 24.7 g. In another example, a second composite face insert can have a peak thickness of 4.25 mm and an edge thickness of 3.8 mm, including 12 Q's and 2 C's, resulting in a mass of 25.6 g. The additional thickness and mass is provided by including additional plies in one or more of the Q's or C's, such as by using two 4-ply Q's instead of two 3-ply Q's. In yet another example, a third composite face insert can have a peak thickness of 4.5 mm and an edge thickness of 3.9 mm, including 12 Q's and 3 C's, resulting in a mass of 26.2 g. Additional and different combinations of Q's and C's can be provided for a composite face insert 110 with a mass between about 20 g and about 30 g, or between about 15 g and about 35 g. In some examples, wherein the strike plate, such as the strike plate 943, has a total mass between 22 grams and 28 grams.

Figure 28A:
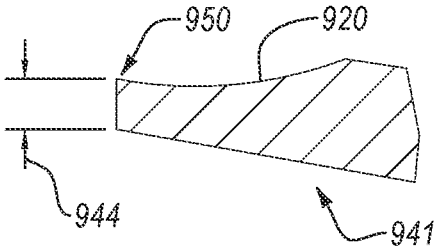
FIG. 28A is a bottom sectional view of a heel portion of a strike plate of a golf club head, according to one or more examples of the present disclosure.

FIG. 28A is a section view of a heel portion 41 of the strike plate 943. The heel portion 941 can include a notch 920. In embodiments with a chamfer on an inside edge of the strike plate 943, no chamfer 950 is provided on the notch 920. The notch 920 can have a notch edge thickness 944 less than the edge thickness 945 of the face insert 110 (see, e.g., FIG. 28B). For example, the notch edge thickness 944 can be between 1.5 mm and 2.1 mm, preferably 1.8 mm.

Figure 28B:
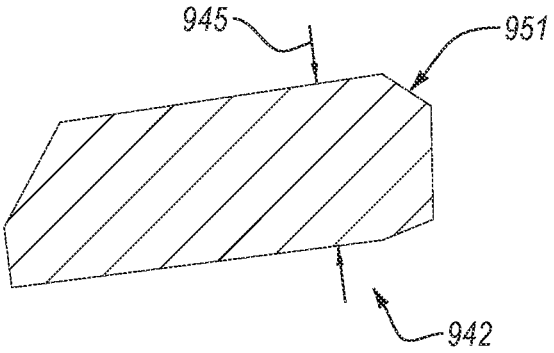
FIG. 28B a bottom sectional view of a toe portion of a strike plate of a golf club head, according to one or more examples of the present disclosure.

FIG. 28B is a section view of a toe portion 942 of the strike plate 943. The toe portion 942 includes a chamfer 951 on the inside edge of the strike plate 943. In some embodiments, the edge thickness 945 can be between about 3.35 mm and about 4.2 mm, preferably 3.65 mm±0.1 mm, 3.8 mm±0.1 mm, or 3.9 mm±0.1 mm.

Figure 29:
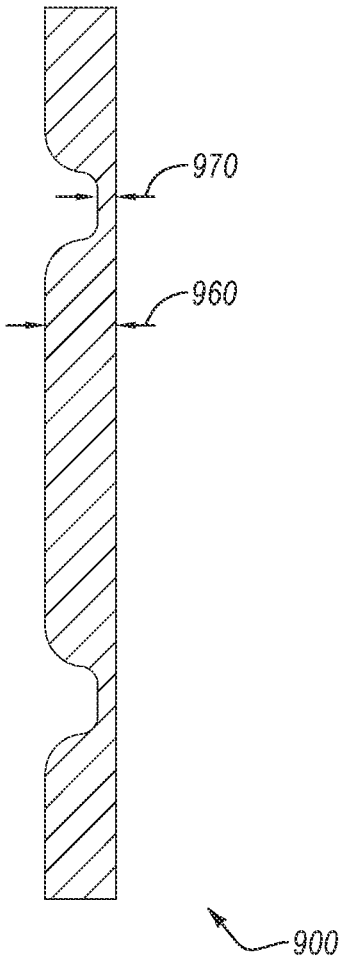
FIG. 29 is a sectional view of a polymer layer of a strike plate of a golf club head, according to one or more examples of the present disclosure.

FIG. 29 is a section view of a polymer layer 900 of the strike plate 943. The polymer layer 900 can be provided on the outer surface of the strike plate 943 to provide for better performance of the strike plate 943, such as in wet conditions. Exemplary polymer layers are described in U.S. patent application Ser. No. 13/330,486 (patented as U.S. Pat. No. 8,979,669), which is incorporated by reference. The polymer layer 900 may include polyurethane and/or other polymer materials. The polymer layer may have a polymer maximum thickness 960 between about 0.2 mm and 0.7 mm or about 0.3 mm and about 0.5 mm, preferably 0.40 mm±0.05 mm. The polymer layer may have a polymer minimum thickness 970 between about 0.05 mm and 0.15 mm, preferably 0.09 mm±0.02 mm. The polymer layer can be configured with alternating maximum thicknesses 960 and minimum thicknesses 970 to create score lines on the strike plate 943. Further, in some embodiments, teeth and/or another texture may be provided on the thicker areas of the polymer layer 900 between the score lines.

In some examples, the crown insert, such as the crown insert 108, and the sole insert, such as the sole insert 110, are made of a carbon-fiber reinforced polymeric material. In one example, the crown insert is made of layers of unidirectional tape, woven cloth, and composite plies.

Referring to FIG. 4, the golf club head 100 has a face-back dimension (FBD) defined as the distance between a hypothetical plane 169, passing through the center face 183 of the strike face 145 and parallel to the strike face 145, and a rearmost point on the golf club head 100 in a face-back direction 165 perpendicular to the hypothetical plane 169. As defined herein, the center face 183 is located at 0% of the face-back dimension (FBD) and the rearmost point is located at 100% of the face-back dimension (FBD). Under this definition, the golf club head 100 can be divided into a face section that extends, in the face-back direction 165, from 0% of the face-back dimension (FBD) to 25% of the face-back dimension (FBD), a middle section that extends, in the face-back direction 165, from 25% to 75% of the face-back dimension (FBD), and a back section that extends, in the face-back direction 165, from 75% to 100% of the face-back dimension (FBD). According to some examples, at least 95% by weight of the middle section is made of a material having a density between 0.9 g/cc and 4.0 g/cc. In certain examples, at least 95% by weight of the middle section is made of material having a density between 0.9 g/cc and 2.0 g/cc. In some examples, at least 95% by weight of the middle section and at least 95% by weight of the back section are made of a material having a density between 0.9 g/cc and 2.0 g/cc, excluding any attached weights and any housings for the attached weights. No more than 20% by weight of the middle section and no more than 20% by weight of the back section are made of a material having a density between 4.0 g/cc and 20.0 g/cc, according to various examples.

In some examples, the golf club head 100 includes one or more of the following materials: carbon steel, stainless steel (e.g. 17-4 PH stainless steel), alloy steel, Fe—Mn—Al alloy, nickel-based ferroalloy, cast iron, super alloy steel, aluminum alloy (including but not limited to 3000 series alloys, 5000 series alloys, 6000 series alloys, such as 6061-T6, and 7000 series alloys, such as 7075), magnesium alloy, copper alloy, titanium alloy (including but not limited to 6-4 titanium, 3-2.5, 6-4, SP700, 15-3-3-3, 10-2-3, Ti 9-1-1, ZA 1300, or other alpha/near alpha, alpha-beta, and beta/near beta titanium alloys) or mixtures thereof.

In one example, when forming part of the golf club heads disclosed herein, such as when forming part of the strike plate, the titanium alloy is a 9-1-1 titanium alloy. Titanium alloys comprising aluminum (e.g., 8.5-9.5% Al), vanadium (e.g., 0.9-1.3% V), and molybdenum (e.g., 0.8-1.1% Mo), optionally with other minor alloying elements and impurities, herein collectively referred to a "9-1-1 Ti", can have less significant alpha case, which renders HF acid etching unnecessary or at least less necessary compared to faces made from conventional 6-4 Ti and other titanium alloys. Further, 9-1-1 Ti can have minimum mechanical properties of 820 MPa yield strength, 958 MPa tensile strength, and 10.2% elongation. These minimum properties can be significantly superior to typical cast titanium alloys, such as 6-4 Ti, which can have minimum mechanical properties of 812 MPa yield strength, 936 MPa tensile strength, and ~6% elongation. In certain examples, the titanium alloy is 8-1-1 Ti.

In another example, when forming part of the golf club heads disclosed herein, such as when forming part of the strike plate, the titanium alloy is an alpha-beta titanium alloy comprising 6.5% to 10% Al by weight, 0.5% to 3.25% Mo by weight, 1.0% to 3.0% Cr by weight, 0.25% to 1.75% V by weight, and/or 0.25% to 1% Fe by weight, with the balance comprising Ti (one example is sometimes referred to as "1300" or "ZA1300" titanium alloy). The alpha-beta titanium alloy or ZA1300 titanium alloy has a first ultimate tensile strength of at least 1,000 MPa in some examples and at least 1,100 MPa in other examples. An ultimate tensile strength of the material forming the body 102, other than the strike face 145, can be less than the first ultimate tensile strength by at least 10%. In another representative example, the alloy may comprise 6.75% to 9.75% Al by weight, 0.75% to 3.25% or 2.75% Mo by weight, 1.0% to 3.0% Cr by weight, 0.25% to 1.75% V by weight, and/or 0.25% to 1% Fe by weight, with the balance comprising Ti. In yet another representative example, the alloy may comprise 7% to 9% Al by weight, 1.75% to 3.25% Mo by weight, 1.25% to 2.75% Cr by weight, 0.5% to 1.5% V by weight, and/or 0.25% to 0.75% Fe by weight, with the balance comprising Ti. In a further representative example, the alloy may comprise 7.5% to 8.5% Al by weight, 2.0% to 3.0% Mo by weight, 1.5% to 2.5% Cr by weight, 0.75% to 1.25% V by weight, and/or 0.375% to 0.625% Fe by weight, with the balance comprising Ti. In another representative example, the alloy may comprise 8% Al by weight, 2.5% Mo by weight, 2% Cr by weight, 1% V by weight, and/or 0.5% Fe by weight, with the balance comprising Ti (such titanium alloys can have the formula Ti-8Al-2.5Mo-2Cr-1V-0.5Fe). As used herein, reference to "Ti-8Al-2.5Mo-2Cr-1V-0.5Fe" refers to a titanium alloy including the referenced elements in any of the proportions given above. Certain examples may also comprise trace quantities of K, Mn, and/or Zr, and/or various impurities.

Ti-8Al-2.5Mo-2Cr-1V-0.5Fe can have minimum mechanical properties of 1150 MPa yield strength, 1180 MPa ultimate tensile strength, and 8% elongation. These minimum properties can be significantly superior to other cast titanium alloys, including 6-4 Ti and 9-1-1 Ti, which can have the minimum mechanical properties noted above. In some examples, Ti-8Al-2.5Mo-2Cr-1V-0.5Fe can have a tensile strength of from about 1180 MPa to about 1460 MPa, a yield strength of from about 1150 MPa to about 1415 MPa, an elongation of from about 8% to about 12%, a modulus of elasticity of about 110 GPa, a density of about 4.45 g/cm$^3$, and a hardness of about 43 on the Rockwell C scale (43 HRC). In particular examples, the Ti-8Al-2.5Mo-2Cr-1V-0.5Fe alloy can have a tensile strength of about 1320 MPa, a yield strength of about 1284 MPa, and an elongation of about 10%. The Ti-8Al-2.5Mo-2Cr-1V-0.5Fe alloy, particularly when used to cast golf club head bodies, promotes less deflection for the same thickness due to a higher ultimate tensile strength compared to other materials. In some implementations, providing less deflection with the same thickness benefits golfers with higher swing speeds because over time the face of the golf club head will maintain its original shape over time.

In yet certain examples, the golf club head 100 is made of a non-metal material with a density less than about 2 g/cm$^3$, such as between about 1 g/cm$^3$ to about 2 g/cm$^3$. The non-metal material may include a polymer, such as fiber-reinforced polymeric material. The polymer can be either thermoset or thermoplastic, and can be amorphous, crystalline and/or a semi-crystalline structure. The polymer may also be formed of an engineering plastic such as a crystalline or semi-crystalline engineering plastic or an amorphous engineering plastic. Potential engineering plastic candidates include polyphenylene sulfide ether (PPS), polyethelipide (PEI), polycarbonate (PC), polypropylene (PP), acrylonitrile-butadience styrene plastics (ABS), polyoxymethylene plastic (POM), nylon 6, nylon 6-6, nylon 12, polymethyl methacrylate (PMMA), polypheylene oxide (PPO), polybothlene terephthalate (PBT), polysulfone (PSU), polyether sulfone (PES), polyether ether ketone (PEEK) or mixtures thereof. Organic fibers, such as fiberglass, carbon fiber, or metallic fiber, can be added into the engineering plastic, so as to enhance structural strength. The reinforcing fibers can be continuous long fibers or short fibers. One of the advantages of PSU is that it is relatively stiff with relatively low damping which produces a better sounding or more metallic sounding golf club compared to other polymers which may be overdamped. Additionally, PSU requires less post processing in that it does not require a finish or paint to achieve a final finished golf club head.

One exemplary material from which any one or more of the sole insert 110, the crown insert 108, the cast cup 103, the ring 106, and/or the strike face, such as the strike plate 243, can be made from is a thermoplastic continuous carbon fiber composite laminate material having long, aligned carbon fibers in a PPS (polyphenylene sulfide) matrix or base. A commercial example of a fiber-reinforced polymer, from which the sole insert 110, the crown insert 108, and/or the strike face can be made, is TEPEX® DYNALITE 207 manufactured by Lanxess®. TEPEX® DYNALITE 207 is a high strength, lightweight material, arranged in sheets, having multiple layers of continuous carbon fiber reinforcement in a PPS thermoplastic matrix or polymer to embed the fibers. The material may have a 54% fiber volume, but can have other fiber volumes (such as a volume of 42% to 57%). According to one example, the material weighs 200 g/m$^2$. Another commercial example of a fiber-reinforced polymer, from which the sole insert 110, crown insert 108, and/or the strike face is made, is TEPEX® DYNALITE 208. This material also has a carbon fiber volume range of 42 to 57%, including a 45% volume in one example, and a weight of 200 g/m2. DYNALITE 208 differs from DYNALITE 207 in that it has a TPU (thermoplastic polyurethane) matrix or base rather than a polyphenylene sulfide (PPS) matrix.

By way of example, the fibers of each sheet of TEPEX® DYNALITE 207 sheet (or other fiber-reinforced polymer material, such as DYNALITE 208) are oriented in the same direction with the sheets being oriented in different directions relative to each other, and the sheets are placed in a two-piece (male/female) matched die, heated past the melt temperature, and formed to shape when the die is closed. This process may be referred to as thermoforming and is especially well-suited for forming the sole insert 110, the crown insert 108, and/or the strike face. After the sole insert 110, the crown insert 108, and/or the strike face are formed (separately, in some implementations) by the thermoforming process, each is cooled and removed from the matched die. In some implementations, the sole insert 110, the crown insert 108, and/or the strike face has a uniform thickness, which facilitates use of the thermoforming process and ease of manufacture. However, in other implementations, the sole insert 110, the crown insert 108, and/or the strike face may have a variable thickness to strengthen select local areas of the insert by, for example, adding additional plies in select areas to enhance durability, acoustic properties, or other properties of the respective inserts.

In some examples, any one or more of the sole insert 110, the crown insert 108, the cast cup 103, the ring 106, and/or the strike face, such as the strike plate 243, can be made by a process other than thermoforming, such as injection molding or thermosetting. In a thermoset process, any one or more of the sole insert 110, the crown insert 108, the cast cup 103, the ring 106, and/or the strike face, such as the strike plate 243 may be made from "prepreg" plies of woven or unidirectional composite fiber fabric (such as carbon fiber composite fabric) that is preimpregnated with resin and hardener formulations that activate when heated. The prepreg plies are placed in a mold suitable for a thermosetting process, such as a bladder mold or compression mold, and stacked/oriented with the carbon or other fibers oriented in different directions. The plies are heated to activate the chemical reaction and form the crown insert 126 and/or a sole insert. Each insert is cooled and removed from its respective mold.

The carbon fiber reinforcement material for any one or more of the sole insert 110, the crown insert 108, the cast cup 103, the ring 106, and/or the strike face, such as the strike plate 243, made by the thermoset manufacturing process, may be a carbon fiber known as "34-700" fiber, available from Grafil, Inc., of Sacramento, California, which has a tensile modulus of 234 Gpa (34 Msi) and a tensile strength of 4500 Mpa (650 Ksi). Another suitable fiber, also available from Grafil, Inc., is a carbon fiber known as "TR50S" fiber which has a tensile modulus of 240 Gpa (35 Msi) and a tensile strength of 4900 Mpa (710 Ksi). Exemplary epoxy resins for the prepreg plies used to form the thermoset crown and sole inserts include Newport 301 and 350 and are available from Newport Adhesives & Composites, Inc., of Irvine, California. In one example, the prepreg sheets have a quasi-isotropic fiber reinforcement of 34-700 fiber having an areal weight between about 20 g/m^2 to about 200 g/m^2 preferably about 70 g/m^2 and impregnated with an epoxy resin (e.g., Newport 301), resulting in a resin content (R/C) of about 40%. For convenience of reference, the plipary composition of a prepreg sheet can be specified in abbreviated form by identifying its fiber areal weight, type of fiber, e.g., 70 FAW 34-700. The abbreviated form can further identify the resin system and resin content, e.g., 70 FAW 34-700/301, R/C 40%.

In some examples, polymers used in the manufacturing of the golf club head 100 may include without limitation, synthetic and natural rubbers, thermoset polymers such as thermoset polyurethanes or thermoset polyureas, as well as thermoplastic polymers including thermoplastic elastomers such as thermoplastic polyurethanes, thermoplastic polyureas, metallocene catalyzed polymer, unimodalethylene/carboxylic acid copolymers, unimodal ethylene/carboxylic acid/carboxylate terpolymers, bimodal ethylene/carboxylic acid copolymers, bimodal ethylene/carboxylic acid/carboxylate terpolymers, polyamides (PA), polyketones (PK), copolyamides, polyesters, copolyesters, polycarbonates, polyphenylene sulfide (PPS), cyclic olefin copolymers (COC), polyolefins, halogenated polyolefins [e.g. chlorinated polyethylene (CPE)], halogenated polyalkylene compounds, polyalkenamer, polyphenylene oxides, polyphenylene sulfides, diallylphthalate polymers, polyimides, polyvinyl chlorides, polyamide-ionomers, polyurethane ionomers, polyvinyl alcohols, polyarylates, polyacrylates, polyphenylene ethers, impact-modified polyphenylene ethers, polystyrenes, high impact polystyrenes, acrylonitrile-butadiene-styrene copolymers, styrene-acrylonitriles (SAN), acrylonitrile-styrene-acrylonitriles, styrene-maleic anhydride (S/MA) polymers, styrenic block copolymers including styrene-butadiene-styrene (SBS), styrene-ethylene-butylene-styrene, (SEBS) and styrene-ethylene-propylene-styrene (SEPS), styrenic terpolymers, functionalized styrenic block copolymers including hydroxylated, functionalized styrenic copolymers, and terpolymers, cellulosic polymers, liquid crystal polymers (LCP), ethylene-propylene-diene terpolymers (EPDM), ethylene-vinyl acetate copolymers (EVA), ethylene-propylene copolymers, propylene elastomers (such as those described in U.S. Pat. No. 6,525,157, to Kim et al, the entire contents of which is hereby incorporated by reference), ethylene vinyl acetates, polyureas, and polysiloxanes and any and all combinations thereof.

Of these preferred are polyamides (PA), polyphthalimide (PPA), polyketones (PK), copolyamides, polyesters, copolyesters, polycarbonates, polyphenylene sulfide (PPS), cyclic olefin copolymers (COC), polyphenylene oxides, diallylphthalate polymers, polyarylates, polyacrylates, polyphenylene ethers, and impact-modified polyphenylene ethers. Especially preferred polymers for use in the golf club heads of the present invention are the family of so called high performance engineering thermoplastics which are known for their toughness and stability at high temperatures. These polymers include the polysulfones, the polyethelipides, and the polyamide-imides. Of these, the most preferred are the polysufones.

Aromatic polysulfones are a family of polymers produced from the condensation polymerization of 4,4'-dichlorodiphenylsulfone with itself or one or more dihydric phenols. The aromatic polysulfones include the thermoplastics sometimes called polyether sulfones, and the general structure of their repeating unit has a diaryl sulfone structure which may be represented as -arylene-SO2-arylene-. These units may be linked to one another by carbon-to-carbon bonds, carbon-oxygen-carbon bonds, carbon-sulfur-carbon bonds, or via a short alkylene linkage, so as to form a thermally stable thermoplastic polymer. Polymers in this family are completely amorphous, exhibit high glass-transition temperatures, and offer high strength and stiffness properties even at high temperatures, making them useful for demanding engineering applications. The polymers also possess good ductility and toughness and are transparent in their natural state by virtue of their fully amorphous nature. Additional key attributes include resistance to hydrolysis by hot water/steam and excellent resistance to acids and bases. The polysulfones are fully thermoplastic, allowing fabrication by most standard methods such as injection molding, extrusion, and thermoforming. They also enjoy a broad range of high temperature engineering uses.

Three commercially important polysulfones are a) polysulfone (PSU); b) Polyethersulfone (PES also referred to as PESU); and c) Polyphenylene sulfoner (PPSU).

Particularly important and preferred aromatic polysulfones are those comprised of repeating units of the structure —C6H4SO2-C6H4-O— where C6H4 represents a m- or p-phenylene structure. The polymer chain can also comprise repeating units such as —C6H4-, C6H4-O—, —C6H4-(lower-alkylene)-C6H4-O—, —C6H4-O—C6H4-O—, —C6H4-S—C6H4-O—, and other thermally stable substantially-aromatic difunctional groups known in the art of engineering thermoplastics. Also included are the so called modified polysulfones where the individual aromatic rings are further substituted in one or substituents including

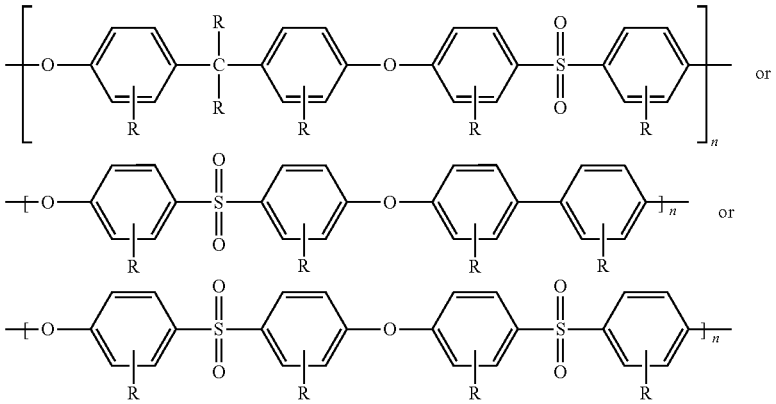

wherein R is independently at each occurrence, a hydrogen atom, a halogen atom or a hydrocarbon group or a combination thereof. The halogen atom includes fluorine, chlorine, bromine and iodine atoms. The hydrocarbon group includes, for example, a C1-C20 alkyl group, a C2-C20 alkenyl group, a C3-C20 cycloalkyl group, a C3-C20 cycloalkenyl group, and a C6-C20 aromatic hydrocarbon group. These hydrocarbon groups may be partly substituted by a halogen atom or atoms, or may be partly substituted by a polar group or groups other than the halogen atom or atoms. As specific examples of the C1-C20 alkyl group, there can be mentioned methyl, ethyl, propyl, isopropyl, amyl, hexyl, octyl, decyl and dodecyl groups. As specific examples of the C2-C20 alkenyl group, there can be mentioned propenyl, isopropepyl, butenyl, isobutenyl, pentenyl and hexenyl groups. As specific examples of the C3-C20 cycloalkyl group, there can be mentioned cyclopentyl and cyclohexyl groups. As specific examples of the C3-C20 cycloalkenyl group, there can be mentioned cyclopentenyl and cyclohexenyl groups. As specific examples of the aromatic hydrocarbon group, there can be mentioned phenyl and naphthyl groups or a combination thereof.

Individual preferred polymers include (a) the polysulfone made by condensation polymerization of bisphenol A and 4,4'-dichlorodiphenyl sulfone in the presence of base, and having the main repeating structure

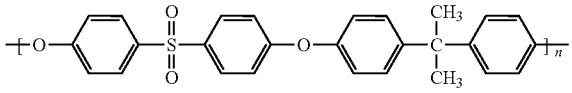

and the abbreviation PSF and sold under the tradenames Udel®, Ultrason® S, Eviva®, RTP PSU, (b) the polysulfone made by condensation polymerization of 4,4'-dihydroxydiphenyl and 4,4'-dichlorodiphenyl sulfone in the presence of base, and having the main repeating structure

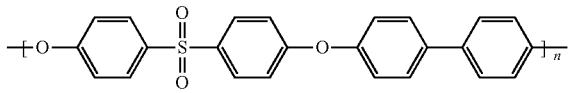

and the abbreviation PPSF and sold under the tradenames RADEL® resin; and (c) a condensation polymer made from 4,4'-dichlorodiphenyl sulfone in the presence of base and having the principle repeating structure

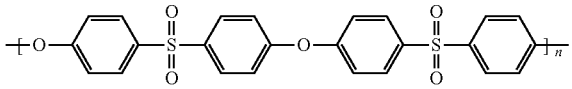

and the abbreviation PPSF and sometimes called a "polyether sulfone" and sold under the tradenames Ultrason® E, LNP™, Veradel® PESU, Sumikaexce, and VICTREX® resin," and any and all combinations thereof.

In some examples, one exemplary material from which any one or more of the sole insert 110, the crown insert 108, the cast cup 103, the ring 106, and/or the strike face, such as the strike plate 243, can be made from is a composite material, such as a carbon fiber reinforced polymeric material, made of a composite including multiple plies or layers of a fibrous material (e.g., graphite, or carbon fiber including turbostratic or graphitic carbon fiber or a hybrid structure with both graphitic and turbostratic parts present). Examples of some of these composite materials for use in the and their fabrication procedures are described in U.S. patent application Ser. No. 10/442,348 (now U.S. Pat. No. 7,267,620), Ser. No. 10/831,496 (now U.S. Pat. No. 7,140,974), Ser. Nos. 11/642,310, 11/825,138, 11/998,436, 11/895,195, 11/823,638, 12/004,386, 12/004,387, 11/960,609, 11/960,610, and 12/156,947, which are incorporated herein by reference. The composite material may be manufactured according to the methods described at least in U.S. patent application Ser. No. 11/825,138, the entire contents of which are herein incorporated by reference.

Alternatively, short or long fiber-reinforced formulations of the previously referenced polymers can be used. Exemplary formulations include a Nylon 6/6 polyamide formulation, which is 30% Carbon Fiber Filled and available commercially from RTP Company under the trade name RTP 285. This material has a Tensile Strength of 35000 psi (241 MPa) as measured by ASTM D 638; a Tensile Elongation of 2.0-3.0% as measured by ASTM D 638; a Tensile Modulus of 3.30×106 psi (22754 MPa) as measured by ASTM D 638; a Flexural Strength of 50000 psi (345 MPa) as measured by ASTM D 790; and a Flexural Modulus of 2.60×106 psi (17927 MPa) as measured by ASTM D 790.

Other materials also include is a polyphthalamide (PPA) formulation which is 40% Carbon Fiber Filled and available commercially from RTP Company under the trade name RTP 4087 UP. This material has a Tensile Strength of 360 MPa as measured by ISO 527; a Tensile Elongation of 1.4% as measured by ISO 527; a Tensile Modulus of 41500 MPa as measured by ISO 527; a Flexural Strength of 580 MPa as measured by ISO 178; and a Flexural Modulus of 34500 MPa as measured by ISO 178.

Yet other materials include is a polyphenylene sulfide (PPS) formulation which is 30% Carbon Fiber Filled and available commercially from RTP Company under the trade name RTP 1385 UP. This material has a Tensile Strength of 255 MPa as measured by ISO 527; a Tensile Elongation of 1.3% as measured by ISO 527; a Tensile Modulus of 28500 MPa as measured by ISO 527; a Flexural Strength of 385 MPa as measured by ISO 178; and a Flexural Modulus of 23,000 MPa as measured by ISO 178.

Especially preferred materials include a polysulfone (PSU) formulation which is 20% Carbon Fiber Filled and available commercially from RTP Company under the trade name RTP 983. This material has a Tensile Strength of 124 MPa as measured by ISO 527; a Tensile Elongation of 2% as measured by ISO 527; a Tensile Modulus of 11032 MPa as measured by ISO 527; a Flexural Strength of 186 MPa as measured by ISO 178; and a Flexural Modulus of 9653 MPa as measured by ISO 178.

Also, preferred materials may include a polysulfone (PSU) formulation which is 30% Carbon Fiber Filled and available commercially from RTP Company under the trade name RTP 985. This material has a Tensile Strength of 138 MPa as measured by ISO 527; a Tensile Elongation of 1.2% as measured by ISO 527; a Tensile Modulus of 20685 MPa as measured by ISO 527; a Flexural Strength of 193 MPa as measured by ISO 178; and a Flexural Modulus of 12411 MPa as measured by ISO 178.

Further preferred materials include a polysulfone (PSU) formulation which is 40% Carbon Fiber Filled and available commercially from RTP Company under the trade name RTP 987. This material has a Tensile Strength of 155 MPa as measured by ISO 527; a Tensile Elongation of 1% as measured by ISO 527; a Tensile Modulus of 24132 MPa as measured by ISO 527; a Flexural Strength of 241 MPa as measured by ISO 178; and a Flexural Modulus of 19306 MPa as measured by ISO 178.

Any one or more of the sole insert 110, the crown insert 108, the cast cup 103, the ring 106, and/or the strike face, such as the strike plate 243, can have a complex three-dimensional shape and curvature corresponding generally to a desired shape and curvature of the golf club head 100. It will be appreciated that other types of club heads, such as fairway wood-type clubs, may be manufactured using one or more of the principles, methods, and materials described herein.

Although not specifically shown, the golf club head 100 of the present disclosure may include other features to promote the performance characteristics of the golf club head 100. For example, the golf club head 100, in some implementations, includes movable weight features similar to those described in more detail in U.S. Pat. Nos. 6,773,360; 7,166,040; 7,452,285; 7,628,707; 7,186,190; 7,591,738; 7,963,861; 7,621,823; 7,448,963; 7,568,985; 7,578,753; 7,717,804; 7,717,805; 7,530,904; 7,540,811; 7,407,447; 7,632,194; 7,846,041; 7,419,441; 7,713,142; 7,744,484; 7,223,180; 7,410,425; and 7,410,426, the entire contents of each of which are incorporated herein by reference in their entirety.

In certain implementations, for example, the golf club head 100 includes slidable weight features similar to those described in more detail in U.S. Pat. Nos. 7,775,905 and 8,444,505; U.S. patent application Ser. No. 13/898,313, filed on May 20, 2013; U.S. patent application Ser. No. 14/047,880, filed on Oct. 7, 2013; U.S. Patent Application No. 61/702,667, filed on Sep. 18, 2012; U.S. patent application Ser. No. 13/841,325, filed on Mar. 15, 2013; U.S. patent application Ser. No. 13/946,918, filed on Jul. 19, 2013; U.S. patent application Ser. No. 14/789,838, filed on Jul. 1, 2015; U.S. Patent Application No. 62/020,972, filed on Jul. 3, 2014; Patent Application No. 62/065,552, filed on Oct. 17, 2014; and Patent Application No. 62/141,160, filed on Mar. 31, 2015, the entire contents of each of which are hereby incorporated herein by reference in their entirety.

According to some implementations, the golf club head 100 includes aerodynamic shape features similar to those described in more detail in U.S. Patent Application Publication No. 2013/0123040A1, the entire contents of which are incorporated herein by reference in their entirety.

In certain implementations, the golf club head 100 includes removable shaft features similar to those described in more detail in U.S. Pat. No. 8,303,431, the contents of which are incorporated by reference herein in in their entirety.

According to yet some implementations, the golf club head 100 includes adjustable loft/lie features similar to those described in more detail in U.S. Pat. Nos. 8,025,587; 8,235,831; 8,337,319; U.S. Patent Application Publication No. 2011/0312437A1; U.S. Patent Application Publication No. 2012/0258818A1; U.S. Patent Application Publication No. 2012/0122601A1; U.S. Patent Application Publication No. 2012/0071264A1; and U.S. patent application Ser. No. 13/686,677, the entire contents of which are incorporated by reference herein in their entirety.

Additionally, in some implementations, the golf club head 100 includes adjustable sole features similar to those described in more detail in U.S. Pat. No. 8,337,319; U.S. Patent Application Publication Nos. 2011/0152000A1, 2011/0312437, 2012/0122601A1; and U.S. patent application Ser. No. 13/686,677, the entire contents of each of which are incorporated by reference herein in their entirety.

In some implementations, the golf club head 100 includes composite face portion features similar to those described in more detail in U.S. patent application Ser. Nos. 11/998,435; 11/642,310; 11/825,138; 11/823,638; 12/004,386; 12/004,387; 11/960,609; 11/960,610; and U.S. Pat. No. 7,267,620, which are herein incorporated by reference in their entirety.

According to one embodiment, a method of making a golf club head, such as the golf club head 100, includes one or more of the following steps: (1) forming a body having a sole opening, forming a composite laminate sole insert, injection molding a thermoplastic composite head component over the sole insert to create a sole insert unit, and joining the sole insert unit to the body; (2) forming a body having a crown opening, forming a composite laminate crown insert, injection molding a thermoplastic composite head component over the crown insert to create a crown insert unit, and joining the crown insert unit to the body; (3) forming a weight track, capable of supporting one or more slidable weights, in the body; (4) forming the sole insert and/or the crown insert from a thermoplastic composite material having a matrix compatible for bonding with the body; (5) forming the sole insert and/or the crown insert from a continuous fiber composite material having continuous fibers selected from the group consisting of glass fibers, aramide fibers, carbon fibers and any combination thereof, and having a thermoplastic matrix consisting of polyphenylene sulfide (PPS), polyamides, polypropylene, thermoplastic polyurethanes, thermoplastic polyureas, polyamide-amides (PAI), polyether amides (PEI), polyetheretherketones (PEEK), and any combinations thereof; (6) forming both the sole insert and the weight track from thermoplastic composite materials having a compatible matrix; (7) forming the sole insert from a thermosetting material, coating a sole insert with a heat activated adhesive, and forming the weight track from a thermoplastic material capable of being injection molded over the sole insert after the coating step; (8) forming the body from a material selected from the group consisting of titanium, one or more titanium alloys, aluminum, one or more aluminum alloys, steel, one or more steel alloys, polymers, plastics, and any combination thereof; (9) forming the body with a crown opening, forming the crown insert from a composite laminate material, and joining the crown insert to the body such that the crown insert overlies the crown opening; (10) selecting a composite head component from the group consisting of one or more ribs to reinforce the golf club head, one or more ribs to tune acoustic properties of the golf club head, one or more weight ports to receive a fixed weight in a sole portion of the golf club head, one or more weight tracks to receive a slidable weight, and combinations thereof; (11) forming the sole insert and the crown insert from a continuous carbon fiber composite material; (12) forming the sole insert and the crown insert by thermosetting using materials suitable for thermosetting, and coating the sole insert with a heat activated adhesive; and (13) forming the body from titanium, titanium alloy or a combination thereof to have the crown opening, the sole insert, and the weight track from a thermoplastic carbon fiber material having a matrix selected from the group consisting of polyphenylene sulfide (PPS), polyamides, polypropylene, thermoplastic polyurethanes, thermoplastic polyureas, polyamide-amides (PAI), polyether amides (PEI), polyetheretherketones (PEEK), and any combinations thereof; and (13) forming a frame with a crown opening, forming a crown insert from a thermoplastic composite material, and joining the crown insert to the body such that the crown insert overlies the crown opening.

Reference throughout this specification to "one embodiment," "an embodiment," or similar language means that a particular feature, structure, or characteristic described in connection with the embodiment is included in at least one embodiment of the present disclosure. Appearances of the phrases "in one embodiment," "in an embodiment," and similar language throughout this specification may, but do not necessarily, all refer to the same embodiment. Similarly, the use of the term "implementation" means an implementation having a particular feature, structure, or characteristic described in connection with one or more embodiments of the present disclosure, however, absent an express correlation to indicate otherwise, an implementation may be associated with one or more embodiments.

In the above description, certain terms may be used such as "up," "down," "upper," "lower," "horizontal," "vertical," "left," "right," "over," "under" and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise. Further, the term "plurality" can be defined as "at least two." The term "about" in some embodiments, can be defined to mean within +/−5% of a given value.

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

The present subject matter may be embodied in other specific forms without departing from its spirit or essential characteristics. The described embodiments are to be considered in all respects only as illustrative and not restrictive. All changes which come within the meaning and range of equivalency of the claims are to be embraced within their scope.

What is claimed is:

1. A driver-type golf club head, comprising:

a forward portion, comprising a strike face, a strike plate that defines the strike face, and a plate opening, wherein the strike plate encloses the plate opening and is made of a non-metal material having a density between 1 g/cm$^3$ and 2 g/cm$^3$;

a rearward portion, opposite the forward portion;

a crown portion;

a sole portion, opposite the crown portion;

a heel portion;

a toe portion, opposite the heel portion;

a hollow interior region defined by the forward portion, the rearward portion, the crown portion, the sole portion, the heel portion, and the toe portion;

at least one of a crown opening, formed in the crown portion, or a sole opening, formed in the sole portion, each one of the crown opening and the sole opening is open to the hollow interior region; and an insert covering each one of the at least one crown opening, to form part of the crown portion, and the sole opening, to form part of the sole portion, the insert is made of a non-metal material having a density between about 1 g/cm$^3$ and about 2 g/cm$^3$;

wherein:

the strike face is void of through-apertures open to the hollow interior region;

a volume of the driver-type golf club head is between 350 cm$^3$ and 500 cm$^3$;

the golf club head has a center-of-gravity (CG) with an x-axis coordinate, on an x-axis of a head center face origin coordinate system of the golf club head, between-7 mm and 7 mm and a y-axis coordinate, on a y-axis of the head center face origin coordinate system of the golf club head, between 25 mm and 50 mm, and a z-axis coordinate, on a z-axis of the head center face origin coordinate system of the golf club head, less than 2 mm;

the strike face of the forward portion has a central region, defined by a 40 mm by 20 mm rectangular area centered on a geometric center of the strike face and elongated in a heel-to-toe direction;

a coefficient of restitution (COR), at the geometric center of the strike face, is at least 0.8;

a summation of a moment of inertia of the golf club head about a z-axis of a head center-of-gravity coordinate system (Izz) and a moment of inertia of the golf club head about an x-axis of the head center-of-gravity coordinate system (Ixx) is between about 700 kg·mm$^2$ and about 1,100 kg·mm$^2$;

a characteristic time (CT) of the strike face, within the central region, is no more than 257 microseconds;

before the strike face impacts a golf ball, the CT of the strike face, at the geometric center of the strike face, has an initial CT value of at least 235 microseconds;

the driver-type golf club head is configured such that after 500 impacts of a golf ball at the geometric center of the strike face, where at each impact the golf ball has a velocity of 52 meters per second, the CT of the strike face at the geometric center of the strike face is no more than five microseconds different than the initial CT value, wherein a cover of the golf ball has a Shore D hardness between, and inclusive of, 55 and 75, and the golf ball has a compression rating of between, and inclusive of, 85 and 107;

the forward portion further comprises a plate-opening recessed ledge that defines the plate opening and the plate-opening recessed ledge extends continuously about the plate opening;

the forward portion further comprises a sidewall that is angled relative to the plate-opening recessed ledge and extends about an outermost periphery of the plate-opening recessed ledge;

the strike plate is seatably engaged with the sidewall and the plate-opening recessed ledge of the forward portion;

the strike plate is adhesively bonded to the plate-opening recessed ledge and the sidewall via an adhesive interposed between the strike plate and the plate-opening recessed ledge and between the strike plate and the sidewall; and the adhesive is adhesively bonded to a bonding surface of the plate-opening recessed ledge;

at least an upper portion of the forward portion comprises an aluminum alloy;

at least an upper portion of the plate-opening recessed ledge comprises an aluminum alloy; and the strike plate has an outer surface area of no more than 4,300 $mm^2$ and no less than 3,300 $mm^2$.

2. The driver-type golf club head according to claim 1, wherein the CT of the strike face, within the central region, is no more than 251 microseconds.

3. The driver-type golf club head according to claim 2, wherein the CT of the strike face, within the central region, is no more than 245 microseconds.

4. The driver-type golf club head according to claim 1, wherein the initial CT value is at least 242 microseconds.

5. The driver-type golf club head according to claim 4, wherein the initial CT value is at least 245 microseconds.

6. The driver-type golf club head according to claim 1, wherein the initial CT value is at least 239 and the CT of the strike face, within the central region, is no more than 245 microseconds.

7. The driver-type golf club head according to claim 1, wherein, after the 500 impacts of the golf ball at the geometric center of the strike face, the CT of the strike face, within the central region, is no more than between 3 microseconds and 5 microseconds more than the initial CT value.

8. The driver-type golf club head according to claim 1, wherein, after the 500 impacts of the golf ball at the geometric center of the strike face, the CT of the strike face, within the central region, is no more than between 1% and 2% greater than the initial CT value.

9. The driver-type golf club head according to claim 1, wherein the driver-type golf club head is configured such that after the 500 impacts of the golf ball at the geometric center of the strike face, where at each impact the golf ball has a velocity of 52 meters per second, the CT of the strike face at any point within the central region is less than 245 microseconds.

10. The driver-type golf club head according to claim 1, wherein the COR, at the geometric center of the strike face, is at least 0.81.

11. The driver-type golf club head according to claim 1, wherein the COR of the strike face, within a surface area of the strike face of at least 200 $mm^2$, is at least 0.79.

12. The driver-type golf club head according to claim 11, wherein the COR of the strike face, within a surface area of the strike face of at least 250 $mm^2$, is at least 0.79.

13. The driver-type golf club head according to claim 1, wherein the COR is at least 0.8 for at least 25% of the strike face within the central region.

14. The driver-type golf club head according to claim 1, wherein the driver-type golf club head is configured such that after the 500 impacts of the golf ball at the geometric center of the strike face, where at each impact the golf ball has a velocity of 52 meters per second, the CT of the strike face at the geometric center of the strike face is no more than three microseconds different than the initial CT value.

15. The driver-type golf club head according to claim 1, wherein the strike face is made of a fiber-reinforced polymer.

16. The driver-type golf club head according to claim 1, wherein a ratio of a total surface area of the bonding surface of the plate-opening recessed ledge to a total surface area of an interior surface of the strike plate opposite the strike face is between 0.21 and 0.45.

17. The driver-type golf club head according to claim 1, wherein:

the forward portion is a separately formed cup;

the cup has a total mass; and a portion of the cup comprised of aluminum alloy has a mass of at least 23.9 grams and the club head has a total mass of no more than 210 grams.

18. The driver-type golf club head according to claim 17, wherein the cup has a multi-piece construction and the total mass of the cup is no more than 109.1 grams.

19. The driver-type golf club head according to claim 18, wherein a lower portion of the cup is formed of a higher density material having a density of between 5.6 g/cc and 20.0 g/cc.

20. The driver-type golf club head according to claim 17, wherein at least a lower portion of the cup is formed of an aluminum alloy.

21. A driver-type golf club head, comprising:

a forward portion, comprising a strike face, a strike plate that defines the strike face, and a plate opening, wherein the strike plate encloses the plate opening and is made of a fiber-reinforced polymer;

a rearward portion, opposite the forward portion;

a crown portion;

a sole portion, opposite the crown portion;

a heel portion;

a toe portion, opposite the heel portion;

a hollow interior region defined by the forward portion, the rearward portion, the crown portion, the sole portion, the heel portion, and the toe portion;

at least one of a crown opening, formed in the crown portion, or a sole opening, formed in the sole portion, each one of the crown opening and the sole opening is open to the hollow interior region; and an insert covering each one of the at least one crown opening, to form part of the crown portion, and the sole opening, to form part of the sole portion, the insert is made of a non-metal material having a density between about 1 $g/cm^3$ and about 2 $g/cm^3$;

wherein:

the strike face is void of through-apertures open to the hollow interior region;

a volume of the driver-type golf club head is between 350 $cm^3$ and 500 $cm^3$;

the golf club head has a center-of-gravity (CG) with an x-axis coordinate, on an x-axis of a head center face origin coordinate system of the golf club head, between −7 mm and 7 mm and a y-axis coordinate, on a y-axis of the head center face origin coordinate system of the golf club head, between 25 mm and 50 mm, and a z-axis coordinate, on a z-axis of the head center face origin coordinate system of the golf club head, less than 2 mm;

the strike face of the forward portion has a central region, defined by a 40 mm by 20 mm rectangular area centered on a geometric center of the strike face and elongated in a heel-to-toe direction;

a coefficient of restitution (COR), at the geometric center of the strike face, is at least 0.8;

a summation of a moment of inertia of the golf club head about a z-axis of a head center-of-gravity coordinate system (Izz) and a moment of inertia of the golf club head about an x-axis of the head center-of-gravity coordinate system (Ixx) is between about 740 kg·mm$^2$ and about 1,100 kg·mm$^2$;

a characteristic time (CT) of the strike face, at any point within the central region, is less than 256 microseconds;

before the strike face impacts a golf ball, the CT of the strike face, at the geometric center of the strike face, has an initial CT value of at least 235 microseconds;

the driver-type golf club head is configured such that after 500 impacts of a golf ball at the geometric center of the strike face, where at each impact the golf ball has a velocity of 52 meters per second, the CT of the strike face at the geometric center of the strike face is no more than three microseconds different than the initial CT value, wherein a cover of the golf ball has a Shore D hardness between, and inclusive of, 55 and 75, and the golf ball has a compression rating of between, and inclusive of, 85 and 107;

the forward portion further comprises a plate-opening recessed ledge that defines the plate opening and the plate-opening recessed ledge extends continuously about the plate opening;

the strike plate is seatably engaged with the plate-opening recessed ledge of the forward portion;

the strike plate is adhesively bonded to the plate-opening recessed ledge via an adhesive interposed between an interior surface of the strike plate and the plate-opening recessed ledge;

other than the adhesive, an interior surface of an entirety of the forward portion is void of contact with any structural material;

at least an upper portion of the forward portion comprises an aluminum alloy;

at least an upper portion of the plate-opening recessed ledge comprises an aluminum alloy; and the strike plate has an outer surface area of no more than 4,300 mm$^2$ and no less than 3,300 mm$^2$.

22. The driver-type golf club head according to claim 21, wherein the initial CT value is at least 245 microseconds.

23. The driver-type golf club head according to claim 21, wherein the initial CT value is no more than 245 microseconds.

24. The driver-type golf club head according to claim 21, wherein the CT of the strike face, within the central region, is no more than 251 microseconds.

25. The driver-type golf club head according to claim 24, wherein the CT of the strike face, within the central region, is no more than 245 microseconds.

26. The driver-type golf club head according to claim 21, wherein the strike face is made of a fiber-reinforced polymer.

27. A driver-type golf club head, comprising:

a forward portion, comprising a strike face, a strike plate that defines the strike face, and a plate opening, wherein the strike plate encloses the plate opening and is made of a non-metal material having a density between 1 g/cm$^3$ and 2 g/cm$^3$;

a rearward portion, opposite the forward portion;

a crown portion;

a sole portion, opposite the crown portion;

a heel portion;

a toe portion, opposite the heel portion;

a hollow interior region defined by the forward portion, the rearward portion, the crown portion, the sole portion, the heel portion, and the toe portion;

at least one of a crown opening, formed in the crown portion, or a sole opening, formed in the sole portion, each one of the crown opening and the sole opening is open to the hollow interior region; and an insert covering each one of the at least one crown opening, to form part of the crown portion, and the sole opening, to form part of the sole portion, the insert is made of a non-metal material having a density between about 1 g/cm$^3$ and about 2 g/cm$^3$;

wherein:

the strike face is void of through-apertures open to the hollow interior region;

a volume of the driver-type golf club head is between 350 cm$^3$ and 500 cm$^3$;

the golf club head has a center-of-gravity (CG) with an x-axis coordinate, on an x-axis of a head center face origin coordinate system of the golf club head, between −7 mm and 7 mm and a y-axis coordinate, on a y-axis of the head center face origin coordinate system of the golf club head, between 25 mm and 50 mm, and a z-axis coordinate, on a z-axis of the head center face origin coordinate system of the golf club head, less than 2 mm;

the strike face of the forward portion has a central region, defined by a 40 mm by 20 mm rectangular area centered on a geometric center of the strike face and elongated in a heel-to-toe direction;

a characteristic time (CT) of the strike face, at any point within the central region, is less than 256 microseconds;

before the strike face impacts a golf ball, a characteristic time (CT) of the strike face, at the geometric center of the strike face, has an initial CT value of at least 242 microseconds;

the driver-type golf club head is configured such that after 500 impacts of a golf ball at the geometric center of the strike face, where at each impact the golf ball has a velocity of 52 meters per second, the CT of the strike face at the geometric center of the strike face is no more than three microseconds different than the initial CT value, wherein a cover of the golf ball has a Shore D hardness between, and inclusive of, 55 and 75, and the golf ball has a compression rating of between, and inclusive of, 85 and 107;

the forward portion further comprises a plate-opening recessed ledge that defines the plate opening and the plate-opening recessed ledge extends continuously about the plate opening;

the forward portion further comprises a sidewall that is angled relative to the plate-opening recessed ledge and extends about an outermost periphery of the plate-opening recessed ledge;

the strike plate is seatably engaged with the sidewall and the plate-opening recessed ledge of the forward portion;

the strike plate is adhesively bonded to the plate-opening recessed ledge and the sidewall via an adhesive interposed between the strike plate and the plate-opening recessed ledge and between the strike plate and the sidewall;

other than the adhesive, an interior surface of an entirety of the forward portion is void of contact with any structural material;

the adhesive is adhesively bonded to a bonding surface of the plate-opening recessed ledge;

at least an upper portion of the forward portion comprises an aluminum alloy;

at least an upper portion of the plate-opening recessed ledge comprises an aluminum alloy; and the strike plate has an outer surface area of no more than 4,300 $mm^2$ and no less than 3,300 $mm^2$.

* * * * *